US005659847A

United States Patent [19]

Tsuda et al.

[11] Patent Number: 5,659,847

[45] Date of Patent: Aug. 19, 1997

[54] PROCESS CARTRIDGE HAVING POSITIONING MEMBER FOR POSITIONING OPTICAL DEVICE

[75] Inventors: Tadayuki Tsuda; Kazumi Sekine; Isao Ikemoto, all of Kawasaki; Kazushi Watanabe, Yokohama; Yoshikazu Sasago, Tokyo; Shinya Noda, Yokohama; Kazunori Kobayashi, Kawasaki, all of Japan

[73] Assignee: Canon Kabushiki Kaisha, Tokyo, Japan

[21] Appl. No.: 952,692

[22] Filed: Sep. 28, 1992

[30] Foreign Application Priority Data

Jun. 30, 1992 [JP] Japan ..... 4-194653
Jun. 30, 1992 [JP] Japan ..... 4-194664

[51] Int. Cl.[6] ..... G03G 21/18

[52] U.S. Cl. ..... 399/113; 399/118

[58] Field of Search ..... 355/200, 210, 355/211, 260, 228, 245

[56] References Cited

U.S. PATENT DOCUMENTS

| | | | |
|---|---|---|---|
| 3,985,436 | 10/1976 | Tanaka et al. | 355/200 |
| 4,500,195 | 2/1985 | Hosono | 355/208 |
| 4,540,268 | 9/1985 | Toyono et al. | 355/210 |
| 4,591,258 | 5/1986 | Nishiro et al. | 355/200 |
| 4,609,276 | 9/1986 | Mitzutani | 355/210 |
| 4,627,701 | 12/1986 | Onoda et al. | 255/221 |
| 4,708,455 | 11/1987 | Kubota et al. | 355/211 |
| 4,839,690 | 6/1989 | Onoda et al. | 355/211 |
| 4,873,548 | 10/1989 | Kobayashi et al. | 355/200 |
| 4,888,620 | 12/1989 | Fujino et al. | 355/211 |
| 4,963,928 | 10/1990 | Yoshiura | 355/210 |
| 4,972,227 | 11/1990 | Onoda et al. | 355/210 |
| 5,028,966 | 7/1991 | Kozuka et al. | 355/260 |
| 5,089,846 | 2/1992 | Tabuchi | 355/200 |
| 5,095,335 | 3/1992 | Watanabe et al. | 355/210 |
| 5,111,244 | 5/1992 | Koyama et al. | 355/210 |
| 5,160,963 | 11/1992 | Haneda et al. | 355/200 |
| 5,294,960 | 3/1994 | Nomura et al. | 355/210 |
| 5,404,198 | 4/1995 | Noda et al. | 355/200 |

FOREIGN PATENT DOCUMENTS

| | | | |
|---|---|---|---|
| 0322219 | 6/1989 | European Pat. Off. . | |
| 0453963 | 10/1991 | European Pat. Off. | 355/210 |
| 0147377 | 8/1984 | Japan . | |
| 0156070 | 7/1986 | Japan | 355/211 |
| 61-231574 | 10/1986 | Japan . | |
| 0018367 | 1/1988 | Japan | 355/211 |
| 63-149669 | 6/1988 | Japan . | |
| 0166055 | 6/1989 | Japan . | |
| 0002786 | 1/1991 | Japan | 355/211 |

OTHER PUBLICATIONS

Lioy et al., Xerox Disclosure Journal, vol. 10, No. 3, May/Jun. 1985.

*Primary Examiner*—Robert Beatty
*Attorney, Agent, or Firm*—Fitzpatrick, Cella, Harper & Scinto

[57] ABSTRACT

A process cartridge includes a first upper and second lower frame, separably engageable to each other, an image bearing member, a process means acting on the image bearing member, and a positioning device for positioning an optical unit of an image forming apparatus when the process cartridge is mounted within the image forming apparatus. With this arrangement, the present invention can provide a process cartridge and an image forming apparatus capable of mounting the process cartridge, which can form an image with higher quality than that of the conventional techniques, without distorting the image. The positioning member is located on the second lower frame and passes through openings formed on the first upper frame in order to position the optical unit.

40 Claims, 42 Drawing Sheets

PROCESS CARTRIDGE HAVING POSITIONING MEMBER FOR POSITIONING OPTICAL DEVICE

BACKGROUND OF THE INVENTION

1. Field of the Invention

The present invention relates to a process cartridge and an image forming system on which such a process cartridge can be mounted. Such an image forming system may be embodied, for example, as an electrophotographic copying machine, a laser beam printer, a facsimile machine, a word processor or the like.

2. Related Background Art

In image forming systems such as copying machines, a latent image is formed by selectively exposing a uniformly charged image bearing member. The latent image is then visualized with toner and the toner image is transferred onto a recording sheet, thereby forming an image on the recording sheet. In such image forming systems, whenever the toner is used up, it must be replenished. The toner replenishing operation is not only troublesome, but also often causes contamination of the surroundings. Further, users are inconvenienced by the fact that the maintenance of various elements or members can be performed only by an expert in the art.

In order to eliminate such drawbacks and inconvenience, an image forming system wherein parts such as a developing device in which the toner therein has been used up or an image bearing member in which a service life thereof has expired, can easily be exchanged, thereby facilitating the maintenance, by assembling the image bearing member, a charger, the developing device and a cleaning device integrally as a process cartridge which can be removably mounted within the image forming system has been proposed and put into practical use, for example, as disclosed U.S. Pat. Nos. 3,985,436, 4,500,195, 4,540,268 and 4,627,701.

However, in the conventional art it was feared that there arose a discrepancy in distance between the original support plate and the surface of photosensitive drum, in accordance with the discrepancy in dimensional accuracy of each part and positional shift of the process cartridge in mounting thereof, thereby distorting the light image incident on the photosensitive member.

In the above-mentioned process cartridge, the following arrangement is known to enhance the positional accuracy between the image bearing member (photosensitive drum) and an optical means of the image forming system (as disclose in U.S. Pat. No. 4,972,227).

That is to say, it is known to arrange on a frame (of the process cartridge) for supporting the photosensitive drum, a positioning portion engageable by structure integral with the optical means attached to the image forming system when the process cartridge is mounted within the image forming system while shifting the process cartridge in an axial direction of the photosensitive drum. With this arrangement, it is possible to position the process cartridge with respect to the optical means of the image forming system with the least number of parts.

SUMMARY OF THE INVENTION

An object of the present invention is to provide an image forming system and a removable process cartridge therefor, which can form an image with higher quality than the conventional one without distorting the image.

Another object of the present invention is to provide a process cartridge and an image forming system capable of removably mounting such process cartridge therein, which can enhance the positional accuracy between an image bearing member of the process cartridge and an optical means of the image forming system more than those in the conventional techniques.

A further object of the present invention is to provide a process cartridge and an image forming system capable of removably mounting such a process cartridge therein, which can enhance the positional accuracy between an image bearing member of the process cartridge and an original support plate of the image forming system more than those in the conventional techniques.

yet another object of the present invention is to provide a process cartridge and an image forming system capable of removably mounting such process cartridge therein, which can enhance the accuracy in distance of an optical path from an original support plate to an image bearing member, thereby forming an image with higher quality than those in the conventional techniques.

DETAILED DESCRIPTION OF THE PREFERRED EMBODIMENTS

First of all, a process cartridge according to a first embodiment of the present invention, and an image forming system utilizing such a process cartridge will be explained with reference to the accompanying drawings.

Figure 2:
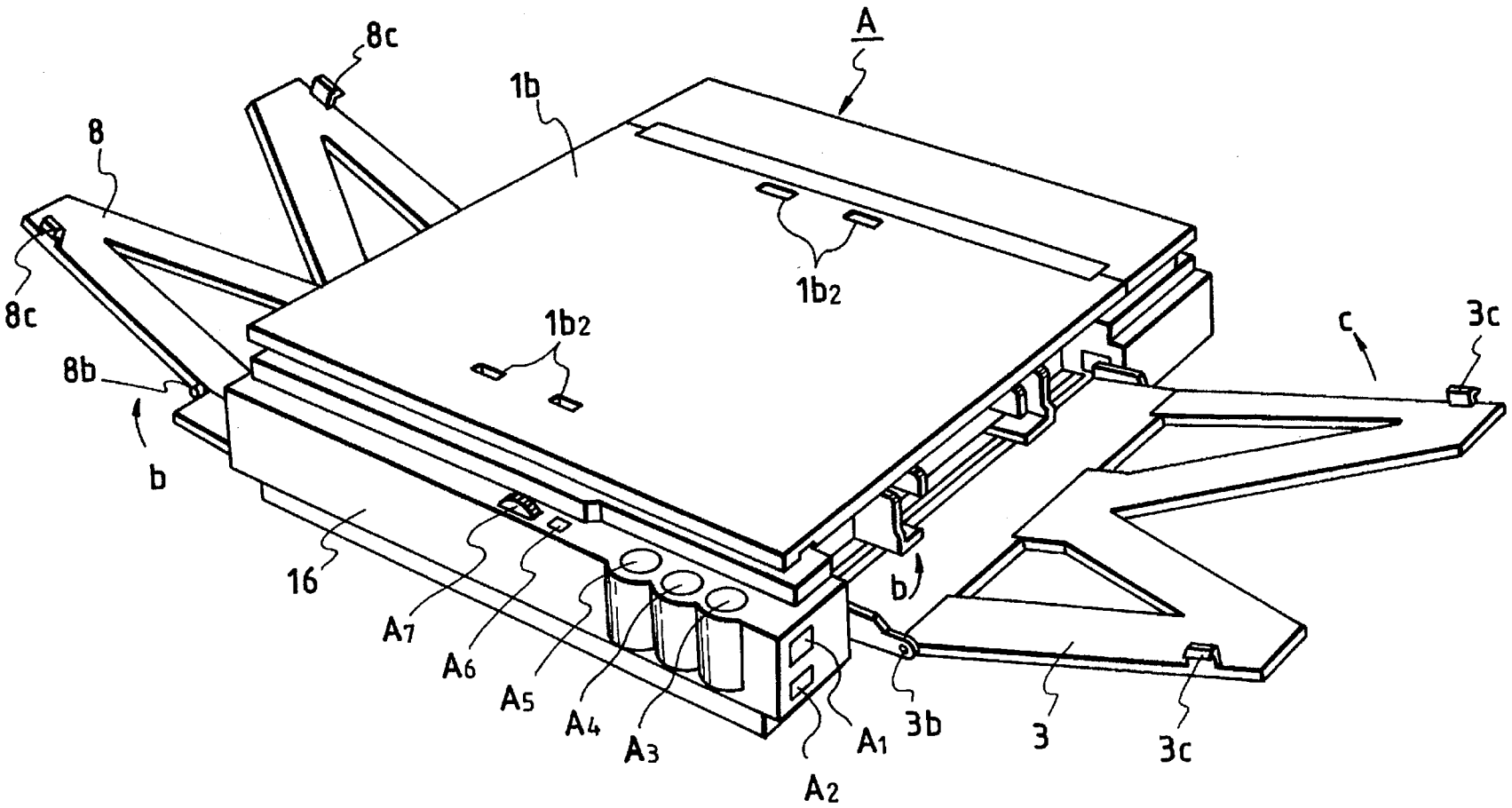
FIG. 2 is a perspective view of the copying machine in a condition that a tray is opened.
Figure 3:
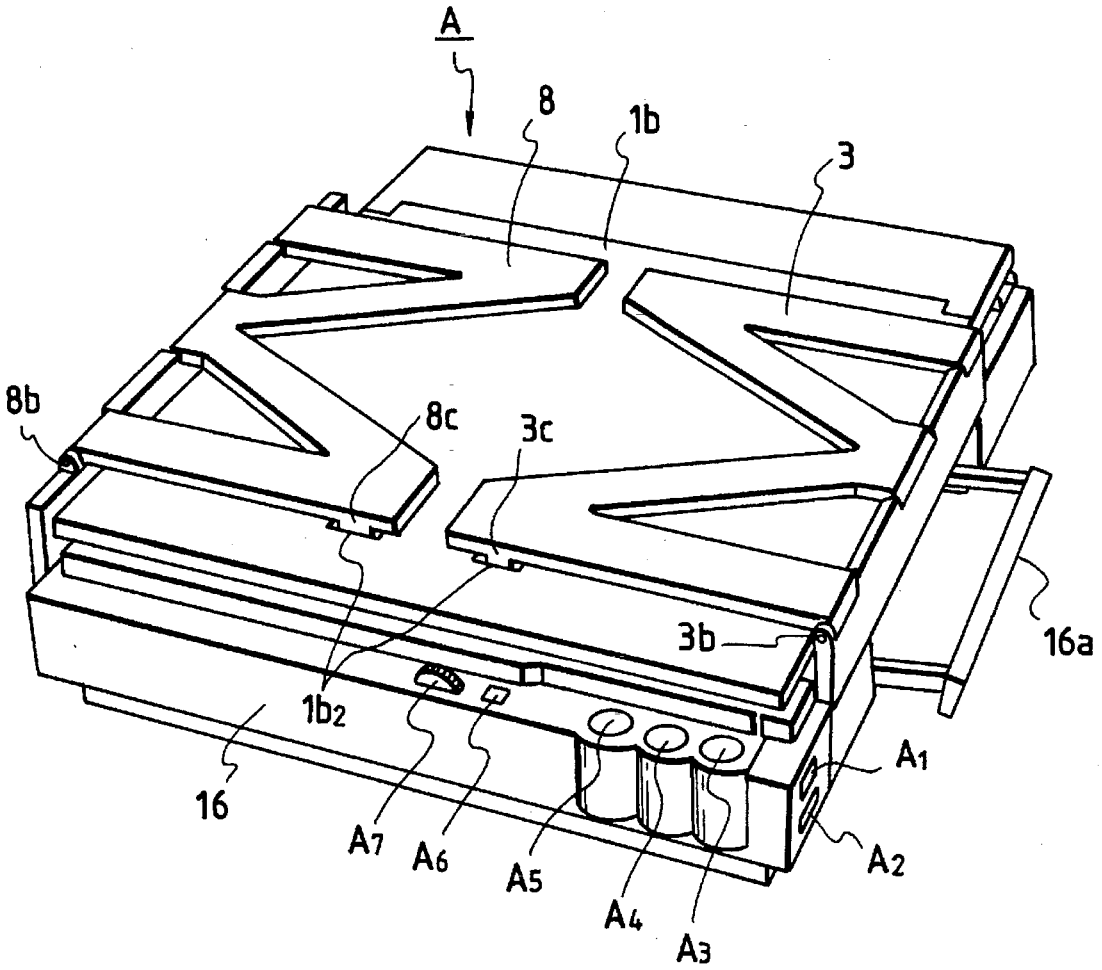
FIG. 3 is a perspective view of the copying machine in a condition that a tray is closed.
Figure 4:
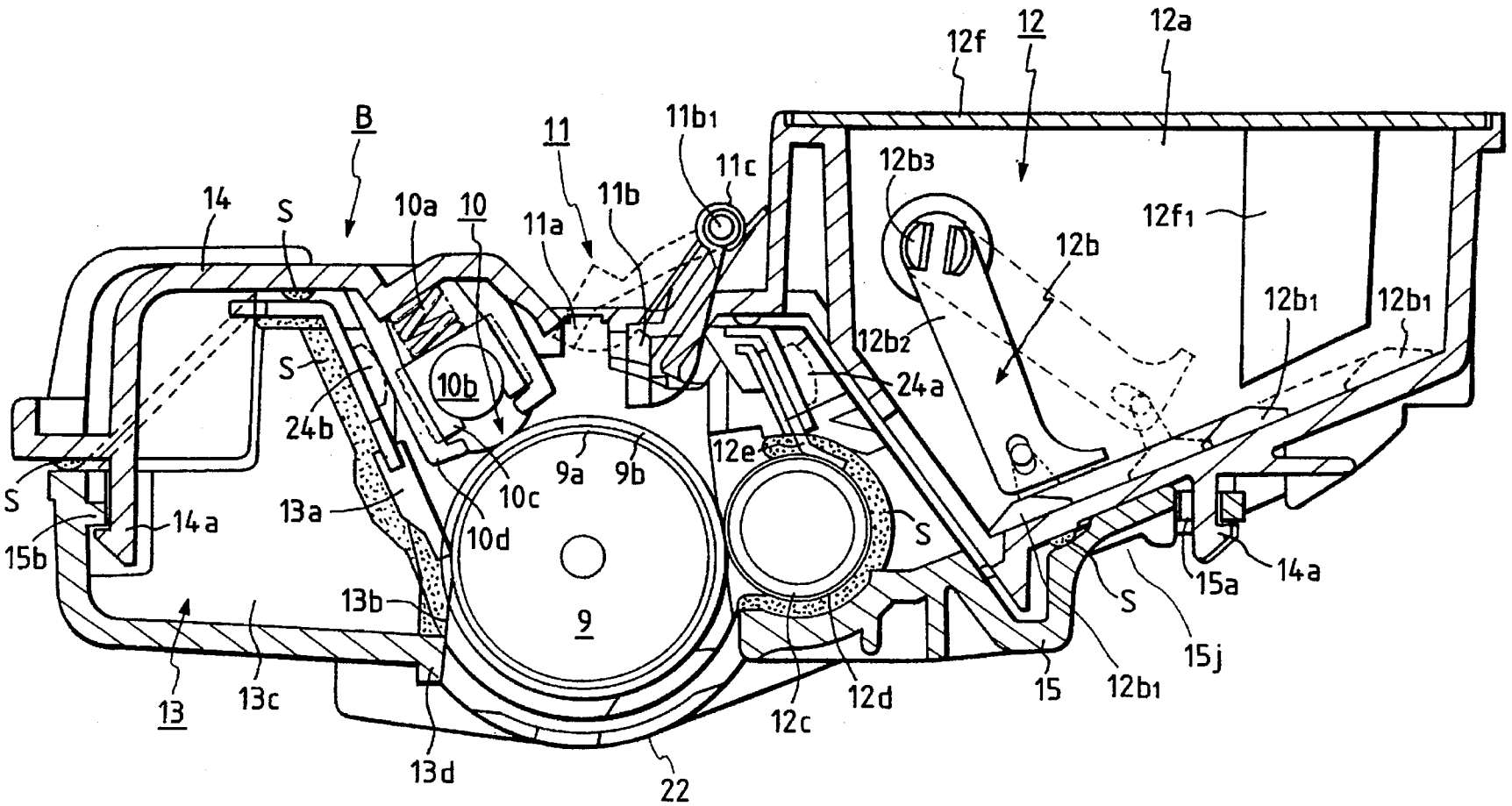
FIG. 4 is an elevational sectional view of the process cartridge.
Figure 5:
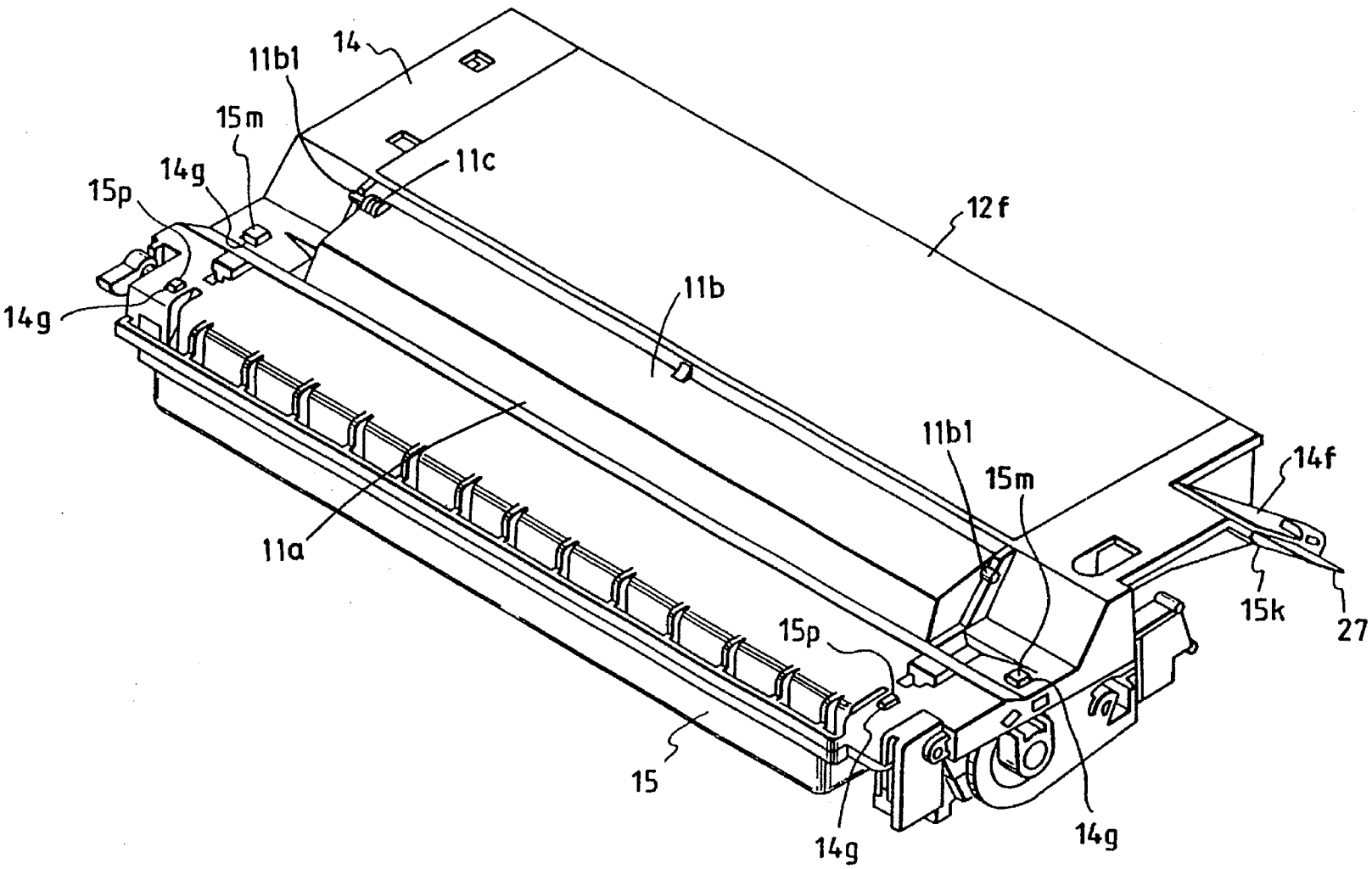
FIG. 5 is a perspective view of the process cartridge.
Figure 6:
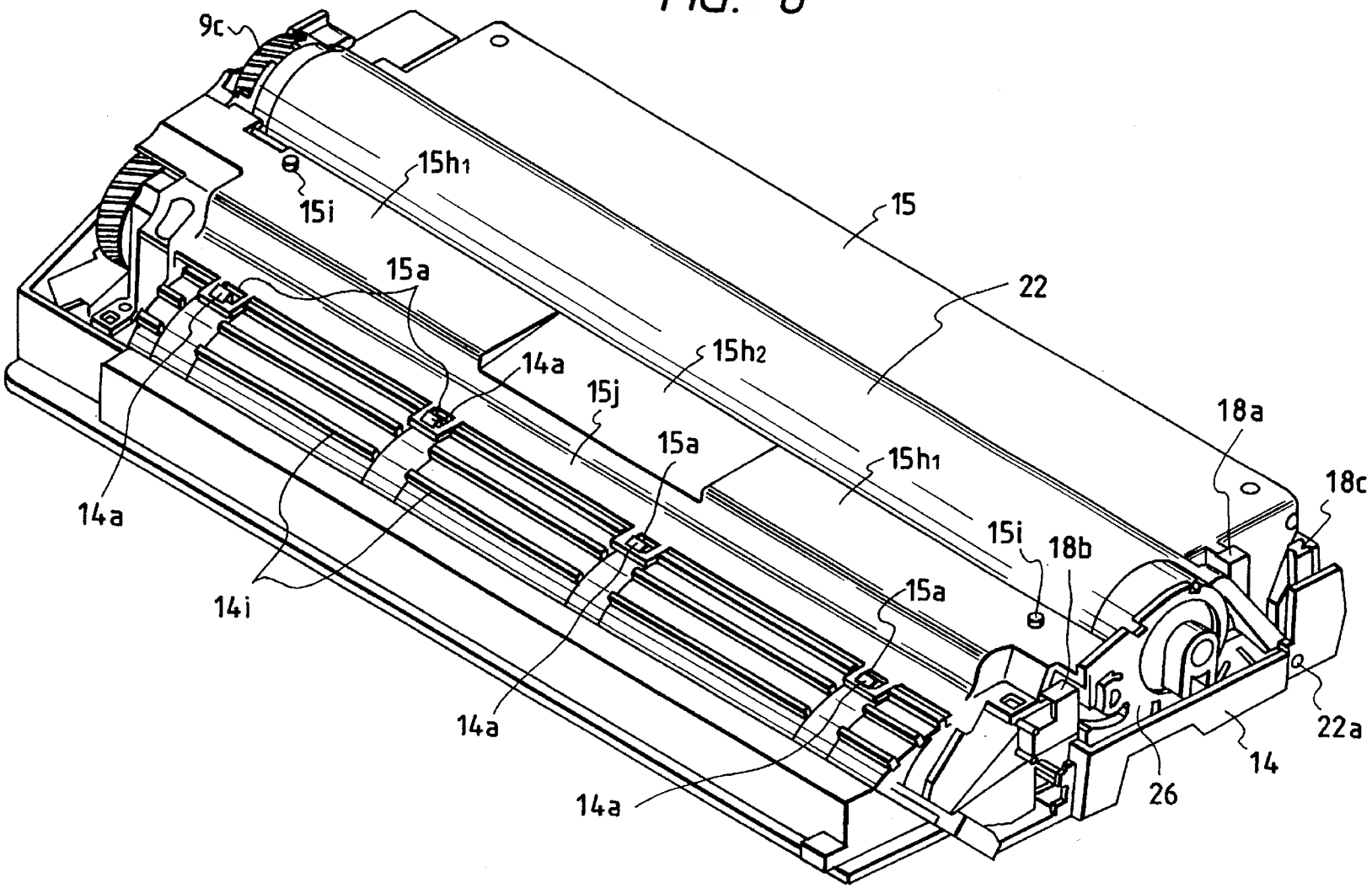
FIG. 6 is a perspective view of the process cartridge in an inverted condition.

The Whole Construction of a Process Cartridge and an Image Forming System Mounting the Process Cartridge thereon:

First of all, the whole construction of the image forming system will briefly be described. Incidentally, FIG. 1 is an elevational sectional view of a copying machine as an example of the image forming system, within which the process cartridge is mounted, FIG. 2 is a perspective view of the copying machine with a tray opened, FIG. 3 is a perspective view of the copying machine with the tray closed, FIG. 4 is an elevational sectional view of the process cartridge, FIG. 5 is a perspective view of the process cartridge, and FIG. 6 is a perspective view of the process cartridge in an inverted condition.

Figure 1:
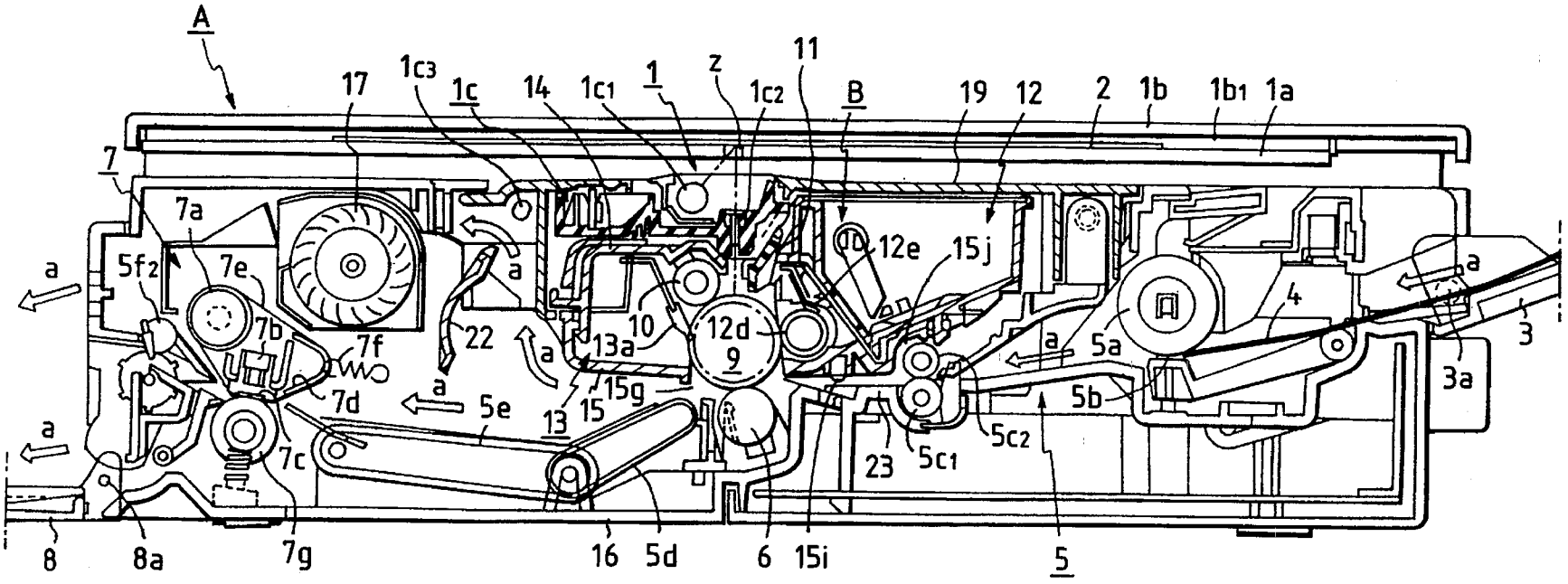
FIG. 1 is an elevational sectional view of a copying machine within which a process cartridge according to a preferred embodiment of the present invention is mounted.

As shown in FIG. 1, the image forming system A operates to optically read image information on an original or document 2 by an original reading means 1. A recording medium rested on a sheet supply tray 3 manually inserted from the sheet supply tray 3 is fed, by a feeding means 5, to an image forming station of the process cartridge B, where a developer (referred to as "toner" hereinafter) image formed in response to the image information is transferred onto the recording medium 4 by a transfer means 6. Thereafter, the recording medium 4 is sent to a fixing means 7 where the transferred toner image is permanently fixed to the recording medium 4. Then, the recording medium is ejected onto an ejection tray 8.

The process cartridge B defining the image forming station operates to uniformly charge a surface of a rotating photosensitive drum (image bearing member) 9 by a charger means 10, then to form a latent image on the photosensitive drum 9 by illuminating a light image read by the reading means 1 on the photosensitive drum by means of an exposure means 11, and then to visualize the latent image as a toner image by a developing means 12. After the toner image is transferred onto the recording medium 4 by the transfer means 6, the residual toner remaining on the photosensitive drum 9 is removed by a cleaning means 13.

Incidentally, the process cartridge B is formed as a cartridge unit by housing the photosensitive drum 9 and the like within frames which include a first or upper frame 14 and a second or lower frame 15. Further, in the illustrated embodiment, the frames 14, 15 are made of high impact styrol resin (HIPS), and a thickness of the upper frame 14 is about 2 mm and a thickness of the lower frame 15 is about 2.5 mm. However, material and thickness of the frames are not limited to the above, but may be selected appropriately.

Next, various parts of the image forming system A and the process cartridge B which is mountable within the image forming system will be fully described.

Image Forming System

First of all, various parts of the image forming system A will be explained.

(Original Reading Means)

The original reading means 1 serves to optically read the information written on the original, and, as shown in FIG. 1, includes an original glass support 1*a* which is disposed at an upper portion of a body 16 of the image forming system and on which the original 2 is to be rested. An original hold-down plate 1*b* having a sponge layer 1*b*1 on its inner surface is attached to the original glass support 1*a* for the opening and closing movement. The original glass support 1*a* and the original hold-down plate 1*b* are mounted on the system body 16 for reciprocal sliding movement in the left and right directions in FIG. 1. On the other hand, a lens unit 1*c* is disposed below the original glass support la at the upper portion of the system body 16 and includes a light source 1*c*1 and a short focus focusing lens array 1*c*2 therein.

With this arrangement, when the original 2 is rested on the original glass support 1*a* with an image surface thereof faced downside and the light source 1*c*1 is activated and the original glass support 1*a* is slid in the left and right direction in FIG. 1, the photosensitive drum 9 of the process cartridge B is exposed by reflection light from the original 2 via the lens array 1*c*2.

(Recording Medium Feeding Means)

The feeding means 5 serves to feed the recording medium 4 rested on the sheet supply tray 3 to the image forming station and to feed the recording medium to the fixing means 7. More particularly, after a plurality of recording media 4 are stacked on the sheet supply tray 3 or a single recording medium 4 is manually inserted on the sheet supply tray 3, and leading end(s) of the recording media or medium are abutted against a nip between a sheet supply roller 5*a* and a friction pad 5*b* urged against the roller, when a copy start button A3 is depressed, the sheet supply roller 5*a* is rotated to separate and feed the recording medium 4 to a pair of register rollers 5*c*1, 5*c*2 which, in turn, feed the recording medium is registration with the image forming operation. After the image forming operation, the recording medium 4 is fed to the fixing means 7 by a convey belt 5*d* and a guide member 5*e*, and then is ejected onto the ejection tray 8 by a pair of ejector rollers 5*f*1, 5*f*2.

(Transfer Means)

The transfer means 6 serves to transfer the toner image formed on the photosensitive drum 9 onto the recording medium 4 and, in the illustrated embodiment, as shown in FIG. 1, it comprises a transfer roller 6. More particularly, by urging the recording medium 4 against the photosensitive drum 9 in the process cartridge B mounted within the image forming system by means of the transfer roller 6 provided in the image forming system and by applying to the transfer roller 6 a voltage having the polarity opposite to that of the toner image formed on the photosensitive drum 9, the toner image on the photosensitive drum 9 is transferred onto the recording medium 4.

(Fixing Means)

The fixing means 7 serves to fix the toner image transferred to the recording medium 4 by applying the voltage to the transfer roller 6 and, as shown in FIG. 1, comprises a heat-resistive fixing film 7*e* wound around and extending between a driving roller 7*a*, a heating body 7*c* held by a holder 7*b* and a tension plate 7*d*. Incidentally, the tension plate 7*d* is biased by a tension spring 7*f* to apply a tension force to the film 7*e*. A pressure roller 7*g* is urged against the heating body 7*c* with the interposition of the film 7*e* so that the fixing film 7*e* is pressurized against the heating body 7*c* with a predetermined force required by the fixing operation.

The heating body 7*c* is made of heat-resistive material such as alimina and has a heat generating surface comprised of a wire-shaped or plate-shaped members having a width of about 160 μm and a length (dimension perpendicular to a plane of FIG. 1) of about 216 mm and made of $Ta_2N$ for example arranged on an under surface of the holder 7*b* made of insulation material or composite material including insulation, and a protection layer made of $Ta_2O$ for example and covering the heat generating surface. The lower surface of the heating body 7*c* is flat, and front and rear ends of the heating body are rounded to permit the sliding movement of the fixing film 7*e*. The fixing film 7*e* is made of heat-treated polyester and has a thickness of about 9 μm. The film can be rotated in a clockwise direction by the rotation of the driving roller 7*a*. When the recording medium 4 to which the toner image was transferred passes through between the fixing film 7*e* and the pressure roller 7*g*, the toner image is fixed to the recording medium 4 by heat and pressure.

Incidentally, in order to escape or discharge the heat generated by the fixing means 7 out of the image forming system, a cooling fan 17 is provided within the body 16 of the image forming system. The fan 17 is rotated, for example when the copy start button A3 (FIG. 2) is depressed, so as to generate air flows a (FIG. 1) flowing into the image forming system from the recording medium supply inlet and flow out from the recording medium ejecting outlet. The various parts including the process cartridge B are cooled by the air flows so that the heat does not remain in the image forming system.

(Recording Medium Supply and Ejection Trays)

As shown in FIGS. 1 to 3, the sheet supply tray and the ejection tray 8 are mounted on shafts 3*a*, 8*a*, respectively within the system body 16 for pivotal movements in directions b in FIG. 2, and for pivotal movements around shafts 3*b*, 8*b* in directions c in FIG. 2. Locking projections 3*c*, 8*c* are formed on free ends of the trays 3, 8 at both sides thereof, respectively. These projections can be fitted into locking recesses 1*b*2 formed in an upper surface of the original hold-down plate 1*b*. Thus, as shown in FIG. 3, when the trays 3, 8 are folded inwardly to fit the locking projections 3*c*, 8*c* into the corresponding recesses 1*b*2, the original glass support 1*a* and the original hold-down plate 1*b* are prevented from sliding in the left and right directions. As a result, an operator can easily lift the image forming system A via grippers 16*a* and transport it.

(Setting Buttons for Density and the like)

Incidentally, setting buttons for setting the density and the like are provided on the image forming system A. Briefly explaining, in FIG. 2, a power switch A1 is provided to turn the image forming system ON and OFF. A density adjusting dial A2 is used to adjust the fundamental density (of the copied image) of the image forming system. The copy start button A3, when depressed, starts the copying operation of the image forming system. A copy clear button A4, when depressed, interrupts the copying operation and clears the various setting conditions (for example, the set density condition). A copy number counter button A5 serves to set the number of copies when depressed. An automatic density setting button A6, when depressed, automatically sets the density in the copying operation. A density setting dial A7 is provided so that the operator can adjust the copy density by rotating this dial at need.

Process Cartridge

Next, various parts of the process cartridge B, which can be mounted within the image forming system A, will be explained.

The process cartridge B includes an image bearing member and at least one process means. For example, the process means may comprise a charge means for charging a surface of the image bearing member, a developing means for forming a toner image on the image bearing member and/or a cleaning means for removing the residual toner remaining on the image bearing member. As shown in FIGS. 1 and 4, in the illustrated embodiment, the process cartridge B is constituted as a cartridge unit which can be removably mounted within the body 16 of the image forming system, by enclosing the charger means 10, the developing means 12 containing the toner (developer) and the cleaning means 13 which are arranged around the photosensitive drum 9 as the image bearing member by a housing comprising the upper and lower frames 14, 15. The charger means 10, exposure means 11 (opening 11*a*) and toner reservoir 12*a* of the developing means 12 are disposed within the upper frame 14, and the photosensitive drum 9, developing sleeve 12*d* of the developing means 12 and cleaning means 13 are disposed within the lower frame 15.

Figure 7:
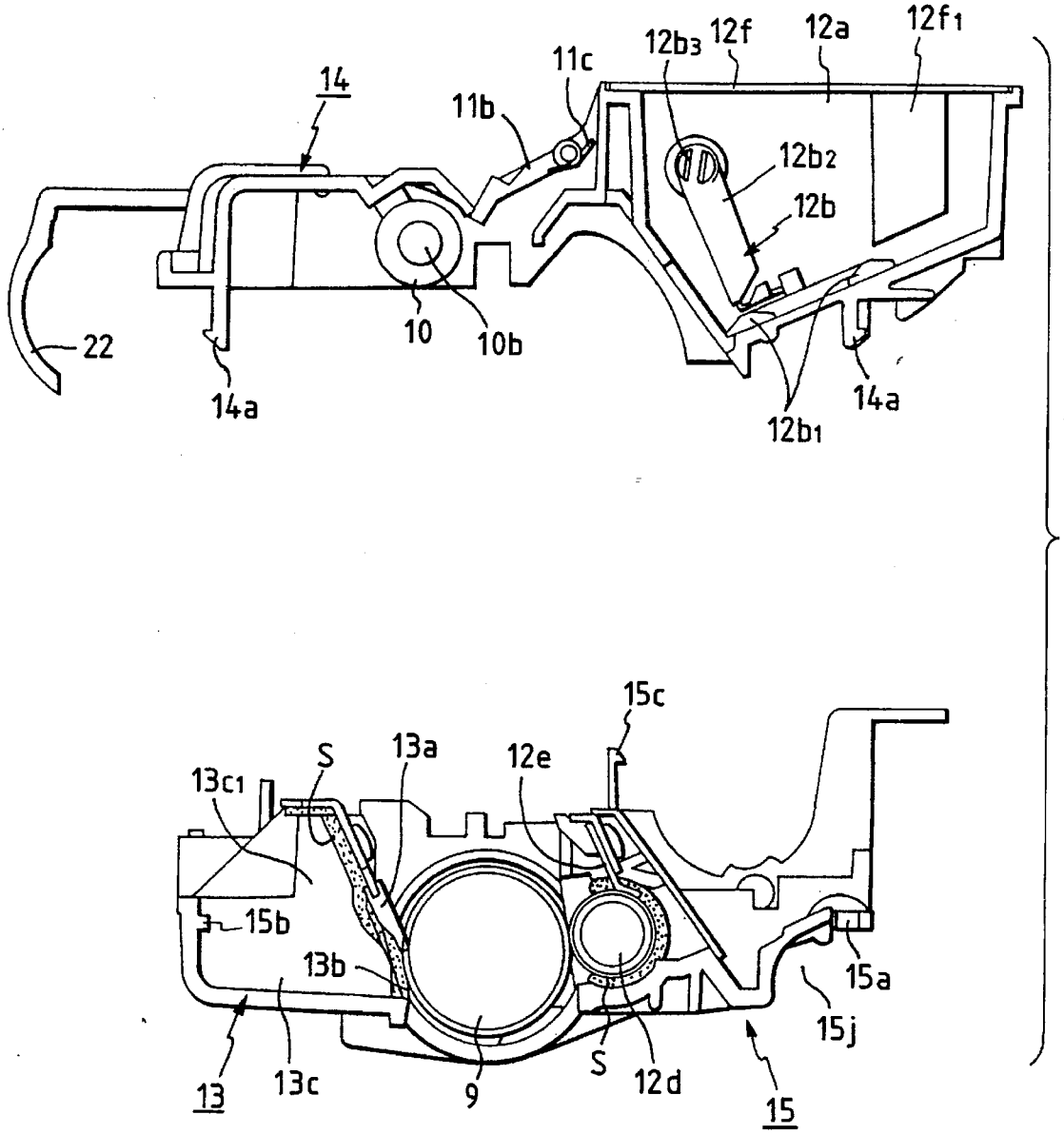
FIG. 7 is an exploded sectional view of the process cartridge in a condition that an upper frame and a lower frame are separated.
Figure 8:
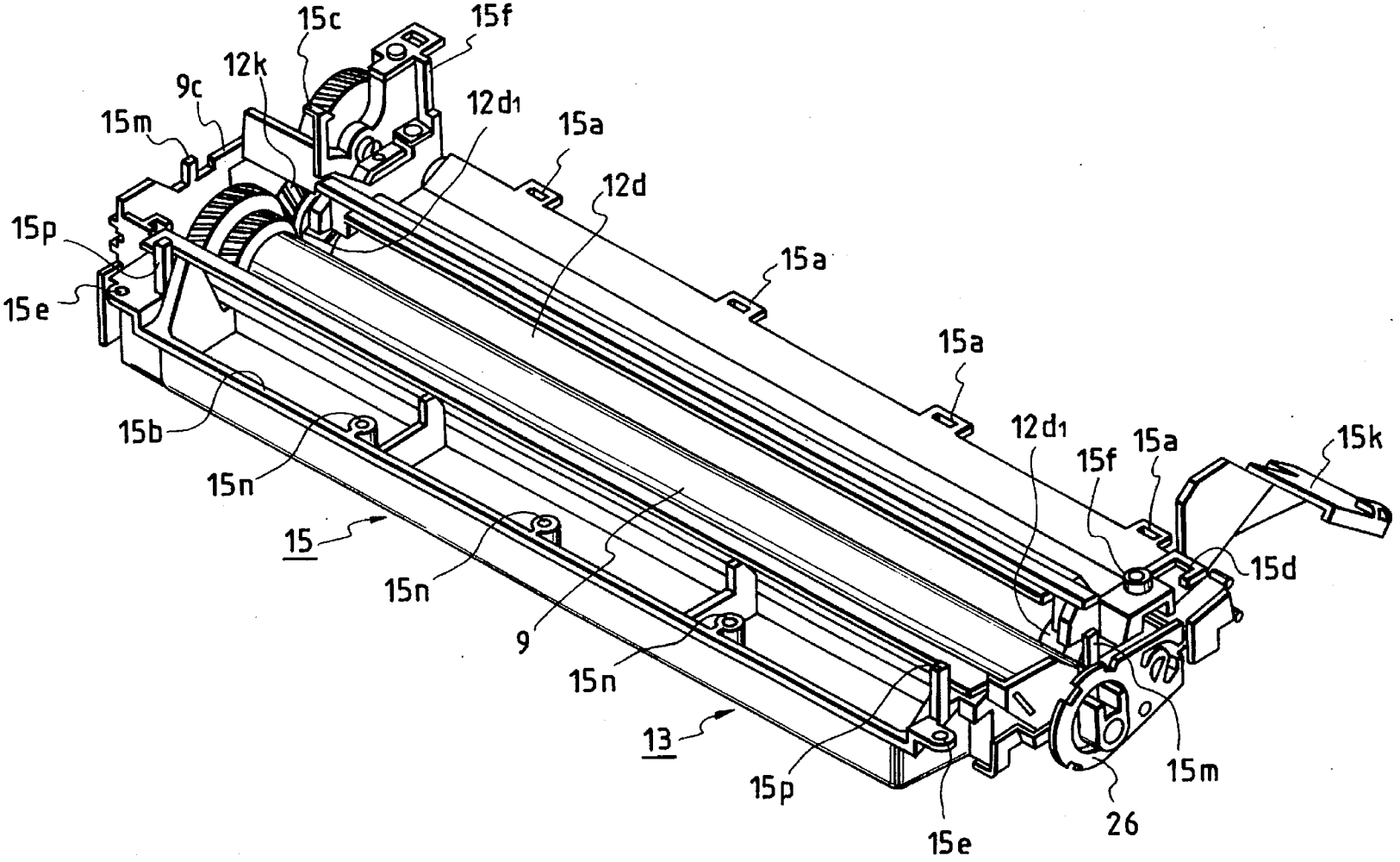
FIG. 8 is a perspective view of the lower frame showing an internal structure thereof.
Figure 9:
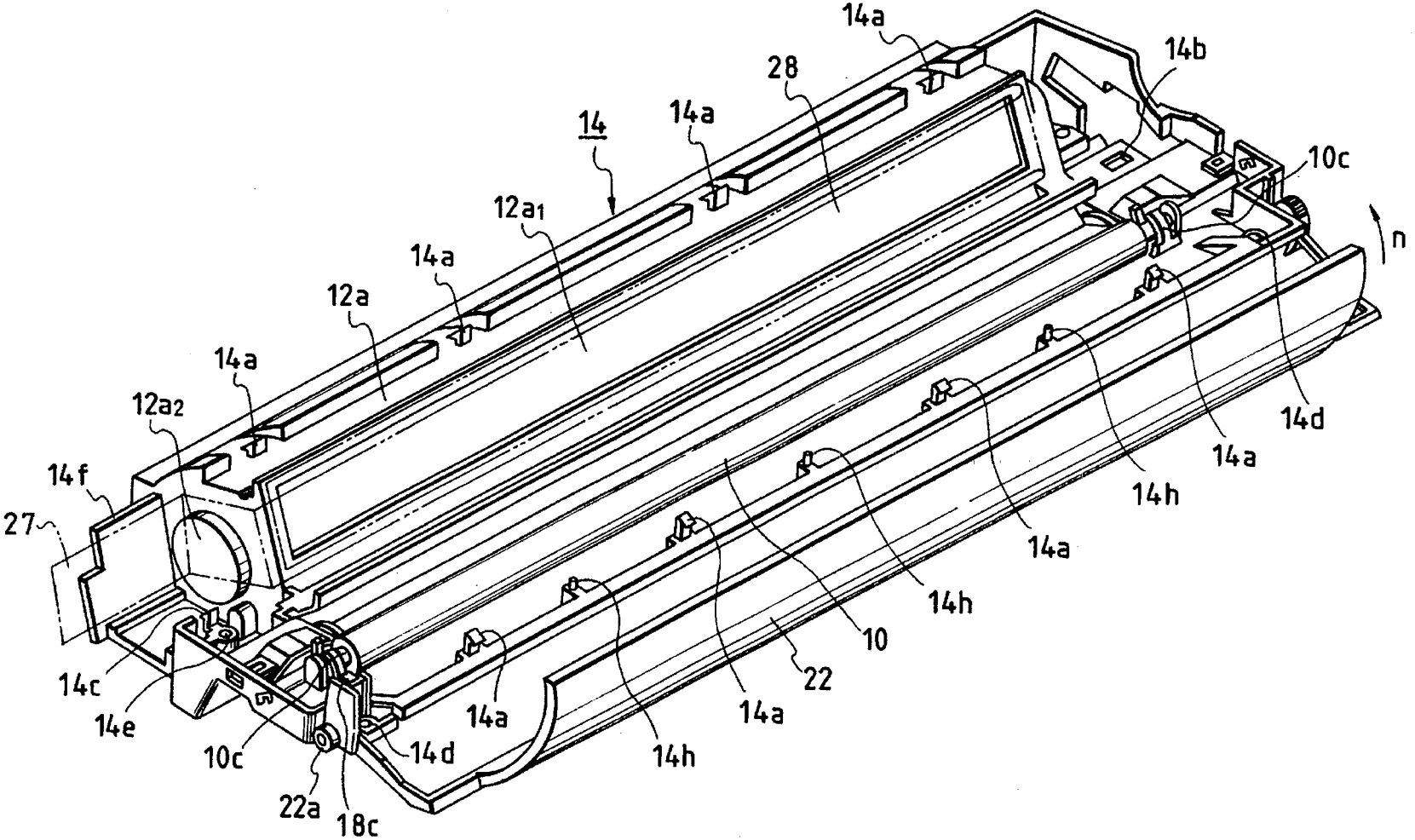
FIG. 9 is a perspective view of the upper frame showing an internal structure thereof.

Now, the various parts of the process cartridge B will be fully described regarding the charger means 11, exposure means 11, developing means 12 and cleaning means 13 in order. Incidentally, FIG. 7 is a sectional view of the process cartridge with the upper and lower frames separated from each other, FIG. 8 is a perspective view showing the internal construction of the lower frame, and FIG. 9 is a perspective view showing the internal construction of the upper frame.

(Photosensitive Drum)

In the illustrated embodiment, the photosensitive drum 9 comprises a cylindrical drum core 9*a* having a thickness of about 1 mm and made of aluminium, and an organic photosensitive layer 9*b* disposed on an outer peripheral surface of the drum core, so that an outer diameter of the photosensitive drum 9 becomes 24 mm. The photosensitive drum 9 is rotated in a direction shown by the arrow in response to the image forming operation, by transmitting a driving force of a drive motor 54 (FIG. 56) of the image forming system to a flange gear 9*c* (FIG. 8) secured to one end of the photosensitive drum 9.

During the image forming operation, when the photosensitive drum 9 is being rotated, the surface of the photosensitive drum 9 is uniformly charged by applying to the charger roller 10 (contacting with the drum 9) a vibrating voltage obtained by overlapping a DC voltage with an AC voltage. In this case, in order to uniformly charge the surface of the photosensitive drum 9, the frequency of the AC voltage applied to the charger roller 10 must be increased. However, if the frequency exceeds about 2000 Hz, the photosensitive drum 9 and the charger roller 10 will be vibrated, thus generating the so-called "charging noise".

That is to say, when the AC voltage is applied to the charged roller 10, an electrostatic attraction force is generated between the photosensitive drum 9 and the charger roller 10, so that the attraction force becomes maximum at the maximum and minimum values of the AC voltage, thus attracting the charger roller 10 against the photosensitive drum 9 while elastically deforming the charger roller. On the other hand, at an intermediate value of the AC voltage, the attraction force becomes minimal, with the result that the elastical deformation of the charger roller 10 is restored to tray to separate the charger roller 10 from the photosensitive drum 9. Consequently, the photosensitive drum 9 and the charger roller 10 are vibrated at the frequency twice that of the applied AC voltage. Further, when the charger roller 10 is attracted against the photosensitive drum 9, the rotations of the drum and the roller are braked, thus causing vibration due to stick slip, which also results in the charging noise.

Figure 10:
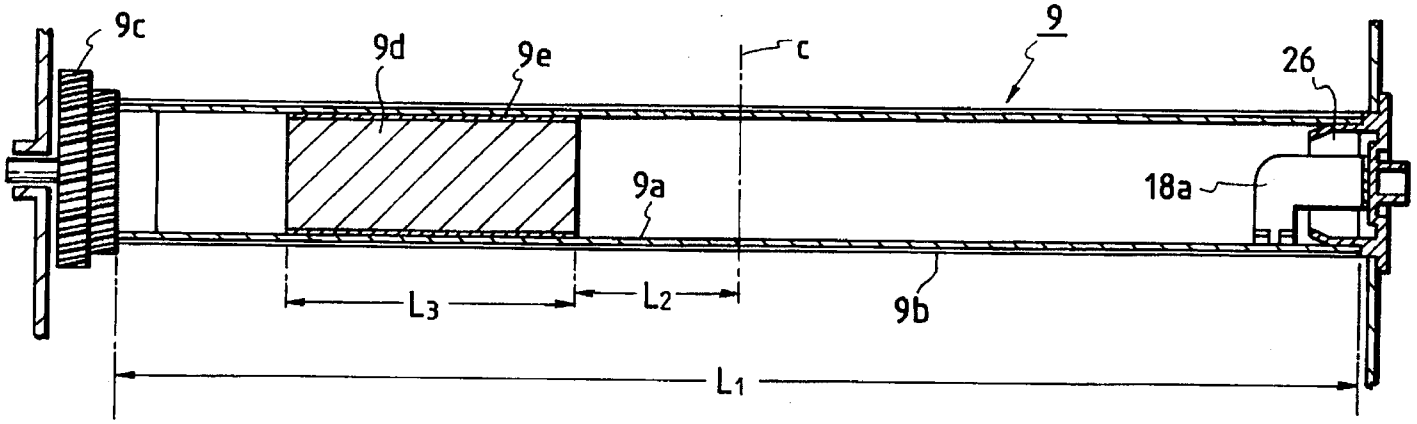
FIG. 10 is a longitudinal sectional view of a photosensitive drum of the process cartridge.

In order to reduce the vibration of the photosensitive drum 9, in the illustrated embodiment, as shown in FIG. 10 (sectional view of the drum), a rigid or elastic filler 9*d* is disposed within the photosensitive drum 9. The filler 9*d* may be made of metal such as aluminium, brass or the like, cement, ceramics such as gypsum, or rubber material such as natural rubber, in consideration of the productivity, workability, effect of weight and cost. The filler 9*d* has a solid cylindrical shape or a hollow cylindrical shape, and has an outer diameter smaller than an inner diameter of the photosensitive drum 9 by about 100 μm, and is inserted into the drum core 9*a*. That is to say, a gap between the drum core 9*a* and the filler 9*d* is set to have a value of 100 μm at the maximum, and an adhesive (for example, cyanoacrylate resin, epoxy resin or the like) 9*e* is applied on the outer surface of the filler 9*d* or on the inner surface of the drum core 9*a*, and the filler 9*d* is inserted into the drum core 9*a*, thus adhering them to each other.

Figure 11:
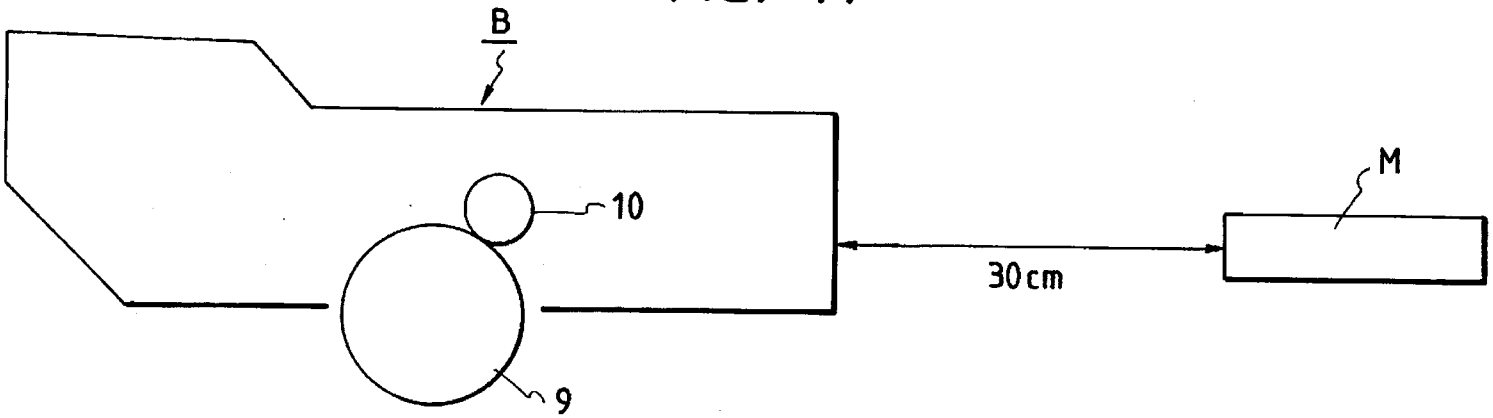
FIG. 11 is a schematic view for explaining the measurement of the charging noise.
Figure 12:
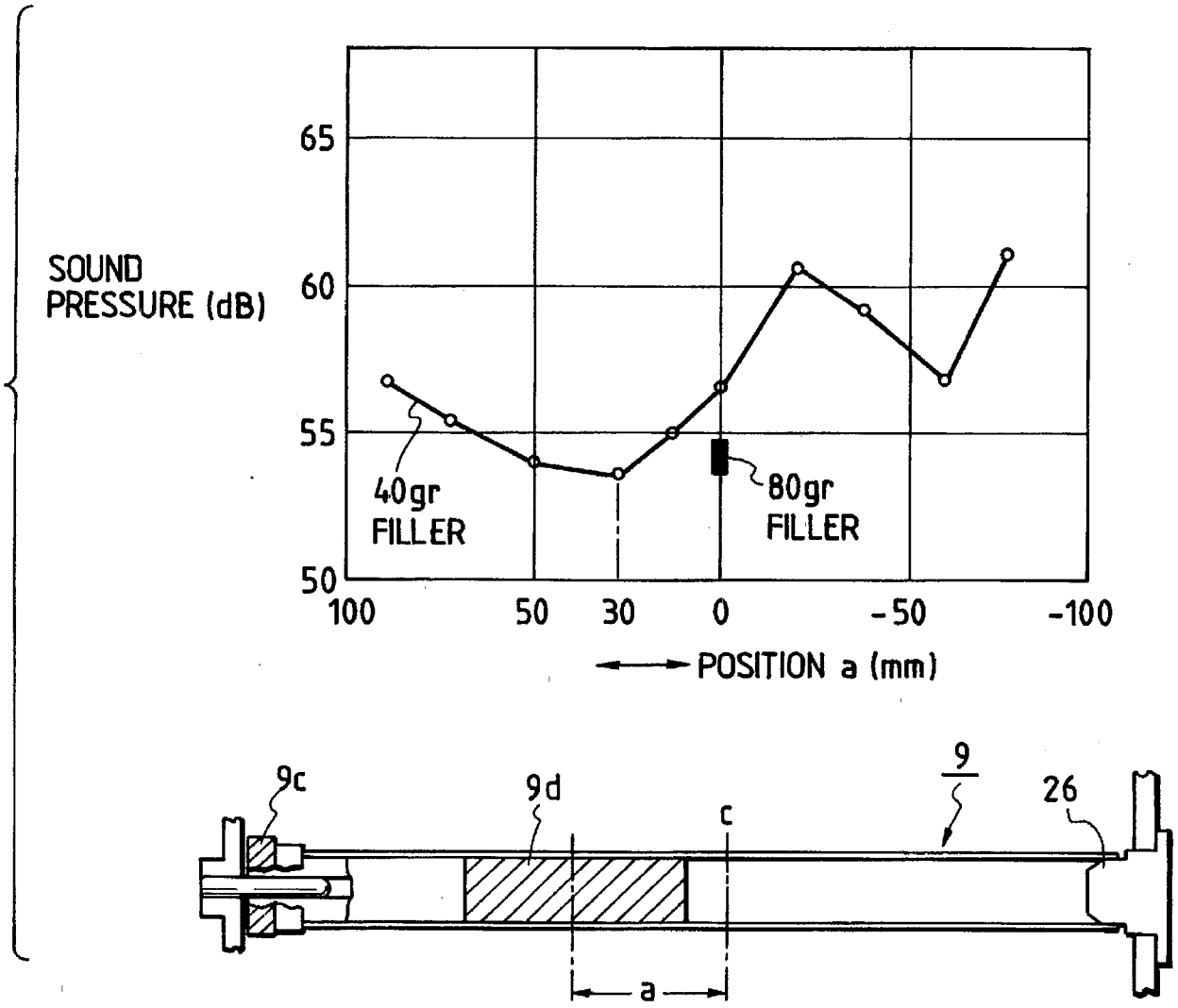
FIG. 12 is a graph showing the result of the measurement of the charging noise regarding a position of a filler.

Now, the test results performed by the inventors, wherein the relation between the position of the filler 9*d* and the noise pressure (noise level) was checked by varying the position of the filler 9*d* in the photosensitive drum 9 will be explained. As shown in FIG. 11, the noise pressure was measured by a microphone M arranged at a distance of 30 cm from the front surface of the process cartridge B disposed in a room having background noise of 43 dB. As result, as shown in FIG. 12, when the filler having a weight of 80 grams was arranged, at a central position in the longitudinal direction of the photosensitive drum 9, the noise pressure was 54.5–54.8 dB. Whereas, when the filler having a weight of 40 grams was arranged at a position offset from the central position toward the flange gear 9*c* by 30 mm, the noise pressure was at a minimum. From this result, it was found that it was more effective to arrange the filler 9*d* in the photosensitive drum 9 offset from the central position toward the gear flange 9*c*. The reason seems that one end of the photosensitive drum 9 is supported via the flange gear 9*c* while the other end of the drum 9 is supported by a bearing member 26 having no flange, so that the construction of the photosensitive drum 9 is not symmetrical with respect the central position in the longitudinal direction of the drum.

Thus, in the illustrated embodiment, as shown in FIG. 10, the filler 9*d* is arranged in the photosensitive drum 9 offset from the central position c (in the longitudinal direction of the drum) toward the flange gear 9*c*, i.e., toward the drive transmission mechanism to the photosensitive drum 9. Incidentally, in the illustrated embodiment, a filler 9*d* comprising a hollow aluminium member having a length L3 of 40 mm and a weight of about 20–60 grams, preferably 35–45 grams (most preferably about 40 grams) is positioned within the photosensitive drum 9 having a longitudinal length L1 of 257 mm at a position offset from the central position c toward the flange gear 9*c* by a distance L2 of 9 mm. By arranging the filler 9*d* within the photosensitive drum 9, the latter can be rotated stably, thus suppressing the vibration due to the rotation of the photosensitive drum 9 in the image forming operation. Therefore, even when the frequency of the AC voltage applied to the charger roller 10 is increased, it is possible to reduce the charging noise.

Further, in the illustrated embodiment, as shown in FIG. 10, an ground contact 18*a* is contacted with the inner surface of the photosensitive drum 9 and the other end of the ground contact is abutted against a drum ground contact pin 35*a*, thereby electrically ground the photosensitive drum 9. The earthing contact 18*a* is arranged at the end of the photosensitive drum opposite to the end adjacent to the flange gear 9*c*.

Figure 13:
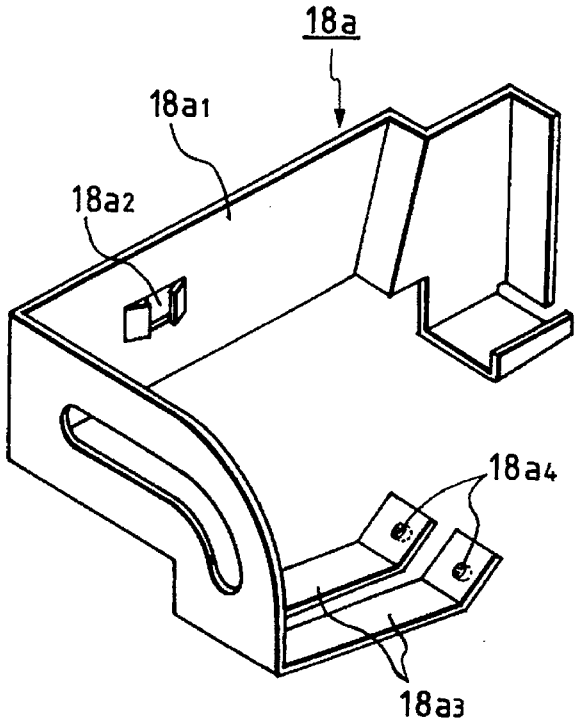
FIG. 13 is a perspective view of a ground contact for the photosensitive drum.

The ground contact 18*a* is made of spring stainless steel, spring bronze phosphate or the like and is attached to the bearing member 26. More particularly, as shown in FIG. 13, the earthing contact comprises a base portion 18*a*1 having a locking opening 18*a*2 into which a boss formed on the bearing member 26 can be fitted, and there are two portions 18*a*3 extending from the base portion 18*a*1, each arm portion being provided at its free end with a semi-circular projection 18*a*4 protruding downwardly. When the bearing member 26 is attached to the photosensitive drum 9, the projections 18*a*4 of the ground contact 18*a* are urged against the inner surface of the photosensitive drum 9 by the elastic force of the arm portions 18*a*3. In this case, since the ground contact 18*a* is contacted with the photosensitive drum at plural points (two points), the reliability of the contact is improved, and, since the ground contact 18*a* is contacted with the photosensitive drum via the semi-circular projections 18*a*4, the contact between the ground contact and the photosensitive drum 9 is stabilized.

Figure 14:
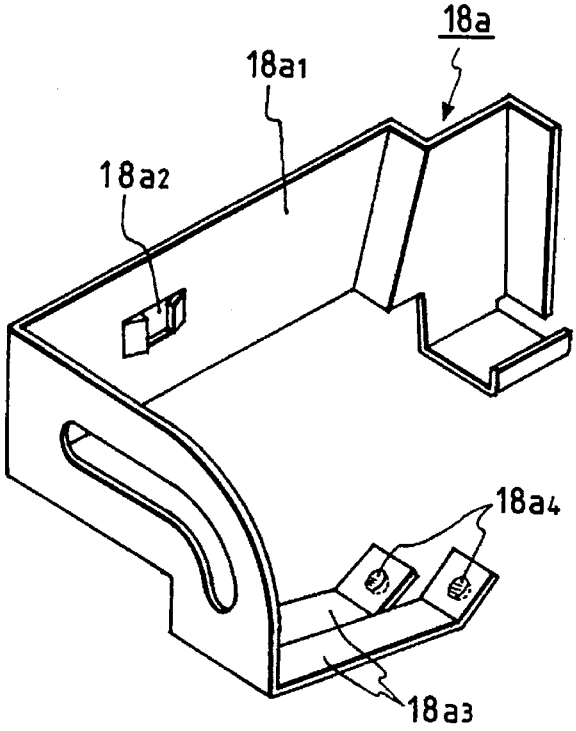
FIG. 14 is a perspective view of a ground contact for the photosensitive drum, according to another embodiment.

Incidentally, as shown in FIG. 14, lengths of the arm portions 18*a*3 of the ground contact 18*a* may be differentiated from each other. With this arrangement, since positions where the semi-circular projections 18*a*4 are contacted with the photosensitive drum 9 are offset from each other in the circumferential direction of the drum, even if there is a crack portion extending in the axial direction in the inner surface of the photosensitive drum 9, both projections 18*a*4 do not contact with such crack portion simultaneously, thereby maintaining the ground contact (between the contact and the drum) without fail. Incidentally, when the lengths of the arm portions 18*a*3 are differentiated, the contacting pressure between one of the arm portions 18*a*3 and the photosensitive drum is differentiated from the contacting pressure between the other arm portion and the drum. However, such difference can be compensated, for example, by changing the bending angles of the arm portions 18*a*3.

Figure 15:
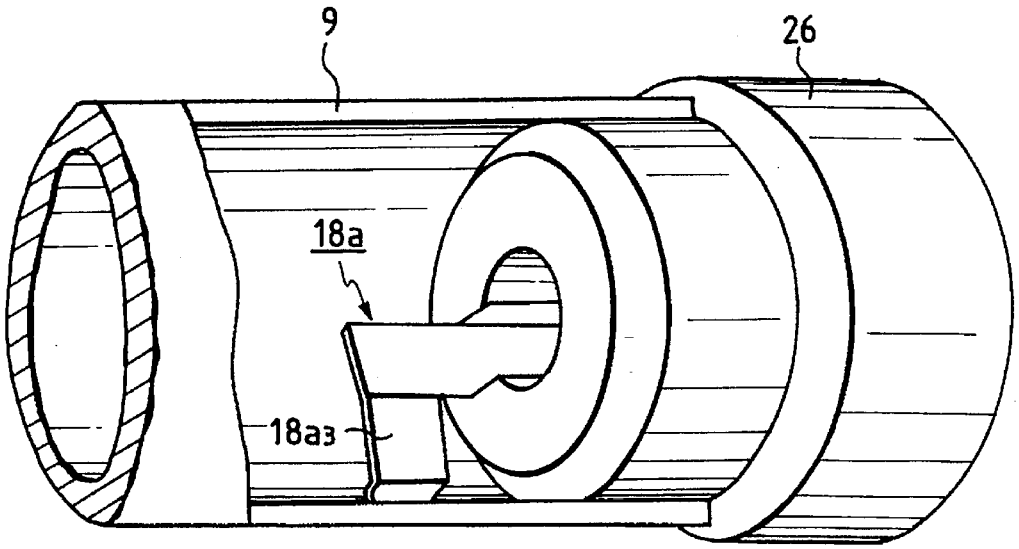
FIG. 15 is a perspective view showing an embodiment wherein an earthing contact, which is not bifurcated, is used with the photosensitive drum.
Figure 16:
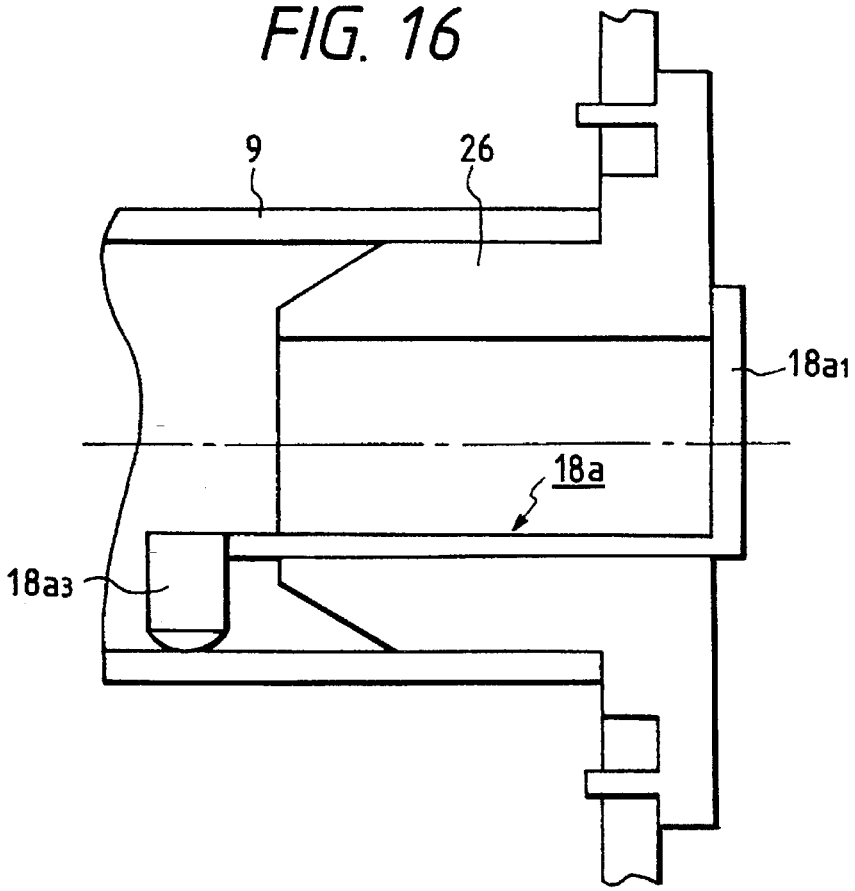
FIG. 16 is a sectional view of the non-bifurcated ground contact used with the photosensitive drum.

In the illustrated embodiment, while the ground contact 18*a* had two arm portions 18*a*3 as mentioned above, three or more arm portions may be provided, or, when the ground contact is contacted with the inner surface of the photosensitive drum 9 without fail, a single arm portion 18*a*3 (not bifurcated) having no projection may be used, as shown in FIGS. 15 and 16.

Now, if the contacting pressure between the ground contact 18*a* and the inner surface of the photosensitive drum 9 is too weak, the semi-circular projections 18*a*4 cannot follow the unevenness of the inner surface of the photosensitive drum, thus causing poor contact between the earthing contact and the photosensitive drum and generating noise due to the vibration of the arm portions 18*a*3. In order to prevent such poor contact and noise, the contacting pressure must be increased. However, if the contacting pressure is too strong, when the image forming system is used for a long time, the inner surface of the photosensitive drum will be damaged by the high pressure of the semi-circular projections 18*a*4. Consequently, when the semi-circular projections 18*a*4 pass through such damaged portion, the vibration occurs, thus causing the poor contact and the vibration noise. In consideration of the above affairs, it is preferable that the contacting pressure between the ground contact 18*a* and the inner surface of the photosensitive drum be set in a range between about 10 grams and about 200 grams. That is to say, according to the test result effected by the inventors, when the contacting pressure was smaller than about 10 grams, it was feared that the poor contact was likely to occur in response to the rotation of the photosensitive drum, thus causing the radio wave jamming regarding other electronic equipments. On the other hand, when the contacting pressure was greater than about 200 grams, it was feared that the inner surface of the photosensitive drum 9 was damaged due to the sliding contact between the drum inner surface and the earthing contact 18*a* for a long time, thus causing the abnormal noise and/or poor contact.

Incidentally, although the generation of the above noise and the like sometimes cannot be eliminated completely because of the inner surface condition of the photosensitive drum, it is possible to reduce the vibration of the photosensitive drum 9 by arranging the filler 9*d* within the drum 9, and it is also possible to prevent the damage of the drum and the poor contact more effectively by disposing the conductive grease on the contacting area between the earthing contact 18*a* and the inner surface of the photosensitive drum 9. Further, since the earthing contact 18*a* is positioned on the bearing member 26, which is situated remote from the filler 9*d* offset toward the flange gear 9*c*, the ground contact can easily be attached to the bearing member.

(Charger Means )

The charger means serves to charge the surface of the photosensitive drum 9. In the illustrated embodiment, the charger means is of so-called contact charging type as disclosed in the Japanese Patent Laid-open Appln. No. 63-149669. More specifically, as shown in FIG. 4, the charger roller 10 is rotatably mounted on the inner surface of the upper frame 14 via a slide bearing 10*c*. The charger roller 10 comprises a metallic roller shaft 10*b* (for example, a conductive metal core made of iron, SUS or the like), an elastic rubber layer made of EPDM, NBR or the like arranged around the roller shaft, and an urethane rubber layer dispersing carbon therein and arranged around the elastic rubber layer, or comprise a metallic roller shaft and a foam urethane rubber layer dispersing carbon therein. The roller shaft 10*b* of the charger roller 10 is held by bearing slide guide pawls 10*d* of the upper frame 14 via the slide bearing 10*c* so that it cannot become detached from the upper frame and it can be moved slightly toward the photosensitive drum 9. The roller shaft 10*b* is biased by a spring 10*a* so that the charger roller 10 is urged against the surface of the photosensitive drum 9. Thus, the charger means is constituted by the charger roller 10 incorporated into the upper frame 14 via the bearing 10*c*. In the image forming operation, when the charger roller 10 is driven by the rotation of the photosensitive drum 9, the surface of the photosensitive drum 9 is uniformly charged by applying the overlapped DC and AC voltage to the charger roller 10 as mentioned above.

Now, the voltage applied to the charger roller 10 will be described. Although the voltage applied to the charger roller 10 may be the DC voltage alone, in order to achieve the uniform charging, the vibration voltage obtained by overlapping the DC voltage and the AC voltage as mentioned above should be applied to the charger roller. Preferably, the vibration voltage obtained by overlapping the DC voltage having the peak-to-peak voltage value greater, by twice or more, than the charging start voltage when the DC voltage along is used, and the AC voltage is applied to the charger roller 10 to improve the uniform charging (refer to the Japanese Patent Laid-open Appln. No. 63-149669). The "vibration voltage" described herein means a voltage having a voltage value that is periodically changed as a function of time and that preferably has a peak-to-peak voltage greater, by twice or more, than the charging start voltage when the surface of the photosensitive drum is charged only by the DC voltage. Further, the wave form of the vibration voltage is not limited to the sinusoidal wave, but may be a rectangular wave, triangular wave or pulse wave. However, a sinusoidal wave, not including the higher harmonic component, is preferable in view of the reduction of the charging noise. The DC voltage may include a voltage having the rectangular wave obtained by periodically turning ON/OFF a DC voltage source, for example.

Figure 17:
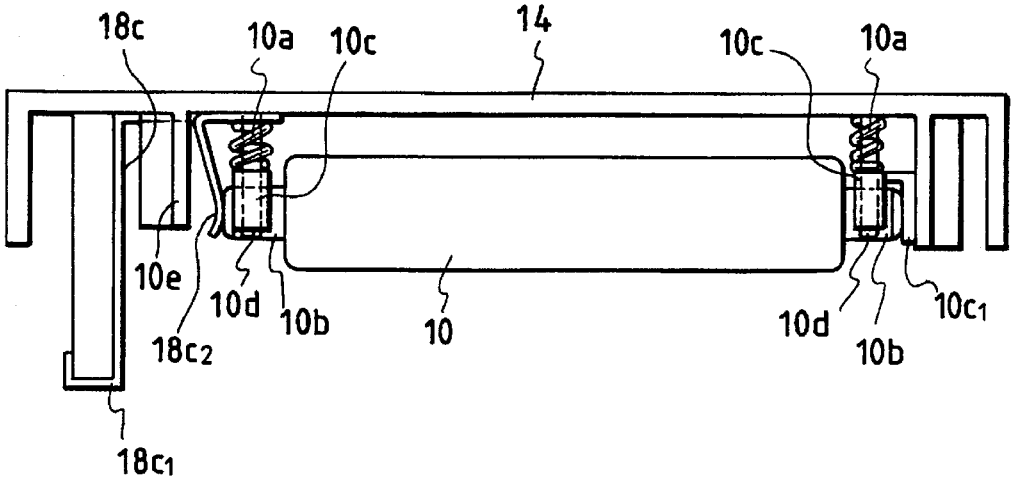
FIG. 17 is an elevational view showing an attachment structure for a Charger roller.

As shown in FIG. 17, the application of the voltage to the charger roller 10 is accomplished by urging one end 18*c*1 of a charging bias contact 18*c* against a charging bias contact pin of the image forming system as will be described later, and the other end 18*c*2 of the charging bias contact 18*c* is urged against the metallic roller shaft 10*b*, thereby applying the voltage to the charger roller 10. Incidentally, since the charger roller 10 is biased by the elastic contact 18*c* toward the right in FIG. 17, the charger roller bearing 10*c* disposed remote from the contact 18*c* has a hooked stopper portion 10*c*1. Further, a stopper portion 10*e* depending from the upper frame 14 is arranged near the contact 18*c* in order to prevent the excessive axial movement of the charger roller 10 when the process cartridge B is dropped or vibrated.

In the illustrated embodiment, with the arrangement as mentioned above, the voltage of 1.6–2.4 KVVpp, −600 $VV_{DC}$ (sinusoidal wave) is applied to the charger roller 10.

When the charger roller 10 is incorporated into the upper frame 14, first of all, the bearing 10*c* is supported by the guide pawls 10*d* of the upper frame 14 and then the roller shaft 10*b* of the charger roller 10 is fitted into the bearing 10*c*. And, when the upper frame 14 is assembled with the lower frame 15, the charger roller 10 is urged against the photosensitive drum 9, as shown in FIG. 4.

Incidentally, the bearing 10*c* for the charger roller 10 is made of conductive bearing material including a great amount of carbon filler, and the voltage is applied to the charger roller 10 from the charging bias contact 18*c* via the metallic spring 10*a* so that a stable charging bias can be supplied.

(Exposure Means )

The exposure means 11 serves to expose the surface of the photosensitive drum 9 uniformly charged by the charger roller 10 with a light image from the reading means 1. As shown in FIGS. 1 and 4, the upper frame 14 is provided with an opening 11*a* through which the light from the lens array 1*c*2 of the image forming system is illuminated onto the photosensitive drum 9. Incidentally, when the process cartridge B is removed from the image forming system A, if the photosensitive drum 9 is exposed by the ambient light through the opening 11*a*, it is feared that the photosensitive drum is deteriorated. To avoid this, a shutter member 11*b* is attached to the opening 11*a* so that when the process cartridge B is removed from the image forming system A the opening 11*a* is closed by the shutter member 11*b* and when the process cartridge is mounted within the image forming system the shutter member opens the opening 11*a*.

Figure 18A:
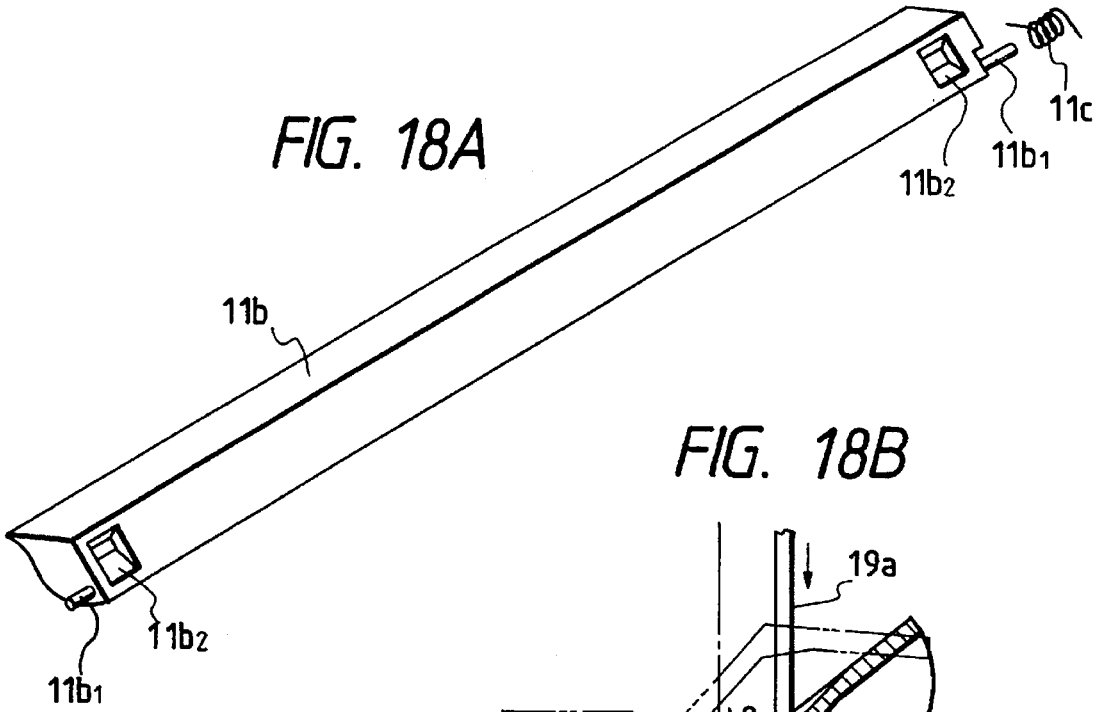
FIG. 18A is a perspective view of an exposure shutter.
Figure 18B:
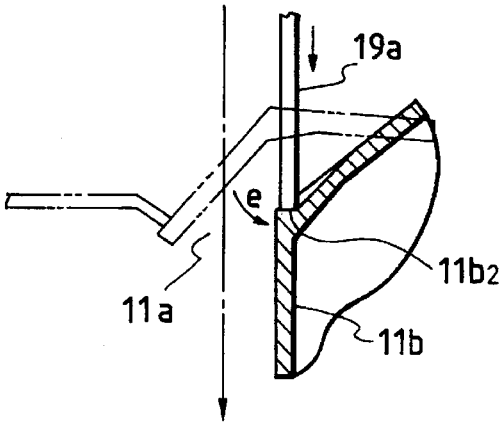
FIG. 18B is a partial sectional view of the exposure shutter.

As shown in FIGS. 18A and 18B, the shutter member 11*b* has an L-shaped cross-section having a convex portion directing toward the outside of the cartridge, and is pivotally mounted on the upper frame 14 via pins 11*b*1. A torsion coil spring 11*c* is mounted around one of the pins 11*b*1 so that the shutter member 11*b* is biased by the coil spring 11*c* to close the opening 11*a* in a condition that the process cartridge B is dismounted from the image forming system A.

As shown in FIG. 18A, abutment portions 11*b*2 are formed on the outer surface of the shutter member 11*b* so that, when the process cartridge B is mounted within the image forming system A and an upper opening/closing cover 19 (FIG. 1) openable with respect to the body 16 of the image forming system is closed, a projection 19*a* formed on the cover 19 is abutted against the abutment portions 11*b*2, thereby rotating the shutter member 11*b* in a direction shown by the arrow e (FIG. 18B) to open the opening 11*a*.

In the opening and closing operation of the shutter member 11*b*, since the shutter member 11*b* has the L-shaped cross-section and the abutment portions 11*b*2 are disposed outwardly of the contour of the cartridge B and near the pivot pins 11*b*1, as shown in FIGS. 4 and 18B, the shutter member 11*b* is abutted against the projection 19*a* of the cover 19 outwardly of the contour of the process cartridge B. As a result, even when the opening and closing angle of the shutter member 11*b* is small, a leading end of the rotating shutter member 11*b* is surely opened, thereby surely illuminating the light from the lens array 1*c*2 disposed above the shutter member onto the photosensitive drum to form the good electrostatic latent image on the surface of the photosensitive drum 9. By constituting the shutter member 11*b* as mentioned above, when the process cartridge B is inserted into the image forming system, it is not necessary to retard the cartridge B from the shutter opening projection 19*a* of the cover 19 of the image forming system, with the result that it is possible to shorten the stroke of the projection, thereby making the process cartridge B and the image forming system A small-sized.

(Developing Means)

Next, the developing means 12 will be explained. The developing means 12 serves to visualize the electrostatic latent image formed on the photosensitive drum 9 by the exposure means with toner as a toner image. Incidentally, in this image forming system A, although magnetic toner or non-magnetic toner can be used, in the illustrated embodiment, the developing means in the process cartridge B includes the magnetic toner as one-component magnetic developer.

Binder resin of the one-component magnetic toner used in the developing operation may be the following or a mixture of the following polymer of styrene and substitute thereof such as polystyrene and polyvinyl toluene; styrene copolymer such as styrene-propylene copolymer, styrene-vinyltoluene copolymer, styrene-vinylnaphthalene copolymer, styrene-acrylic acid ethyl copolymer or 'styrene-acrylic acid butyl copolymer; polymetylmethacrylate, polybuthymethacrylate, polyvinylacetate, polyethylene, polypropylene, polyvinylbutyral, polycrylic acid resin, rosin, modified rosin, turpentine resin, phenolic resin, aliphatic hydrocarbon resin, alicyclic hydrocarbon resin, aromatic petroleum resin, paraffin wax, carnauba wax or the like.

As for the coloring material added to the magnetic toner it may be known carbon black, copper phthalocyanine, iron black or the like. The magnetic fine particles contained in the magnetic toner may be of the material magnetizable when placed in the magnetic field, such as ferromagnetic powder of metal such as iron, cobalt, and nickel, powder of metal alloy or powder of compound such as magnetite or ferrite.

As shown in FIG. 4, the developing means 12 for forming the toner image with the magnetic toner has a toner reservoir 12*a* for containing the toner, and a toner feed mechanism 12*b* disposed within the toner reservoir 12*a* and adapted to feed out the toner. Further, the developing means is so designed that the developing sleeve 12*d* having a magnet 12*c* therein is rotated to form a thin toner layer on a surface of the developing sleeve. When the toner layer is being formed on the developing sleeve 12*d*, the developable frictional charging charges are applied to the electrostatic latent image on the photosensitive drum 9 by the friction between the toner and the developing sleeve 12*d*. Further, in order to regulate a thickness of the toner layer, a developing blade 12*e* is urged against the surface of the developing sleeve 12*d*. The developing sleeve 12*d* is disposed in a confronting relation to the surface of the photosensitive drum 9 with a gap of about 100–400 μm therebetween.

As shown in FIG. 4, the magnetic toner feed mechanism 12*b* has feed members 12*b*1 made of polypropylene (PP), acrylobutadienestyrol (ABS), high-impact styrol (HIPS) or the like and is reciprocally shiftable in a direction shown by the arrows f along a bottom surface of the toner reservoir 12*a*. Each feed member 12*b*1 has a substantial triangular cross-section and is provided with a plurality of long rod members extending along the rotation axis of the photosensitive drum (direction perpendicular to the plane of FIG. 4) for scraping the whole bottom surface of the toner reservoir 12*a*. The rod members are interconnected at both their ends to constitute an integral structure. Further, there are three feed members 12*b*1, and the shifting range of the feed members are selected to be greater than a bottom width of the triangular cross-section so that all of the toner on the bottom surface of the toner reservoir can be scraped. In addition, an arm member 12*b*2 is provided at its free end with a projection 12*b*6, thereby preventing the feed members 12*b*1 from floating and being disordered.

The feed member 12*b*1 has a lock projection 12*b*4 at its one longitudinal end, which projection is rotatably fitted into a slot 12*b*5 formed in the arm member 12*b*2. The arm member 12*b*2 is rotatably mounted on the upper frame 14 via a shaft 12*b*3 and is connected to an arm (not shown) disposed outside the toner reservoir 12*a*. Further, a drive transmitting means is connected to the feed members 12*b*1 so that, when the process cartridge B is mounted within the image forming system A, the driving force from the image forming system is transmitted to the feed members to swing the arm member 12*b*2 around the shaft 12*b*3 by a predetermined angle. Incidentally, as shown in FIG. 7 and the like, the feed members 12*b*1 and the arm member 12*b*2 may be integrally formed from resin such as polypropylene, polyamide or the like so that they can be folded at a connecting portion therebetween.

Accordingly, in the image forming operation, when the arm member 12*b*2 is rocked by the predetermined angle, the feed members 12*b*1 are reciprocally shifted along the bottom surface of the toner reservoir 12*a* in directions f between a condition shown by the solid lines and a condition shown by the broken lines. Consequently, the toner situated near the bottom surface of the toner reservoir 12*a* is fed toward the developing sleeve 12*d* by the feed members 12*b*1. In this case, since each feed member 12*b*1 has a triangular cross-section, the toner is scraped by the feed members and is gently fed along inclined surfaces of the feed members 12*b*1. Thus, the toner near the developing sleeve 12*d* is hard to agitate, and, therefore, the toner layer formed on the surface of the developing sleeve 12*d* is hard to deteriorate.

Further, as shown in FIG. 4, a lid member 12*f* of the toner reservoir 12*a* is provided with a depending member 12*f*1. A distance between a lower end of the depending member 12*f*1 and the bottom surface of the toner reservoir is selected so as to be slightly greater than a height of the triangular cross-section of each toner feed member 12*b*1. Accordingly, the toner feed member 12*b*1 is reciprocally shifted between the bottom surface of the toner reservoir and the depending member 12*f*1, with the result that, if the feed member 12*b*1 tries to float from the bottom surface of the toner reservoir, such floating is limited or regulated, thus preventing the floating of the feed members 12*b*1.

Incidentally, the image forming system A according to the illustrated embodiment can also receive a process cartridge including the non-magnetic toner. In this case, the toner feed mechanism is driven to agitate the non-magentic toner near the developing sleeve 12*d*.

Figure 19:
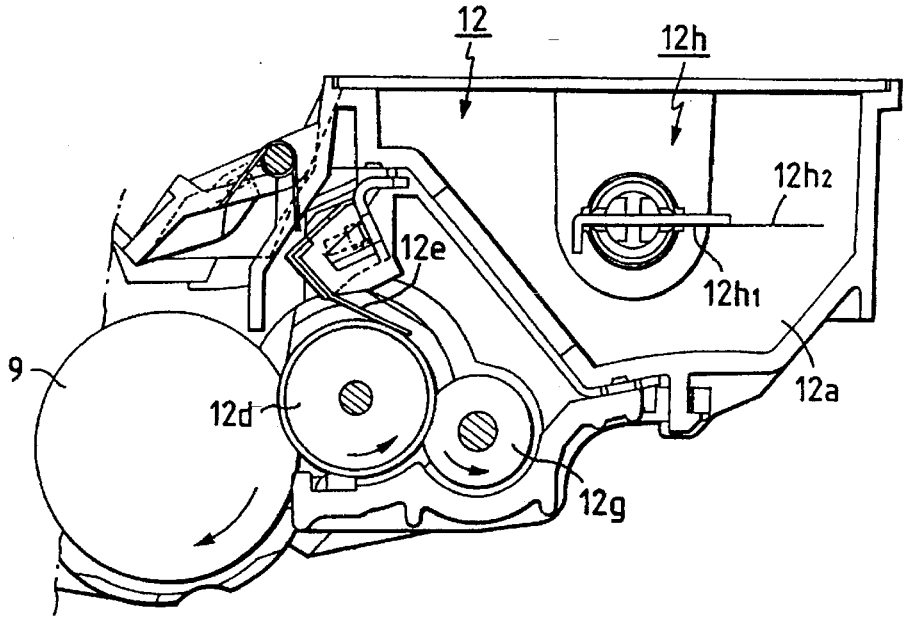
FIG. 19 is a sectional view showing a non-magnetic toner feeding mechanism having an agitating vane.

That is to say, when the non-magnetic toner is used, as shown in FIG. 19, an elastic roller 12*g*, rotated in a direction same as that of the developing sleeve 12*d*, feeds the non-magnetic toner fed from the toner reservoir 12*a* by the toner feed mechanism 12*h* toward the developing sleeve 12*d*. In this case, at a nip between the developing sleeve 12*d* and the elastic roller 12*g*, the toner on the elastic roller 12*g* is frictionally charged by the sliding contact between the toner and the developing sleeve 12*d* to be adhered onto the developing sleeve 12*d* electrostatically. Thereafter, during the rotation of the developing sleeve 12*d*, the non-magnetic toner adhered to the developing sleeve 12*d* enters into an abutment area between the developing blade 12*e* and the developing sleeve 12*d* to form the thin toner layer on the developing sleeve, and the toner is frictionally charged by the sliding contact between the toner and the developing sleeve with a polarity sufficient to develop the electrostatic latent image. However, when the toner remains on the developing sleeve 12*d*, the remaining toner is mixed with the new toner fed to the developing sleeve 12*d* and is fed to the abutment area between the developing sleeve and the developing blade 12e. The remaining toner and the new toner are frictionally charged by the sliding contact between the toner and the developing sleeve 12d. In this case, however, although the new toner is charged with the proper charge, since the remaining toner is further charged from the condition that it has already been charged with the proper charge, it is over-charged. The over-charged or excessively charged toner has the adhesion force (to the developing sleeve 12d) stronger than that of the property charged toner, thus becoming harder to use in the developing operation.

To avoid this, in the illustrated embodiment, regarding the process cartridge containing the non-magnetic toner, as shown in FIG. 19, the non-magnetic toner feed mechanism 12h comprises a rotary member 12h1 disposed in the toner reservoir 12a, which rotary member 12h1 has an elastic agitating vane 12h2. When the non-magnetic toner cartridge is mounted within the image forming system A, the drive transmitting means is connected to the rotary member 12h1 so that the latter is rotated by the image forming system in the image forming operation. In this way, when the image is formed by using the cartridge containing the non-magnetic toner and mounted within the image forming system, the toner in the toner reservoir 12a is greatly agitated by the agitating vane 12h2. As a result, the toner near the developing sleeve 12d is also agitated and mixed with the toner in the toner reservoir 12a, thereby dispersing the charging charges removed from the developing sleeve 12d in the toner within the toner reservoir to prevent the deterioration of the toner.

The developing sleeve 12d, on which the toner layer is formed, is arranged in a confronting relation to the photosensitive drum 9 with a small gap therebetween (about 300 μm regarding the process cartridge containing the magnetic toner, or about 200 μm regarding the process cartridge containing the non-magnetic toner). Accordingly, in the illustrated embodiment, abutment rings each having an outer diameter greater than that of the developing sleeve by an amount corresponding to the small gap are arranged in the vicinity of both axial ends of the developing sleeve 12d and outside the toner layer forming area so that these rings are abutted against the photosensitive drum 9 at zones outside the latent image forming area.

Figure 20:
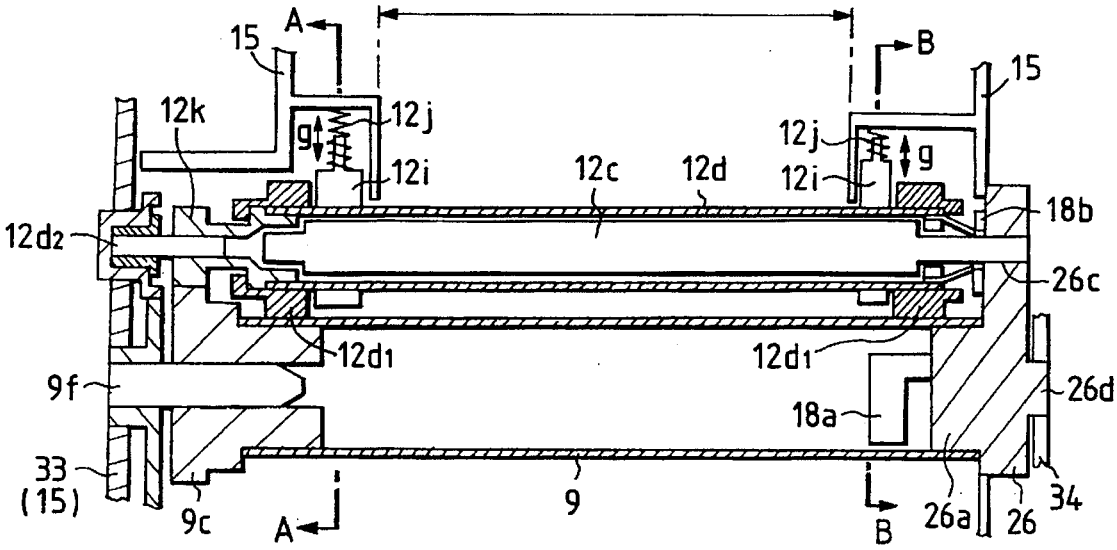
FIG. 20 is a longitudinal sectional view showing a positional relation between the photosensitive drum (9) and a developing sleeve (12*d*) and a structure for pressurizing the developing sleeve.
Figure 21A:
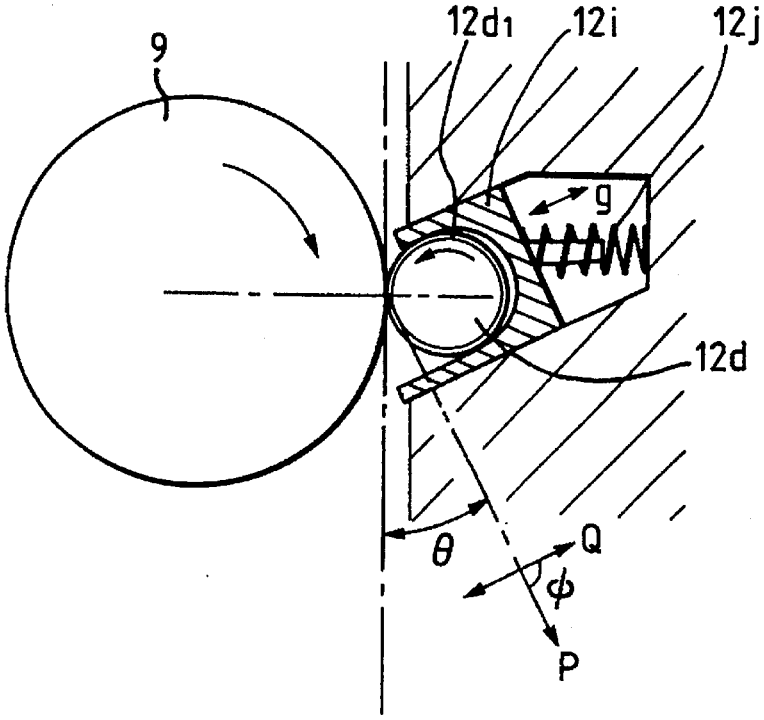
FIG. 21A is a sectional view taken along the line A—A of FIG. 20.
Figure 21B:
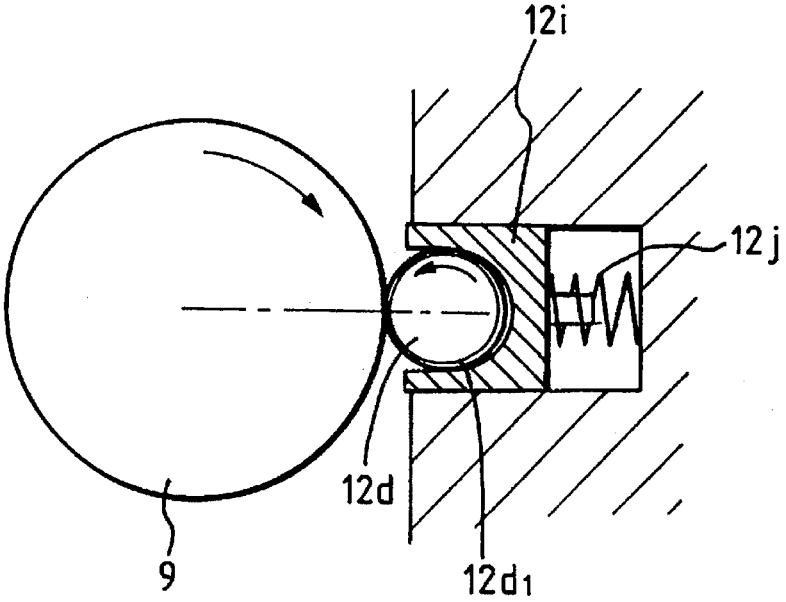
FIG. 21B is a sectional view taken along the line B—B of FIG. 20.

Now, the positional relation between the photosensitive drum 9 and the developing sleeve 12d will be explained. FIG. 20 is a longitudinal sectional view showing a positional relation between the photosensitive drum 9 and the developing sleeve 12d and a structure for pressurizing the developing sleeve, FIG. 21A is a sectional view taken along the line A—A of FIG. 20, and FIG. 21B is a sectional view taken along the line B—B of FIG. 20.

As shown in FIG. 20, the developing sleeve 12d, on which the toner layer is formed, is arranged in a confronting relation to the photosensitive drum 9 with the small gap therebetween (about 200–300 μm). In this case, the photosensitive drum 9 is rotatably mounted on the lower frame 15 by rotatably supporting a rotary shaft 9f of the flange gear 9c at the one end of the drum via a supporting member 33. The other end of the photosensitive drum 9 is also rotatably mounted on the lower frame 15 via a bearing portion 26a of the bearing member 26 secured to the lower frame. The developing sleeve 12d has the above-mentioned abutment rings 12d1 each having the outer diameter greater than that of the developing sleeve by the amount corresponding to the small gap and arranged in the vicinity of both axial ends of the developing sleeve and outside the toner layer forming area so that these rings are abutted against the photosensitive drum 9 at the zones outside the latent image forming area.

Further, the developing 12d is rotatably supported by sleeve bearings 12i disposed between the abutment rings 12d1 in the vicinity of both axial ends of the developing sleeve and outside the toner layer forming area, which sleeve bearings 12i are mounted on the lower frame 15 in such a manner that they can be slightly shifted in directions shown by the arrow g in FIG. 20. Each sleeve bearing 12i has a rearwardly extending projection around which an urging spring 12j having one end abutted against the lower frame 15 is mounted. Consequently, the developing sleeve 12d is always biased toward the photosensitive drum 9 by these urging springs. With this arrangement, the abutment rings 12d, are always abutted against the photosensitive drum 9, with the result that the predetermined gap between the developing sleeve 12d and the photosensitive drum 9 is always maintained, thereby transmitting the driving force to the flange gear 9c of the photosensitive drum 9 and a sleeve gear 12k of the developing sleeve 12d meshed with the flange gear 9c.

The sleeve gear 12k also constitutes a flange portion of the developing sleeve 12d. That is to say, according to the illustrated embodiment, the sleeve gear 12k and the flange portion are integrally formed from resin material (for example, polyacetylene resin). Further, a metallic pin 12d2 having a small diameter (for example, made of stainless steel) and having one end rotatably supported by the lower frame 15 is press-fitted into and secured to the sleeve gear 12k (flange portion) at its center. This metallic pin 12d2 acts as a rotary shaft at one end of the developing sleeve 12d. According to the illustrated embodiment, since the sleeve gear and the flange portion can be integrally formed from resin, it is possible to facilitate the manufacturing of the developing sleeve and to make the developing sleeve 12d and the process cartridge B light-weight.

Figure 22:
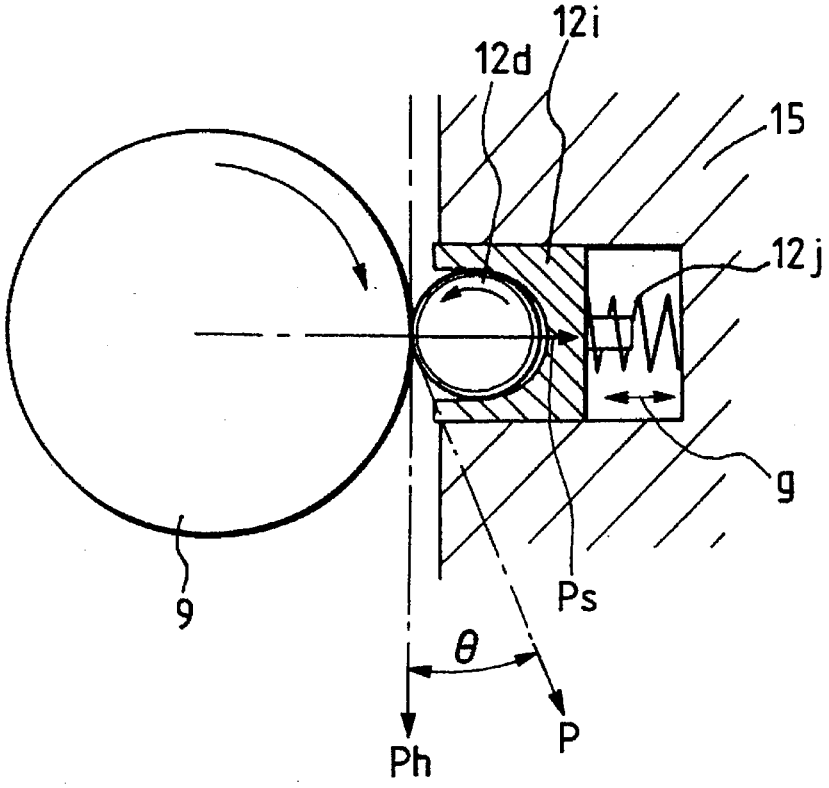
FIG. 22 is a sectional view for explaining the pressurizing force acting on the developing sleeve.

Now, the sliding directions of the sleeve bearings 12i will be explained with reference to FIG. 22. First of all, the driving of the developing sleeve 12d will be described. When the driving force is transmitted from the drive source (drive motor 54) of the image forming system to the flange gear 9c and then is transmitted from the flange gear 9c to the sleeve gear 12k, the meshing force between the gears is directed to a direction inclined or offset from a tangential line contacting a meshing pitch circle of the flange gear 9c and a meshing pitch circle of the sleeve gear 12k by a pressure angle (20° in the illustrated embodiment). Thus, the meshing force is directed to a direction shown by the arrow P in FIG. 22 ($\theta \cong 20°$). In this case, if the sleeve bearings 12i are slid in a direction parallel to a line connecting the center of rotation of the photosensitive drum 9 and the center of rotation of the developing sleeve 12d, when the meshing force P is divided into a force component Ps of a horizontal direction parallel with the sliding direction and a force component Ph of a vertical direction perpendicular to the sliding direction, as shown in FIG. 22, the force component of the horizontal direction parallel with the sliding direction is directed away from the photosensitive drum 9. As a result, regarding the driving of the developing sleeve 12d, the distance between the photosensitive drum 9 and the development sleeve 12d is easily varied in accordance with the meshing force between the flange gear 9c and the sleeve gear 12k, with the result that the toner on the developing sleeve 12d cannot be moved to the photosensitive drum 9 properly, thus worsening the developing ability.

To avoid this, in the illustrated embodiment, as shown in FIG. 21A, in consideration of the transmission of the driving force from the flange gear 9c to the sleeve gear 12k, the sliding direction of the sleeve bearing 12i at the driving side (side where the sleeve gear 12*k* is disposed) is coincided with directions shown by the arrow Q. That is to say, an angle ϕ, formed between the direction of the meshing force P (between the flange gear 9*c* and the sleeve gear 12*k*) and the sliding direction, is set to have a value of about 90° (92° in the illustrated embodiment). With this arrangement, the force component Ps of the horizontal direction parallel with the sliding direction is negligible, and, in the illustrated embodiment, the force component Ps acts to slightly bias the developing sleeve 12*d* toward the photosensitive drum 9. In such a case, the developing sleeve 12*d* is pressurized by an amount corresponding to spring pressure α of the urging springs 12*j* to maintain the distance between the photosensitive drum 9 and the developing sleeve 12*d* constant, thereby ensuring the proper development.

Next, the sliding direction of the slide bearing 12*i* at the non-driving side (side where the sleeve gear 12*k* is not arranged) will be explained. At the non-driving side, unlike the above-mentioned driving side, since the slide bearing 12*i* does not receive a driving force, as shown in FIG. 21B, the sliding direction of the slide bearing 12*i* is selected to be substantially parallel with a line connecting a center of the photosensitive drum 9 and a center of the developing sleeve 12*d*.

In this way, when the developing sleeve 12*d* is pressurized toward the photosensitive drum 9, by changing the urging angle for urging the developing sleeve 12*d* at the driving side from that at the non-driving side, the positional relation between the developing sleeve 12*d* and the photosensitive drum 9 is always maintained properly, thus permitting the proper development.

Incidentally, the sliding direction of the slide bearing 12*i* at the driving side may be set to be substantially parallel with the line connecting the center of the photosensitive drum 9 and the center of the developing sleeve 12*d* as in the case of the non-driving side. That is to say, as described in the above-mentioned embodiment, at the driving side, since the developing sleeve 12*d* is urged away from the photosensitive drum 9 by the force component Ps (of the meshing force between the flange gear 9*c* and the sleeve gear 12*k*) directing toward the sliding direction of the slide bearing 12*i*, in this embodiment, the urging force of the urging spring 12*j* at the driving side may be set to have a value greater than that at the non-driving side by an amount corresponding to the force component Ps. That is, when the urging force of the urging spring 12*j* to the developing sleeve 12*d* at the non-driving side is P, the urging force P2 of the urging spring 12*j* at the driving side is set to have a relation P2=P1+Ps, with the result that the developing sleeve 12*d* is always subjected to the proper urging force, thus ensuring the constant distance between the developing sleeve and the photosensitive drum 9.

(Cleaning Means)

The cleaning means 13 serves to remove the residual toner remaining on the photosensitive drum 9 after the toner image on the photosensitive drum 9 has been transferred to the recording medium 4 by the transfer means 6. As shown in FIG. 4, the cleaning means 13 comprises an elastic cleaning blade 13*a* contacting with the surface of the photosensitive drum 9 and adapted to remove or scrape off the residual toner remaining on the photosensitive drum 9, a squeegee sheet 13*b* slightly contacting with the surface of the photosensitive drum 9 and disposed below the cleaning blade 13*a* to receive the removed toner, and a waste toner reservoir 13*c* for collecting the waste toner received by the sheet 13*b*. Incidentally, the squeegee sheet 13*b* is slightly contacted with the surface of the photosensitive drum 9 and the serves to permit the passing of the residual toner remaining on the photosensitive drum, but to direct the toner removed from the photosensitive drum 9 by the cleaning blade 13*a* to a direction away from the surface of the photosensitive drum 9.

Figure 23:
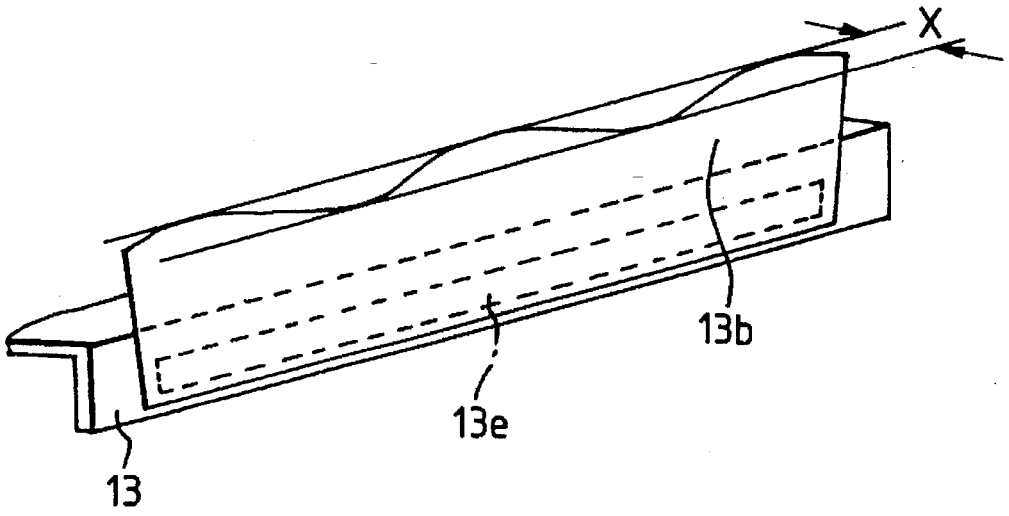
FIG. 23 is a perspective view of a squeegee sheet in a condition where an upper edge of the sheet is tortuous.

Now, a method for attaching the squeegee sheet 13*b* will be described. The squeegee sheet 13*b* is adhered to an attachment surface 13*d* of the waste toner reservoir 13*c* via both-side adhesive tape 13*e*. In this case, the waste toner reservoir 13*c* is made of resin material (for example, high-impact styrol (HIPS) or the like) and has a slight uneven surface. Thus, as shown in FIG. 23, if the both-sided adhesive tape 13*e* is merely stuck to the attachment surface 13*d* and the squeegee sheet 13*b* is merely attached to The adhesive tape 13*e*, it is feared that a free edge of the squeegee sheet 13*b* (to be contacted with the photosensitive drum 9) is tortuous, as shown by x. If such a tortuous edge x of the squeegee sheet 13*b* is generated, the squeegee sheet 13*b* does not closely contact with the surface of the photosensitive drum 9, so that it cannot receive all the toner removed by the cleaning blade 13*a*.

Figure 24A:
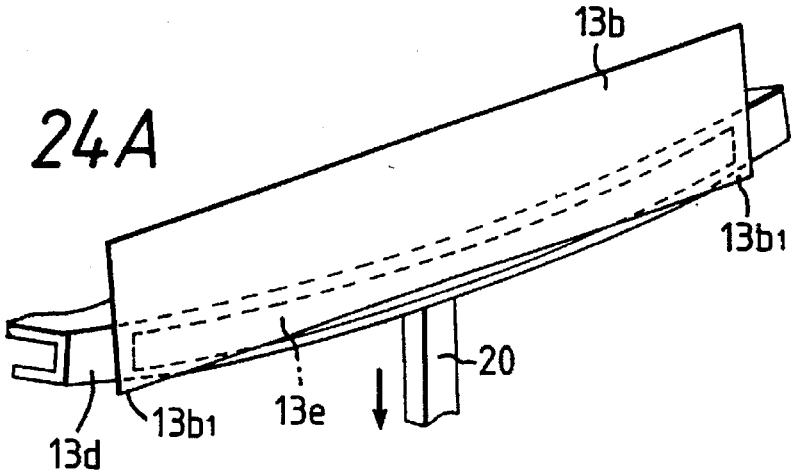
FIG. 24A is a perspective view showing a condition that a both-sided adhesive tape is protruded from a lower end of the squeegee sheet.

In order to avoid this, it is considered that, when the squeegee sheet 13*b* is attached to the attachment surface, as shown in FIG. 24A, the attachment surface 13*d*, at a lower portion of the waste toner reservoir, is pulled downwardly by a pulling tool 20 to elastically deform the attachment surface to form a curvature and then the squeegee sheet 13*b* is stuck to the curved attachment surface, and, thereafter the curvature of the attachment surface is released to apply the tension to the free edge of the squeegee sheet 13*b*, thereby preventing the free edge from becoming tortuous. However, in the recent small-sized process cartridges B, since the dimension of the attachment surface 13*d* is small, if the squeegee sheet 13*b* is stuck to the curved attachment surface 13*d*, as shown in FIG. 24A, both lower ends or corners 13*b*1 of the squeegee sheet 13*b* will be protruded from the attachment surface 13*d* downwardly. Further, when the Squeegee sheet 13*b* is protruded downwardly from the attachment surface 13*d*, as is apparent from the sectional view of FIG. 1, it is feared that the recording medium 4 is interfered with the protruded squeegee sheet 13*b*.

Figure 24B:
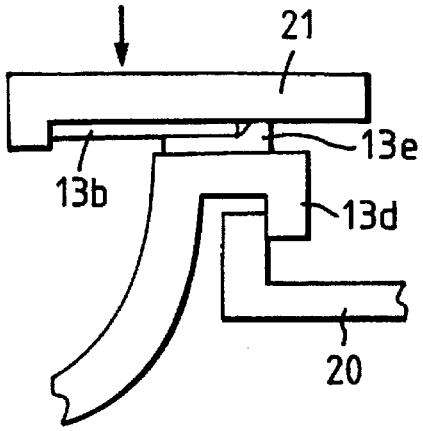
FIGS. 24B and 24C are views showing a condition that a sticking tool is adhered to the protruded both-sided adhesive tape.
Figure 24C:
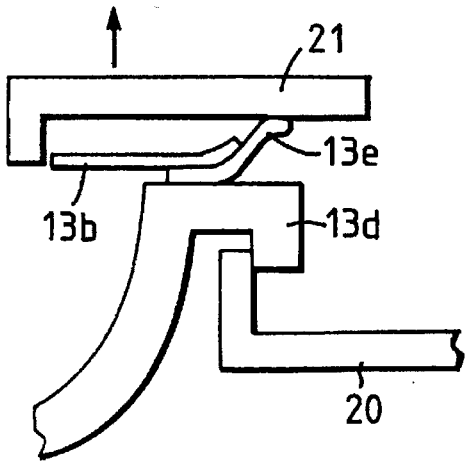

Further, it the squeegee sheet 13*b* is attached to the curved attachment surface 13*d*, as shown in FIG. 24A, the both-sided adhesive tape 13*e* will be protruded from the lower end of the squeegee sheet 13*b*. Thus, in this condition, when the squeegee sheet 13*b* is urged against the both-sided adhesive tape 13*e* by a sticking tool 21, as shown in FIG. 24B, the protruded portion of the both-sided adhesive tape 13*e* is stuck to the sticking tool 21, with the result that, when the sticking tool 21 is removed, as shown in FIG. 24C, the both-sided adhesive tape 13*e* is peeled from the attachment surface 13*d*, thus causing poor attachment of the squeegee sheet 13*b*.

Figure 25A:
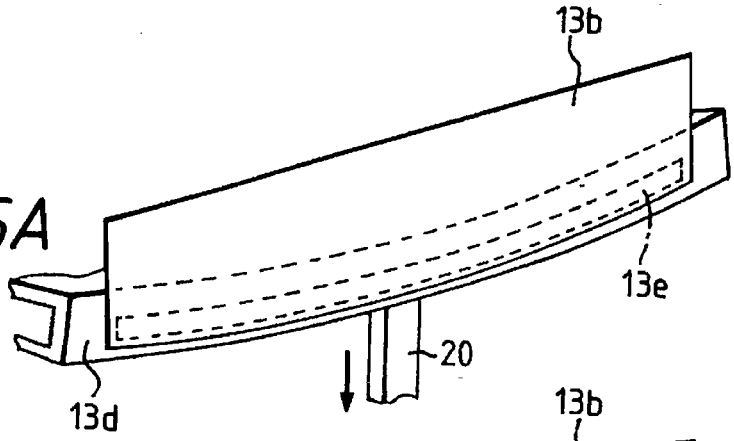
FIG. 25A is a perspective view showing a condition where the squeegee sheet is stuck to a curved attachment surface with a lower end portion of the sheet being curved.
Figure 25B:
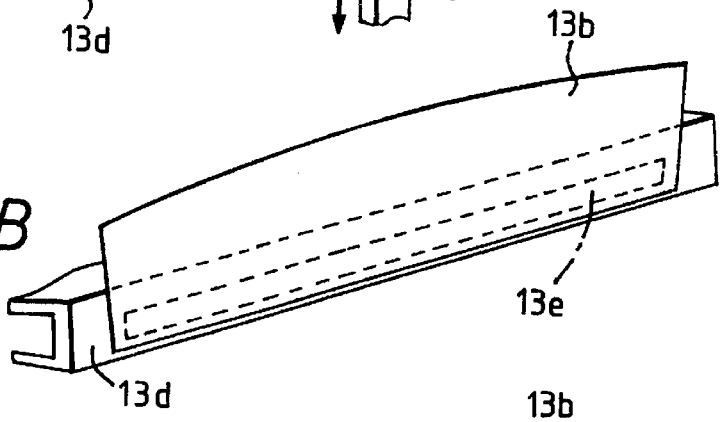
FIG. 25B is a perspective view showing a condition that an upper end portion of the squeegee sheet is tensioned by releasing the curvature of the attachment surface.

To avoid this, in the illustrated embodiment, as shown in FIG. 25A, the configuration of the lower end of the squeegee sheet 13*b* becomes substantially the same as the curvature configuration of the attachment surface 13*d*, which has been curved by the pulling tool 20. That is to say, a width of the squeegee sheet 13*b* is varied from both longitudinal ends to a central portion so that the latter becomes greater than the former (for example, width at the central portion is about 7.9 mm, and width at both ends is about 7.4 mm). In this way, when the squeegee sheet 13*b* is attached to the attachment surface, the curved both-sided adhesive tape 13*e* does not protrude from the squeegee sheet 13*b*. Further, when the pulling tool 20 is removed to release the curvature of the attachment surface 13*d* thereby to apply the tension to the upper edge of the squeegee sheet 13*b* as shown in FIG. 25B, the lower end of the squeegee sheet does not protrude from the attachment surface 13*d* downwardly. Therefore, the above-mentioned interference between the recording medium 4 and the squeegee sheet 13*b* and the poor attachment of the squeegee sheet 13*b* can be prevented.

Figure 26:
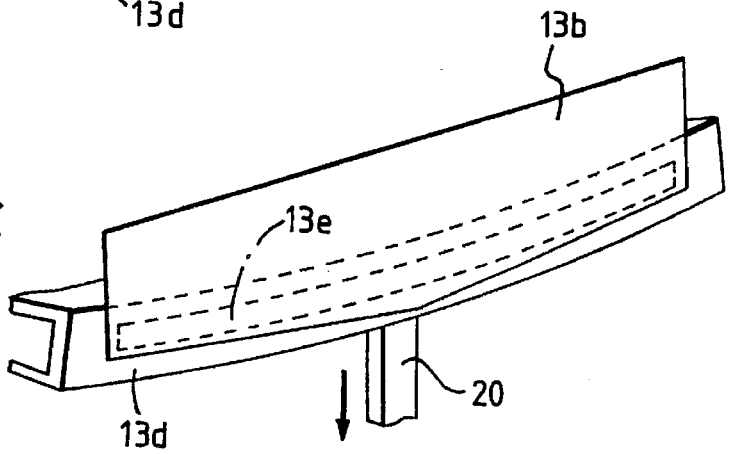
FIG. 26 is a perspective view of a squeegee sheet according to another embodiment wherein a width of the sheet is straightened and widened gradually from both ends to a central portion thereof.
Figure 27:
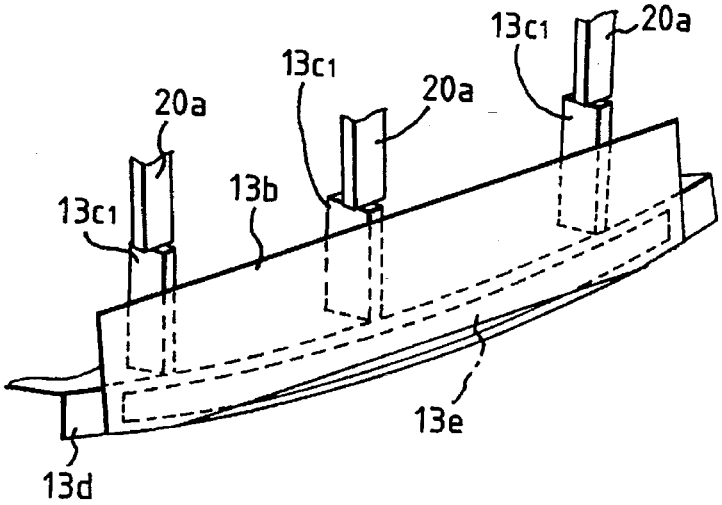
FIG. 27 is a perspective view for explaining the formation of the curvature of the squeegee sheet attachment surface by pressing the surface.

Incidentally, in view of the workability and the service life of a working tool, it is desirable that the lower edge of the squeegee sheet 13*b* is straight. Thus, as shown in FIG. 26, the width of the squeegee sheet 13*b* may be varied straightly so that the width at the central portion becomes greater than those at both longitudinal ends in correspondence to the amount of the curvature of the attachment surface 13*d*. In the above-mentioned embodiment, while the attachment surface 13*d* was curved by pulling it by the pulling tool 20, it is to be understood that, as shown in FIG. 27, the attachment surface 13*d* may be curved by pushing toner reservoir partition plates 13*c*1, which are integrally formed with the attachment surface 13*d* by pushing tools 20*a*.

Further, in the illustrated embodiment, while the squeegee sheet attachment surface 13*d* was formed on the lower portion of the waste toner reservoir 13*c*, the squeegee sheet 13*b* may be stuck to a metallic plate attachment surface independently formed from the waste toner reservoir 13*c* and the metallic plate may be incorporated into the waste toner reservoir 13*c*.

Incidentally, in the illustrated embodiment, the squeegee sheet 13*b* is made of polyethylene terephthalate (PET) and has a thickness of about 38 μm, a length of about 241.3 mm, a central width of about 7.9 mm, end widths of about 7.4 mm and an appropriate radius of curvature of about 14556.7 mm.

(Upper and Lower Frames)

Next, the upper and lower frames 14, 15 constituting the housing of the process cartridge B will be explained. As shown in FIGS. 7 and 8, the photosensitive drum 9, the developing sleeve 12*d*, developing blade 12*e* of the developing means 12, and the cleaning means 13 are provided in the lower frame 15. On the other hand, as shown in FIGS. 7 and 9, the charger roller 10, the toner reservoir 12*a* of the developing means 12 and the toner feed mechanism 12*b* are provided in the upper frame 14.

In order to assemble the upper and lower frames 14, 15 together, four pairs of locking pawls 14*a* are integrally formed with the upper frame 14 and are spaced apart from each other equidistantly in a longitudinal direction of the upper frame. Similarly, locking openings 15*a* and locking projections 15*b* for engaging by the locking pawls 14*a* are integrally formed on the lower frame 15. Accordingly, when the upper and lower frames 14, 15 are forcibly urged against each other to engage the locking pawls 14*a* by the corresponding locking openings 15*a* and locking projections 15*b*, the upper and lower frames 14, 15 are interconnected. Incidentally, in order to ensure the interconnection between the upper and lower frames, as shown in FIG. 8, a locking pawl 15*c* and a locking opening 15*d* are formed near both longitudinal ends of the lower frame 15, respectively, whereas, as shown in FIG. 9, a locking opening 14*b* (to be engaged by the locking pawl 15*c*) and a locking pawl 14*c* (to be engaged by the locking opening 15*d*) are formed near both longitudinal ends of the upper frame 14, respectively.

When the parts constituting the process cartridge B are separately contained within the upper and lower frames 14, 15 as mentioned above, by arranging the parts which should be positioned with respect to the photosensitive drum 9 (for example, developing sleeve 12*d*, developing blade 12*e* and cleaning blade 13*a*) within the same frame (lower frame 15 in the illustrated embodiment), it is possible to ensure the excellent positioning accuracy of each part and to facilitate the assembling of the process cartridge B. Further, as shown in FIG. 8, fitting recesses 15*n* are formed in the lower frame 15 in the vicinity of one lateral edge thereof. On the other hand, as shown in FIG. 9, fitting projections 14*h* (to be fitted into the corresponding fitting recesses 15*n*) are formed on the upper frame 14 in the vicinity of one lateral edge thereof at intermediate locations between the adjacent locking pawls 14*a*.

Further, in the illustrated embodiment, as shown in FIG. 8, fitting projections 15*e* are formed on the lower frame 15 near two corners thereof, whereas fitting recesses 15*f* are formed in the lower frame near the other two corners. On the other hand, as shown in FIG. 9, fitting recesses 14*d* (to be engaged by the corresponding fitting projections 15*e*) are formed in the upper frame 14 near two corners thereof, whereas fitting projections 14*e* (to be fitted into the corresponding fitting recesses 15*f*) are formed in the lower frame near the other two corners. Accordingly, when the upper and lower frames 14, 15 are interconnected, by fitting the fitting projections 14*h*, 14*e*, 15*e* (of the upper and lower frames 14, 15) into the corresponding fitting recesses 15*n*, 15*f*, 14*d*, the upper and lower frames 14, 15 are firmly interconnected to each other so that, even if a torsion force is applied to the interconnected upper and lower frames 14, 15, they are not disassembled.

Incidentally, the positions of the above-mentioned fitting projections and fitting recesses may be changed so long as the interconnected upper and lower frames 14, 15 are not disassembled by any torsion force applied thereto.

Further, as shown in FIG. 9, a protection cover 22 is rotatably mounted on the upper frame 14 via pivot pins 22*a*. The protection cover 22 is biased toward a direction shown by the arrow h in FIG. 9 by torsion coil springs (not shown) arranged around the pivot pins 22*a*, so that the projection cover 22 closes or covers the photosensitive drum 9 in the condition that the process cartridge B is removed from the image forming system A as shown in FIG. 4.

More specifically, as shown in FIG. 1, the photosensitive drum 9 is so designed that it is exposed from an opening 15*g* formed in the lower frame 15 to be opposed to the transfer roller 6 in order to permit the transferring of the toner image from the photosensitive drum onto the recording medium 4. However, in the condition that the process cartridge B is removed from the image forming system A, if the photosensitive drum 9 is exposed to the atmosphere, it will be deteriorated by the ambient light and the dirt and the like will be adhered to the photosensitive drum 9. To avoid this, when the process cartridge B is dismounted from the image forming system A, the opening 15*g* is closed by the protection cover 22, thereby protecting the photosensitive drum 9 from the ambient light and dirt. Incidentally, when the process cartridge B is mounted within the image forming system A, the protection cover 22 is rotated by a rocking mechanism (not shown) to expose the photosensitive drum 9 from the opening 15*g*.

Further, as apparent from FIG. 1, in the illustrated embodiment, the lower surface of the lower frame 15 also acts as a guide for conveying the recording medium 4. The lower surface of the lower frame is formed as both side guide portions 15*h*1 and a stepped central guide portion 15*h*2 (FIG. 6). The longitudinal length (i.e., distance between the steps) of the central guide portion 15*h*2 is about 102–120 mm (107 mm in the illustrated embodiment) which is slightly greater than a width (about 100 mm), and the depth of the step is selected to have a value of about 0.8–2 mm. With this arrangement, the central guide portion 15*h*2 increases the conveying space for the recording medium 4, with the result that, even when a thick resilient sheet such as a post card, visiting card or envelope is used as the recording medium 4, such a thick sheet does not interfere with the guide surface of the lower frame 15, thereby preventing the recording medium from jamming. On the other hand, when a thin sheet having a greater width than that of the post card such as a plain sheet is used as the recording medium, since such sheet (recording medium) is guided by both side guide portions 15*h*1, it is possible to convey the sheet without floating.

Figure 28:
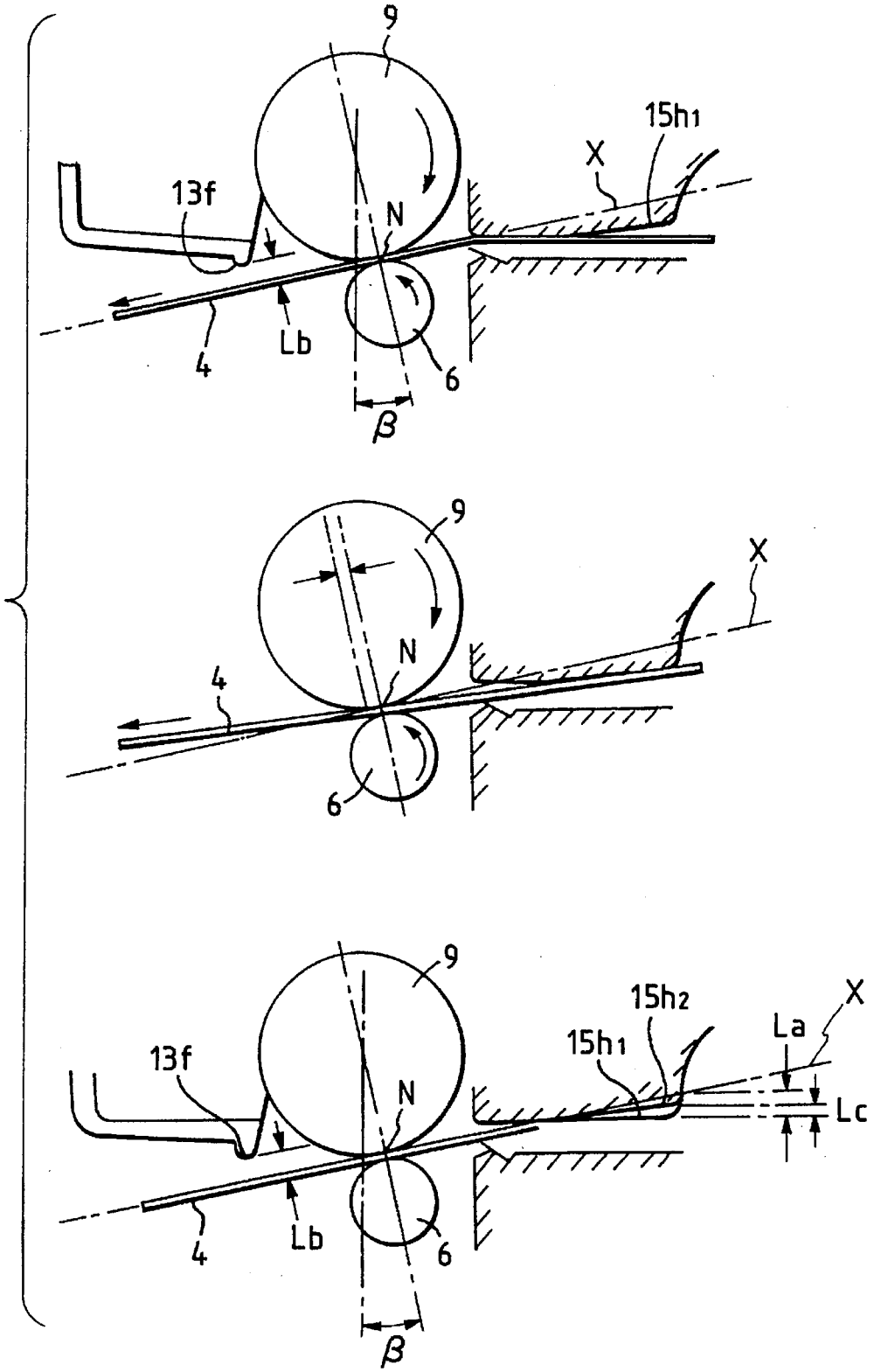
FIG. 28 is a view showing conditions that a recording medium is being guided by a lower surface of the lower frame.

Now, the lower surface of the lower frame 15 acting as the convey guide for the recording medium will be described more concretely. As shown in FIG. 28, both side guide portions 15*h*1 can be flexed by an amount La (=5–7 mm) with respect to a tangential direction X regarding a nip N between the photosensitive drum 9 and the transfer roller 6. Since both side guide portions 15*h*1 are formed on the lower surface of the lower frame 15 designed to provide the required space between the lower frame and the developing sleeve 12*d* and the required space for sufficiently supplying the toner to the developing sleeve, such guide portions are determined by the position of the developing sleeve 12*d* selected to obtain the optimum developing condition. If the lower surfaces of the side guide portions are approached to the tangential line X, the thickness of the lower portion of the lower frame 15 is decreased, thus causing a problem regarding the strength of the process cartridge B.

Further, the position of a lower end 13*f* of the cleaning means 13 is determined by the positions of the cleaning blade 13*a*, the squeegee sheet 13*b* and the like constituting the cleaning means 13 as described later, and is so selected to provide a distance Lb (=3–5 mm) preventing the interference with the recording medium 4 being fed. Incidentally, in the illustrated embodiment, as angle β between a vertical line passing through the rotational center of the photosensitive drum 9 shown in FIG. 28 and a line connecting the rotational center of the photosensitive drum and the rotational center of the transfer roller 6 is selected to have a value of 5–20 degrees.

In consideration of the above affairs, by providing the recess or step having a depth Lc (=1–2 mm) only in the central guide portion 15*h*2 to approach this guide portion to the tangential line X, it is possible to feed the thicker and resilient recording medium 4 smoothly without reducing the strength of the lower frame 15. Incidentally, in most cases, since the thicker and more resilient recording medium 4 are in the form of the visiting card, envelope or the like, which are narrower than the post card under the general specification of the image forming system, so long as the width of the stepped or recessed central guide portion 15*h*2 is selected to be slightly greater than that of the post card, there is no problem in the practical use.

Further, regulating projections 15*i* protruding downwardly are formed on the outer surface of the lower frame 15 in areas outside of the recording medium guiding zone. The regulating projections 15*i* each protrudes from the guide surface of the lower frame for the recording medium 4 by about 1 mm. With this arrangement, even if the process cartridge B is slightly lowered for some reason during the image forming operation, since the regulating projections 15*i* are abutted against a lower guide member 23 (FIG. 1) of the body 16 of the image forming system, the further lowering of the process cartridge can be prevented. Accordingly, a space of at least 1 mm is maintained between the lower guide member 23 and the lower guide surface of the lower frame 15 to provide a convey path for the recording medium 4, thereby conveying the recording medium without jamming. Further, as shown in FIG. 1, a recess 15*j* is formed in the lower surface of the lower frame 15 not to interfere with the register roller 5*c*2. Thus, when the process cartridge B is mounted within the image forming system A, since it can be mounted near the register roller 5*c*2, the whole image forming system can be small in size.

(Assembling of Process Cartridge)

Figure 29:
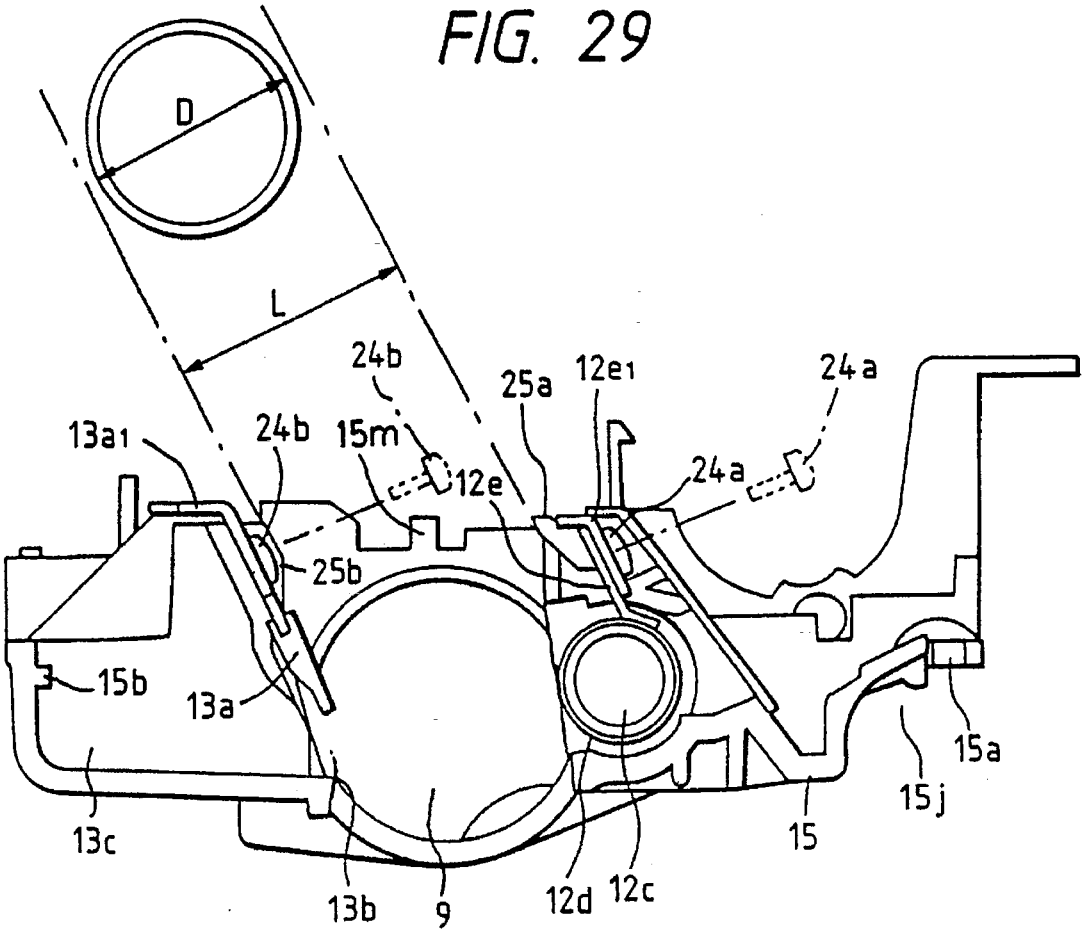
FIG. 29 is a sectional view showing a condition where the photosensitive drum is finally assembled.

Next, the assembling of the process cartridge having the above-mentioned construction will be explained. In FIG. 29, toner leak preventing seals S having a regular shape and made of Moltopren (flexible palyurethane, manufactured by INOAC Incorp.) rubber for preventing the leakage of toner are stuck on ends of the developing means 12 and on the ends of the cleaning means 13 and on the lower frame 15. Incidentally, the toner leak preventing seals S each may not have the regular shape. Alternatively, toner leak preventing seals may be attached by forming recesses in portions (to be attached) of the seals and by pouring liquid material which becomes elastomer when solidified into the recesses.

A blade support member 12*e*1 to which the developing sleeve 12*e* is attached and a blade support member 13*a*1 to which the cleaning blade 13*a* is attached are attached to the lower frame 15 by pins 24*a*, 24*b*, respectively. According to the illustrated embodiment, as shown by the phantom lines in FIG. 29, the attachment surfaces of the blade support members 12*e*1, 13*a*1 may be substantially parallel to each other so that the pins 24*a*, 24*b* can be driven from the same direction. Thus, when a large number of process cartridges B are manufactured, the developing blades 12*e*and the cleaning blades 13*a* can be continuously attached by the pins by using an automatic device. Further, the assembling ability for the blades 12*e*, 13*a* can be improved by providing a space for a screw driver, and the shape of a mold can be simplified by aligning the housing removing direction from the mold, thereby achieving the a reduction in cost.

Figure 30:
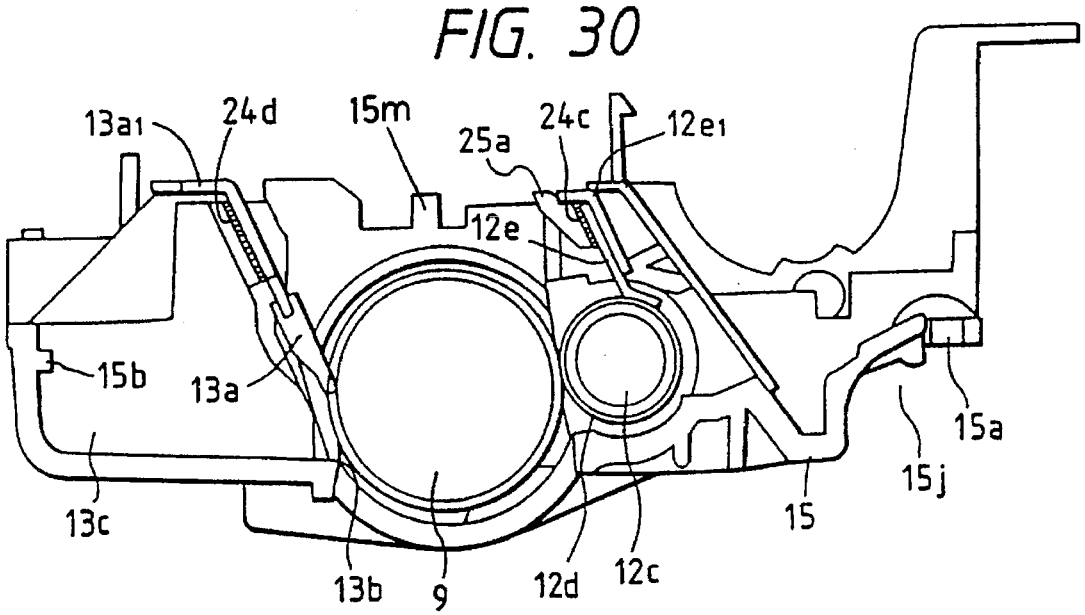
FIG. 30 is a sectional view showing a condition where a developing blade and a cleaning blade are stuck.

Incidentally, the developing blade 12*e* and the cleaning blade 13*a* may not be attached by the pins (screws), but may be attached to the lower frame 15 by adhesives 24*c*, 24*d*, as shown in FIG. 30. Also in this case, when the adhesives can be applied from the same direction, the attachment of the developing blade 12*e* and the cleaning blade 13*a* can be automatically and continuously performed by using an automatic device.

Figure 31:
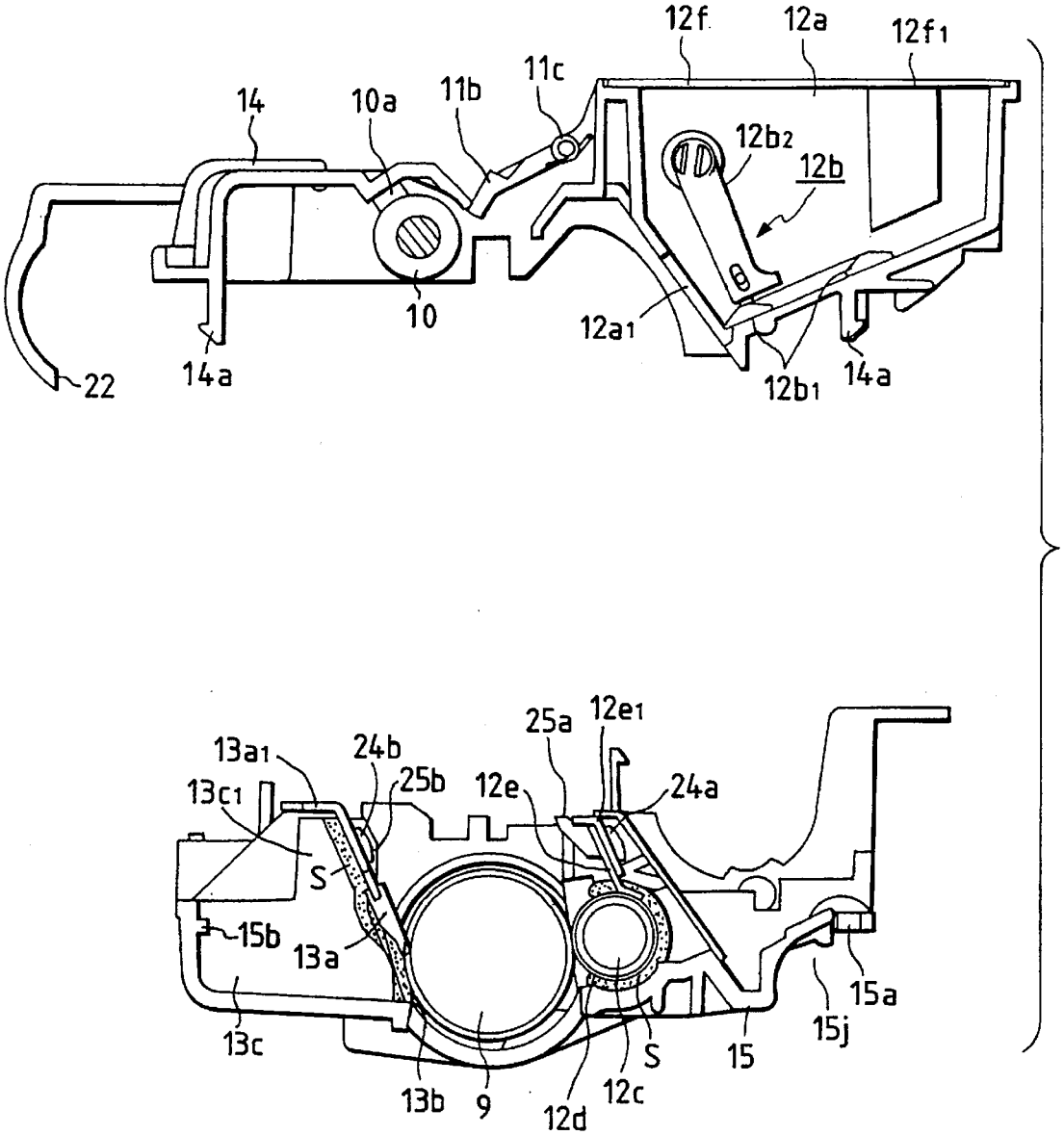
FIG. 31 is an exploded view for explaining the assembling of the process cartridge.
Figure 32:
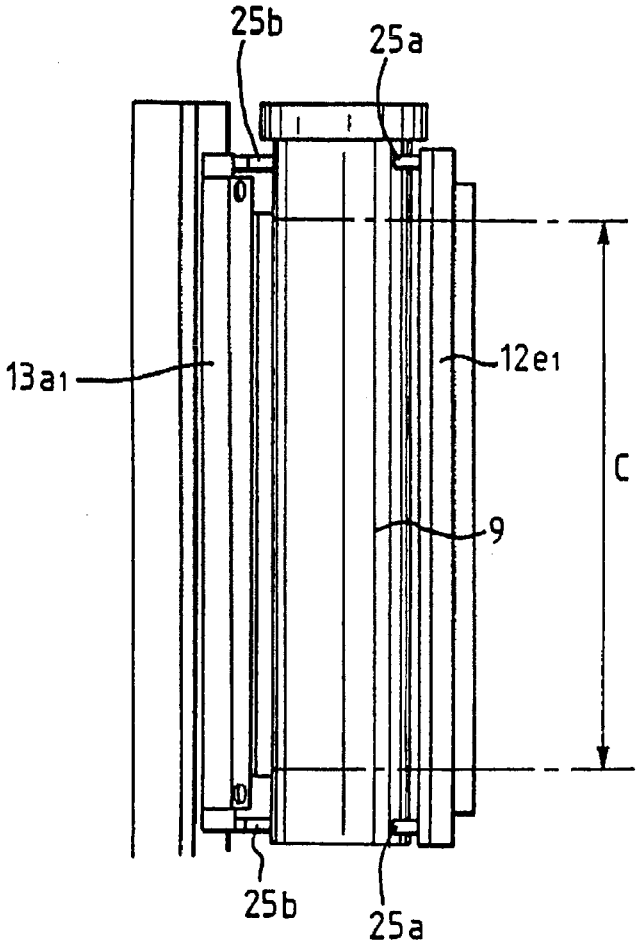
FIG. 32 is a view for explaining a position of guide members when the photosensitive drum of the process cartridge is assembled.

After the blades 12*e*, 13*a* have been attached as mentioned above, the developing sleeve 12*d* is attached to the lower frame 15. Then, the photosensitive drum 9 is attached to the lower frame 15. To this end, in the illustrated embodiment, guide members 25*a*, 25*b* are attached to surfaces (opposed to the photosensitive drum) of the blade support members 12*e*1, 13*a*1, respectively, at zones outside of the longitudinal image forming area C (FIG. 32) of the photosensitive drum 9. (Incidentally, in the illustrated embodiment, the guide members 25*a*, 25*b* are integrally formed with the lower frame 15). A distance between the guide members 25*a* and 25*b* is set to be greater than the outer diameter D of the photosensitive drum 9. Thus, after the various parts such as the developing blade 12*e*, cleaning blade 13*a* and the like have been attached to the lower frame 15, as shown in FIG. 31, the photosensitive drum 9 can be finally attached to the lower frame while guiding the both longitudinal ends (outside of the image forming area) of the photosensitive drum by the guide members 25*a*, 25*b*. That is to say, the photosensitive drum 9 is attached to the lower frame 15 while slightly flexing the cleaning blade 13*a* and/or slightly retarding and rotating the developing sleeve 12*d*.

If the photosensitive drum 9 is firstly attached to the lower frame 15 and then the blades 12*e*, 13*a* and the like are attached to the lower frame, it is feared that the surface of the photosensitive drum 9 is damaged during the attachment of the blades 12*e*, 13*a* and the like. Further, during the assembling operation, it is difficult or impossible to check the attachment positions of the developing blade 12*e* and the cleaning blade 13*a* and to measure the contacting pressures between the blades and the photosensitive drum. In addition, although lublicant must be applied to the blades 12*e*, 13*a* to prevent the increase in torque and/or the blade turn-up due to the close contact between the initial blades 12*e*, 13*a* (at the non-toner condition) and the photosensitive drum 9 and the developing sleeve 12*d* before the blades 12*e*, 13*a* are attached to the lower frame 15, such lublicant is likely to be dropped off from the blades during the assembling of the blades. However, according to the illustrated embodiment, since the photosensitive drum 9 is finally attached to the lower frame, the above-mentioned drawbacks and problems can be eliminated.

As mentioned above, according to the illustrated embodiment, it is possible to check the attachment positions of the developing means 12 and the cleaning means 13 in the condition that these means 12, 13 are attached to the frames, and to prevent the image forming area of the photosensitive drum from being damaged or scratched during the assembling of the drum. Further, since it is possible to apply the lublicant to the blades in the condition that these means 12, 13 are attached to the frames, the dropping of the lublicant can be prevented, thereby preventing the occurrence of the increase in torque and/or the blade turn-up due to the close contact between the developing blade 12*e* and the developing sleeve 12*d*, and the cleaning blade 13*a* and the photosensitive drum 9.

Figure 33:
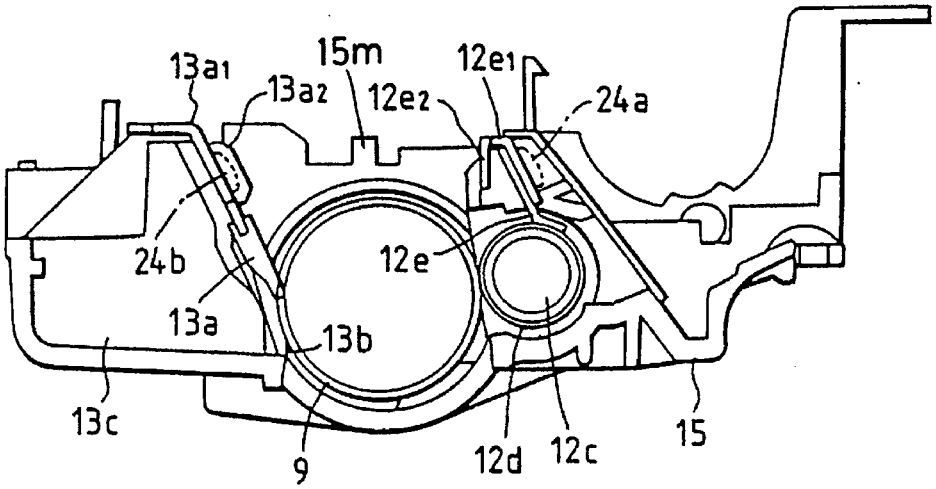
FIG. 33 is a sectional view of a structure wherein drum guides are arranged at the end of blade supporting members.

Incidentally, in the illustrated embodiment, while the guide members 25*a*, 25*b* were integrally formed with the lower frame 15, as shown in FIG. 33, projections 12*e*2, 13*a*2 may be integrally formed on the blade support members 12*e*1, 13*a*1 or other guide members may be attached to the blade support members at both longitudinal end zones of the blade support members outside of the image forming area of the photosensitive drum 9, so that the photosensitive drum 9 is guided by these projections or other guide members during the assembling of the drum.

Figure 34:
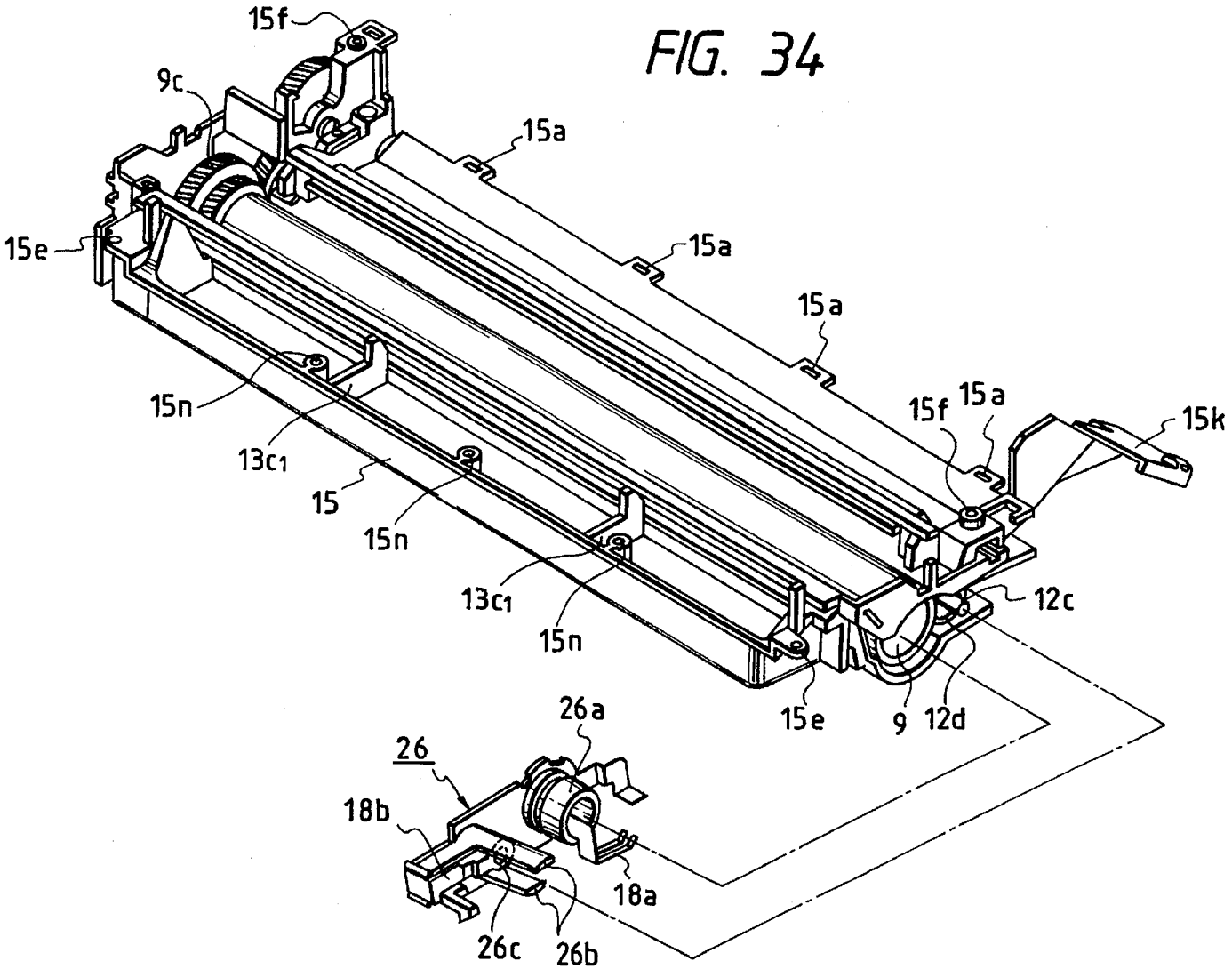
FIG. 34 is a perspective view for explaining the attachment of bearing members for the photosensitive drum and the developing sleeve.
Figure 35:
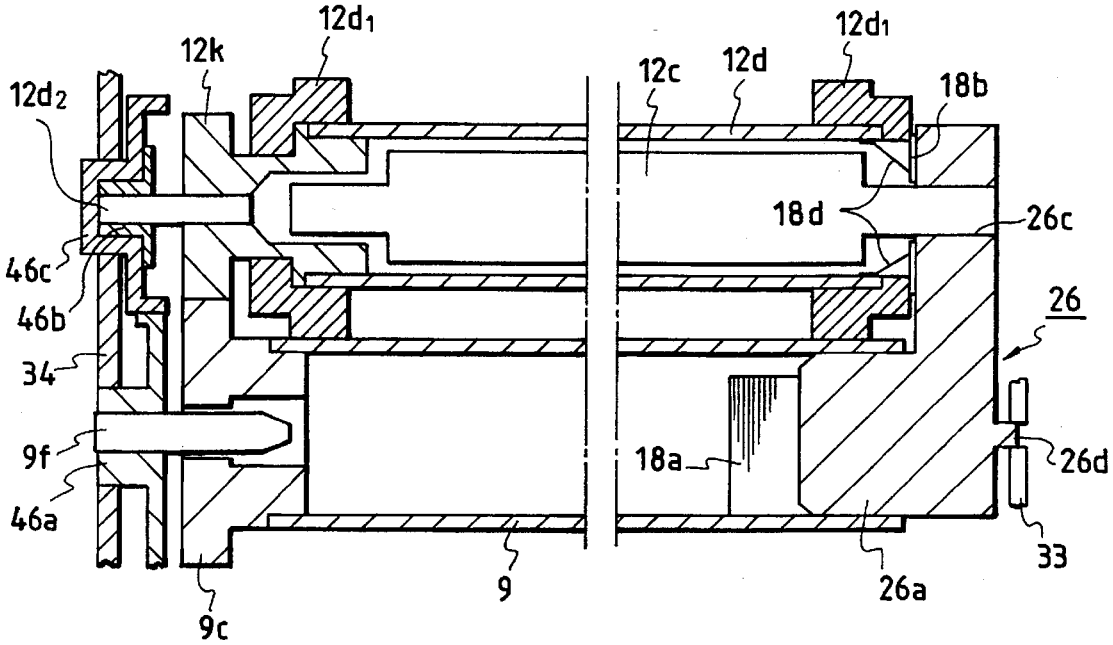
FIG. 35 is a sectional view of the photosensitive drum and the developing sleeve with the bearing members attached thereto.

After the developing sleeve 12*d*, developing blade 12*e*, cleaning blade 13*a* and photosensitive drum 9 have been attached to the lower frame 15 as mentioned above, as shown in FIG. 34 (perspective view) and FIG. 35 (sectional view), the bearing member 26 is incorporated to rotatably support one end of the photosensitive drum 9 and one end of the developing sleeve 12*d*. The bearing member 26 is made of anti-wear material such as polyacetal and comprises a drum bearing portion 26*a* to be fitted on the photosensitived rum 9, a sleeve bearing portion 26*b* to be fitted on the outer surface of the developing sleeve 12*d*, and a D-cut hole portion 26*c* to be fitted on an end of a D-cut magnet 12*c*. Alternatively, the sleeve bearing portion 26*b* may be fitted on the outer surface of the sleeve bearing 12*i* supporting the outer surface of the developing sleeve 12*d* or may be fitted between slide surfaces 15Q of the lower frame 15 which are fitted on the outer surface of the slide bearing 12*i*.

Accordingly, when the drum bearing portion 26*a* is fitted on the end of the photosensitive drum 9 and the end of the magnet 12*c* is inserted into the D-cut hole portion 26*c* and the developing sleeve 12*d* is inserted between into the sleeve bearing portion 26*b* and the bearing member 26 is fitted into the side of the lower frame 15 while sliding it in the longitudinal direction of the drum, the photosensitive drum 9 and the developing sleeve 12*d* are rotatably supported.

Incidentally, as shown in FIG. 34, the earthing contact 18*a* is attached to the bearing member 26, and, when the bearing member 26 is fitted into the side of the lower frame, the earthing contact 18*a* is contacted with the aluminium drum core 9*a* of the photosensitive drum 9 (see FIG. 10). Further, the developing bias contact 18*b* is also attached to the bearing member 26, and, when the bearing member 26 is attached to the developing sleeve 12*d*, the bias contact 18*b* is contacted with a conductive member 18*d* contacting the inner surface of the developing sleeve 12*d*.

In this way, by rotatably supporting the photosensitive drum 9 and the developing sleeve 12*d* by the single bearing member 26, it is possible to improve the positional accuracy of the elements 9, 12*d*, and to reduce the number of parts, thereby facilitating the assembling operation and achieving a reduction in cost. Further, since the positioning of the photosensitive drum 9 and the positioning of the developing sleeve 12*d* and the magnet 12*c* can be performed by using a single member, it is possible to determine the positional relation between the photosensitive drum 9 and the magnet 12*c* with high accuracy, with the result that it is possible to maintain a magnetic force regarding the surface of the photosensitive drum 9 constant, thus obtaining the high quality image. In addition, since the earthing contact 18*a* for earthing the photosensitive drum 9 and the developing bias contact 18*b* for applying the developing bias to the developing sleeve 12*d* are attached to the bearing member 26, the compactness Of the parts can be achieved effectively, thus making the process cartridge B small in size.

Further, by providing (on the bearing member 26) supported portions for positioning the process cartridge B within the image forming system when the process cartridge is mounted within the image forming system, the positioning of the process cartridge B regarding the image forming system can be effected accurately. Furthermore, as apparent from FIGS. 5 and 6, an outwardly protruding U-shaped projection, i.,e, drum shaft portion 26*d* (FIG. 20) is also formed on the bearing member 26. When the process cartridge B is mounted within the body 16 of the image forming system, the drum shaft portion 26*d* is supported by a shaft support member 34 as will be described later, thereby positioning the process cartridge B. In this way, since the process cartridge B is positioned by the bearing member 26 for directly supporting the photosensitive drum 9 when the cartridge is mounted within the system body 16, the photosensitive drum 9 can be accurately positioned regardless of the manufacturing and/or assembling errors of other parts.

Further, as shown in FIG. 35, the other end of the magnet 12*c* is received in an inner cavity formed in the sleeve gear 12*k*, and an outer diameter of the magnet 12*c* is so selected as to be slightly smaller than an inner diameter of the cavity. Thus, at the sleeve gear 12*k*, the magnet 12*c* is held in the cavity with any play and is maintained in a lower position in the cavity by its own weight or is biased toward the blade support member 12*e*1 made of magnetic metal such as ZINKOTE (zinc plated steel plate, manufactured by shin Nippon Steel Incorp. ) by a magnetic force of the magnet 12*c*. In this way, since the sleeve gear 12*k* and the magnet 12*c* are associated with each other with any play, the friction torque between the magnet 12*c* and the rotating sleeve gear 12*k* can be reduced, thereby reducing the torque regarding the process cartridge.

On the other hand, as shown in FIG. 31, the charger roller 10 is rotatably mounted within the upper frame 14, and the shutter member 11*b*, the protection cover 22 and the toner feed mechanism 12*b* are also attached to the upper frame 15. The opening 12*a*1 for feeding out the toner from the toner reservoir 12*a* to the developing sleeve 12*d* is closed by a cover film 28 (FIG. 36) having a tear tape 27. Further, the lid member 12*f* is secured to the upper frame, and, thereafter, the toner is supplied to the toner reservoir 12*a* through the filling opening 12*a*3 and then the filling opening 12*a*3 is closed by the lid 12*a*2, thus sealing the toner reservoir 12*a*.

Figure 36:
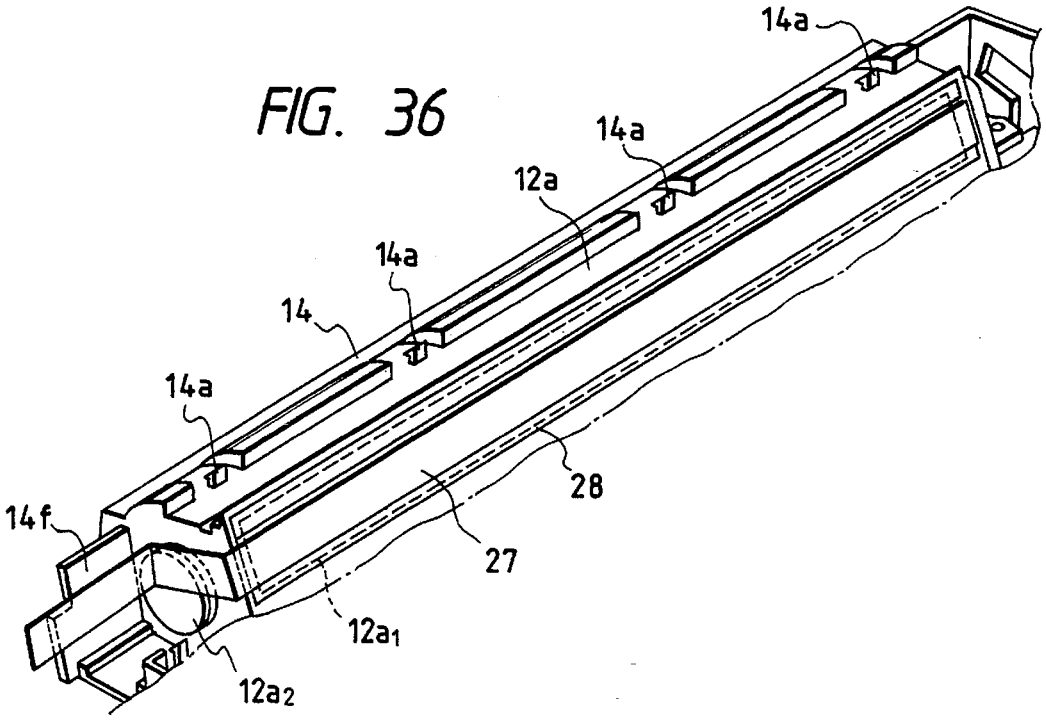
FIG. 36 is a perspective view for explaining a cover film and a tear tape.

Incidentally, as shown in FIG. 36, the tear tape 27 of the cover film 28 stuck around the opening 12*a*1 extends from one longitudinal end (right end in FIG. 36) of the opening 12*a*1 to the other longitudinal end (left end in FIG. 36) and is bent at the other end and further extends along a gripper portion 14*f* formed on the upper frame 14 and protrudes therefrom outwardly.

Figure 37:
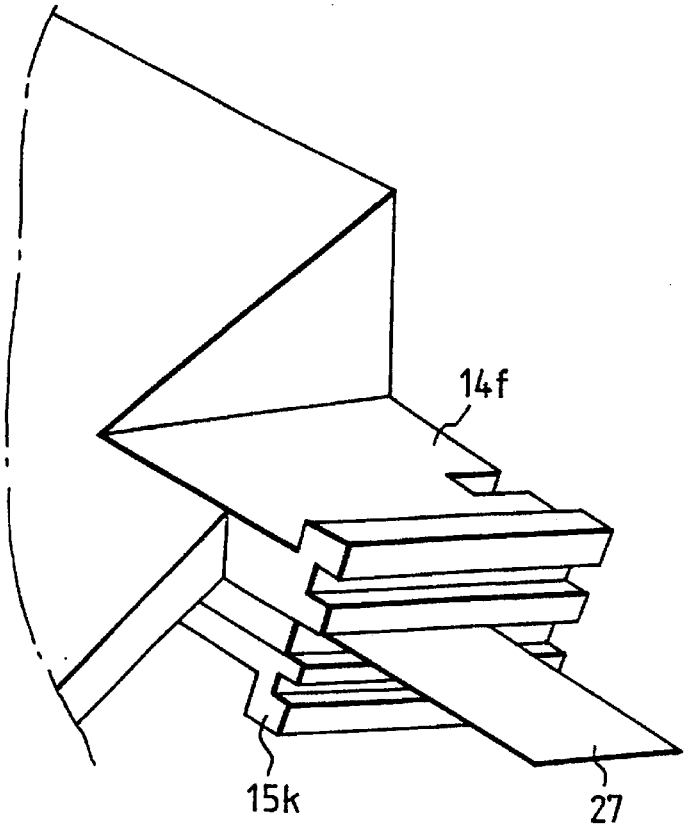
FIG. 37 is a perspective view showing a condition where the tear tape is protruded from a gripper.

Next, the process cartridge B is assembled by interconnecting the upper and lower frames 14, 15 via the above-mentioned locking pawls and locking openings or recesses. In this case, as shown in FIG. 37, the tear tape 27 is exposed between the gripper portion 14*f* of the upper frame 14 and a gripper portion 15*k* of the lower frame 15. Therefore, when a new process cartridge B is used, the operator pulls a protruded portion of the tear tape 27 exposed between the gripper portions 14*f*, 15*k* to peel the tear tape 27 from the cover film 28 so as to open the opening 12*a*1, thus permitting the movement of the toner in the toner reservoir 12*a* toward the developing sleeve 12*d*. Thereafter, the process cartridge is mounted within the image forming system A.

As mentioned above, by exposing the tear tape 27 between the gripper portions 14*f*, 15*k* of the upper and lower frames 14, 15, the tear tape 27 can easily be exposed from the process cartridge in assembling the upper and lower frames 14, 15. The gripper portions 14*f*, 15*k* are utilized when the process cartridge B is mounted within the image forming system. Thus, if the operator forgets to remove the tear tape 27 before the process cartridge is mounted within the image forming system, since he must grip the gripper portions in mounting the process cartridge, he will know the existence of the non-removed tear tape 27. Further, when the color of the tear tape 27 is clearly differentiated from the color of the frames 14, 15 (for example, if the frames are black, a white or yellow tear tape 27 is used), the noticeability is improved, thus reducing the missing of the removal of the tear tape.

Figure 38:
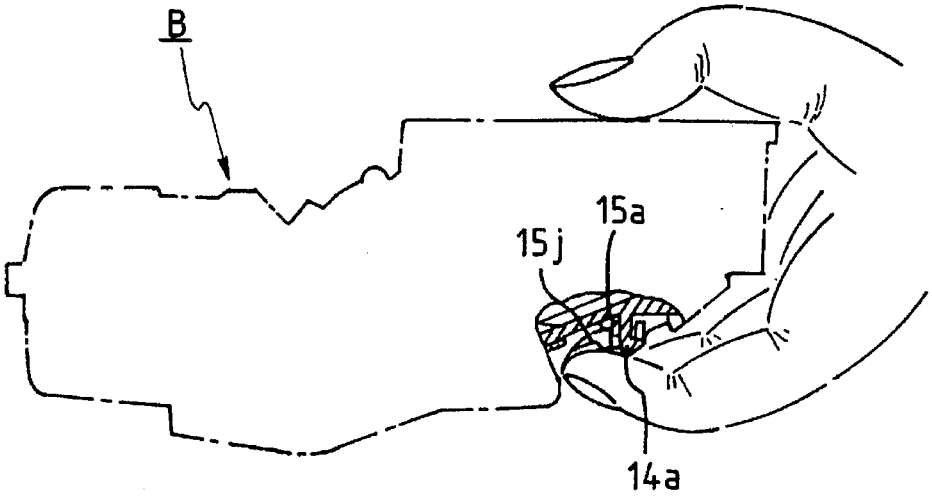
FIG. 38 is a schematic view showing a condition where the process cartridge is gripped by an operator's hand.

Further, for example, when a U-shaped guide rib for temporarily holding the tear tape 27 is provided on the gripper portion 14*f* of the upper frame 14, it is possible to surely and easily expose the tear tape 27 at a predetermined position during the interconnection between the upper and lower frames 14, 15. Incidentally, when the process cartridge B is assembled by interconnecting the upper and lower frames 14, 15, since the recess 15*j* for receiving the register roller 5*c*2 is formed in the outer surface of the lower frame 15, as shown in FIG. 38, the operator can surely grip the process cartridge B by inserting his fingers into the recess 15*j*. Further, in the illustrated embodiment, as shown in FIG. 6, slip preventing ribs 14*i* are formed on the process cartridge B so that the operator can easily grip the process cartridge by hooking his fingers against the ribs. Incidentally, since the recess for receiving (preventing the contact with) the resister roller 5*c*2 is formed in the lower frame 15 of the process cartridge B, it is possible to make the image forming system smaller in size.

Further, as shown in FIG. 6 since the recess 15*j* is formed along and in the vicinity of the locking pawls 14*a* and the locking openings 15*b* through which the upper and lower frames 14, 15 are interconnected, when the operator grips the process cartridge B by hooking his fingers against the recess 15*j*, the gripping force from the operator acts toward the locking direction, thus surely interlocking the locking pawls 14*a* and the locking openings 15*b*.

Figure 39A:
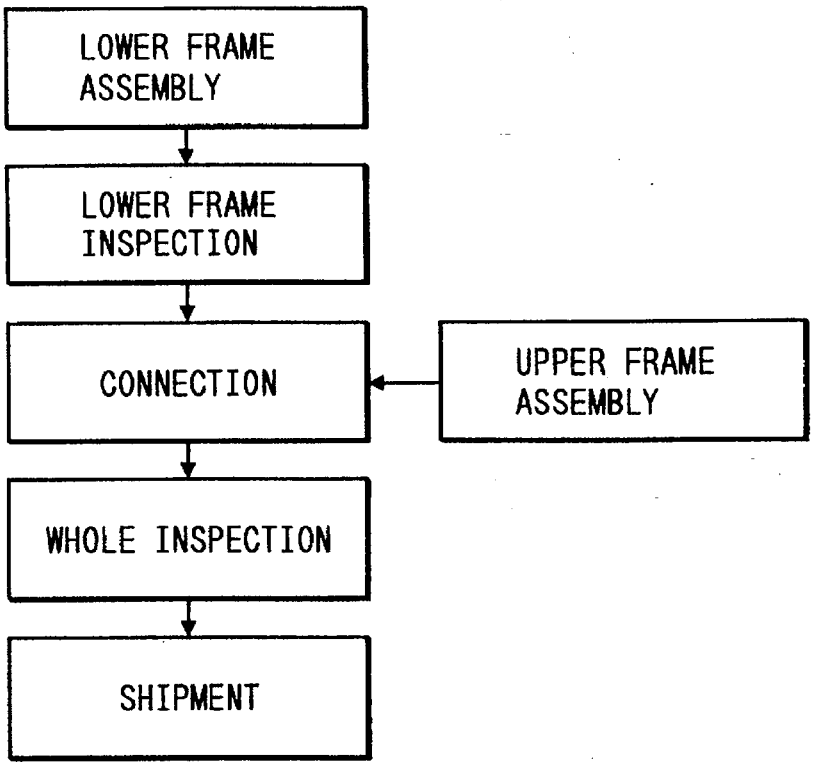
FIG. 39A is a flow chart showing the assembling and shipping line for the process cartridge.

Now, the assembling and shipping line for the process cartridge B will be explained with reference to FIG. 39A. As shown, the various parts are assembled in the lower frame 15, and then, the lower frame, into which the various parts are incorporated, is checked (for example, the positional relation between the photosensitive drum 9 and the developing sleeve 12*d* is checked). Then, the lower frame 15 is interconnected to the upper frame 14 within which the parts such as the charger roller 10 are assembled, thereby forming the process cartridge B. Thereafter, the total check of the process cartridge B is effected, and then the process cartridge is shipped. Thus, the assembling and shipping line is very simple.

(Mounting of Cartridge)

Next, the construction for mounting the process cartridge B within the image forming system A will be explained.

Figure 40:
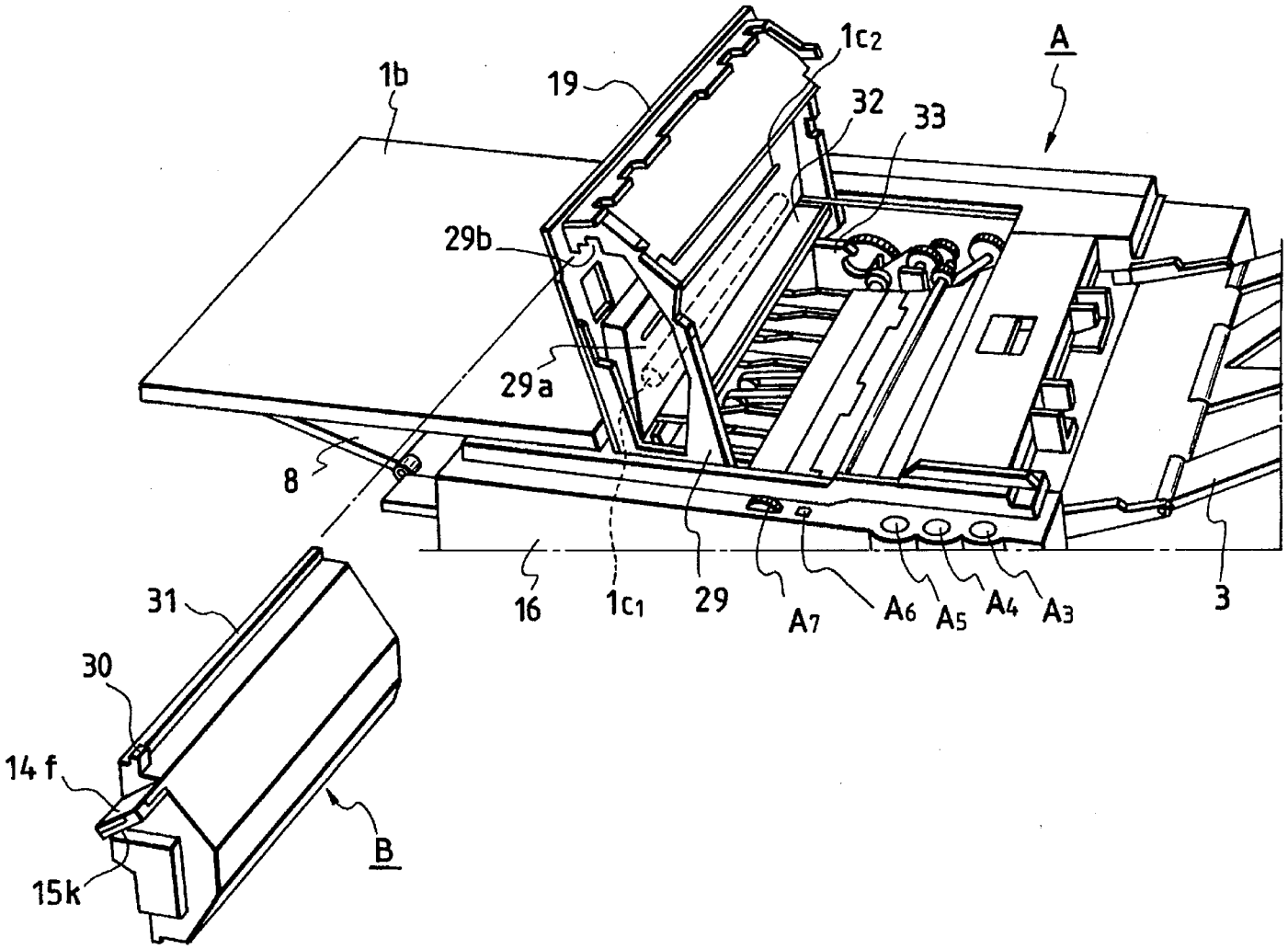
FIG. 40 is a perspective view showing a condition where the process cartridge is being mounted within the image forming apparatus or system.

As shown in FIG. 40, a loading member 29 having a fitting window 29*a* matched to the contour of the process cartridge B is provided on the upper opening/closing cover 19 of the image forming system A. The process cartridge B is inserted into the image forming system through the fitting window 29*a* by gripping the gripper portions 14*f*, 15*k*. In this case, a guide ridge 31 formed on the process cartridge B is guided by a guide groove (not numbered) formed in the cover 19 and the lower portion of the process cartridge is guided a guide plate 32 having a hook at its free end.

Figure 41:
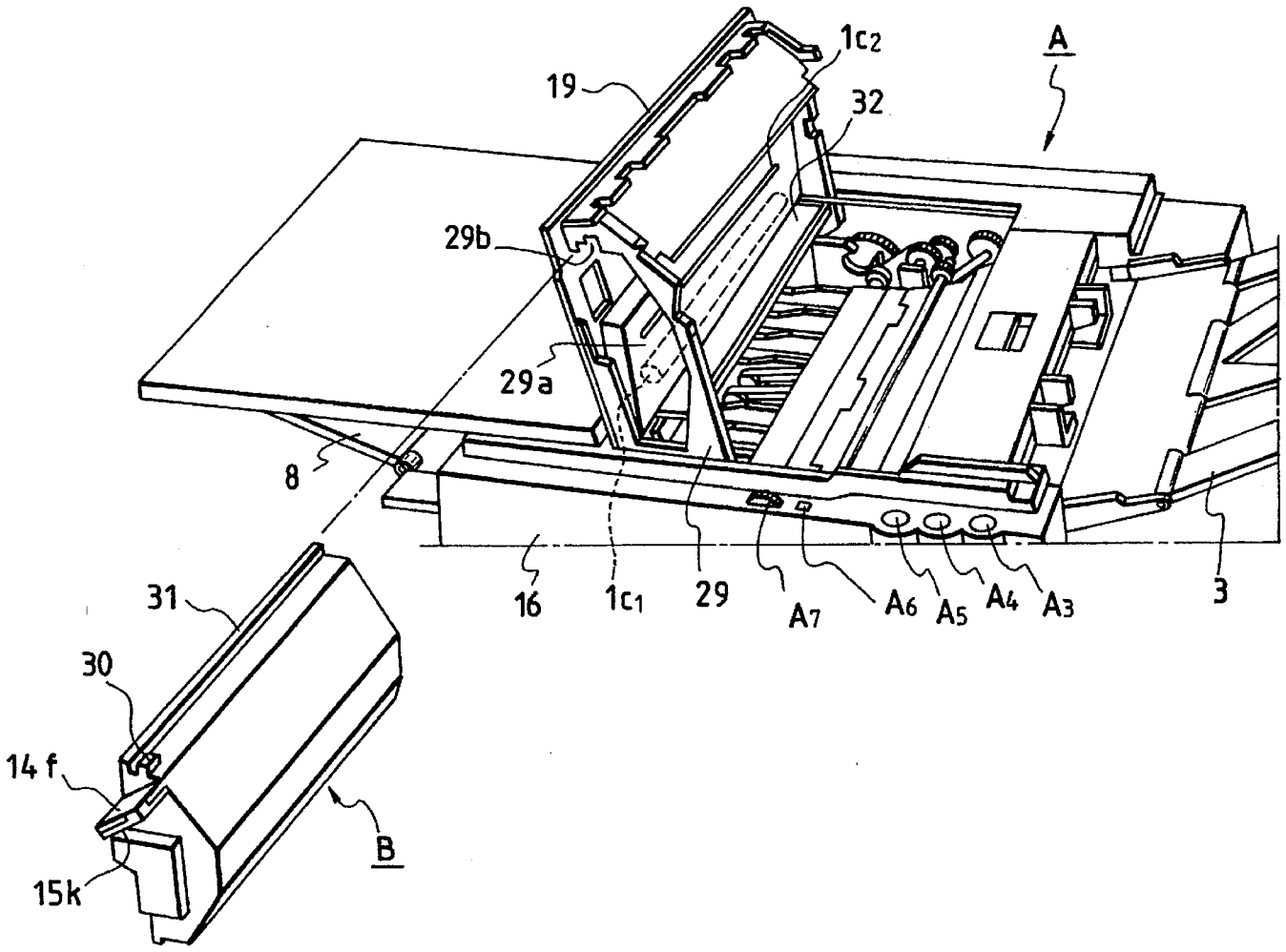
FIG. 41 is a perspective view showing a condition where the process cartridge of FIG. 24 is being mounted within the image forming system.

Incidentally, as shown in FIG. 40, a miss-mount preventing projection 30 is formed on the process cartridge B and the fitting window 29*a* has a recess 29*b* for receiving the projection 30. As shown in FIGS. 40 and 41, the configuration or position of the projection 30 is differentiated depending upon a particular process cartridge containing the toner having the developing sensitivity suitable to a particular image forming system A (i.e. differentiated for each process cartridge), so that, even when an attempt to mount a process cartridge containing the toner having the different developing sensitivity is tried within the particular image forming system, since the projection 30 does not match with the fitting window 29*a* of that image forming system, it cannot be mounted within that image forming system. Accordingly, the miss-mounting of the process cartridge B can be prevented, thus preventing the formation of the obscure image due to the different developing sensitive toner. Incidentally, it is also possible to prevent the miss-mounting of a process cartridge which includes a different kind of photosensitive drum, as well as a different developing sensitivity. Further, since the recess 29*b* and the projection 30 are situated this side when the process cartridge is mounted, if the operator tries to erroneously mount the process cartridge within the image forming system, he can easily ascertain with his eyes the fact that the projection 30 is blocked by the filling member 29. Thus, the possibility that the operator can forcibly push the process cartridge into the image forming system to damage the process cartridge B and/or the image forming system A as in the conventional case can be avoided.

After the process cartridge B is inserted into the fitting window 29*a* of the opening/closing cover 19, when the cover 19 is closed, the rotary shaft 9*f* of the photosensitive drum 9 which is protruded from one side of the upper and lower frames 14, 15, is supported by a shaft support member 33 (FIG. 40) via a bearing 46*a*, and the rotary shaft 12*d*2, of the developing sleeve 12*d* which is protruded from one side of the upper and lower frames 14, 15, is supported by the shaft support member 33 via a slide bearing 46*b* and a bearing 46c (FIG. 35 ). On the other hand, the drum shaft portion 26d (FIG. 35) of the bearing member 26 attached to the other end of the photosensitive drum 9 is supported by a shaft support member 34 shown in FIG. 42.

In this case, the protection cover 22 is rotated to expose the photosensitive drum 9, with the result that the photosensitive drum 9 is contacted with the transfer roller 6 of the image forming system A. Further, the drum ground contact 18a contacting the photosensitive drum 9, the developing bias contact 18b contacting the developing sleeve 12d and the charging bias contact 18c contacting the charger roller 10 are provided on the process cartridge B so that these contacts protrude from the lower surface of the lower frame 15, and these contacts 18a, 18b, 18c are urgingly contacted with the drum ground contact pin 35a, developing bias contact pin 35b and charging bias contact pin 35c (FIG. 42), respectively.

Figure 42:
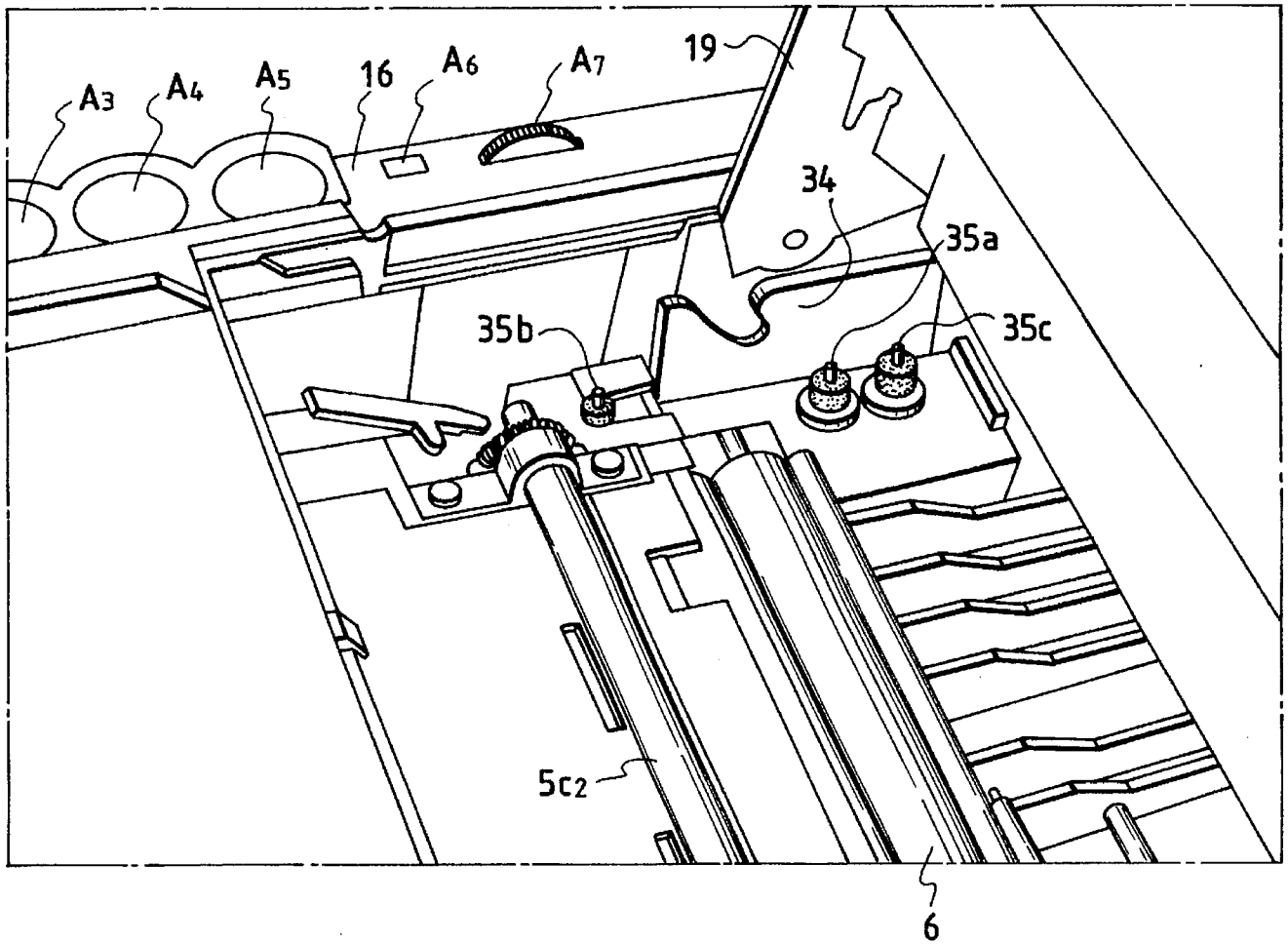
FIG. 42 is a perspective view showing the arrangement of three contacts provided on the image forming system.
Figure 43:
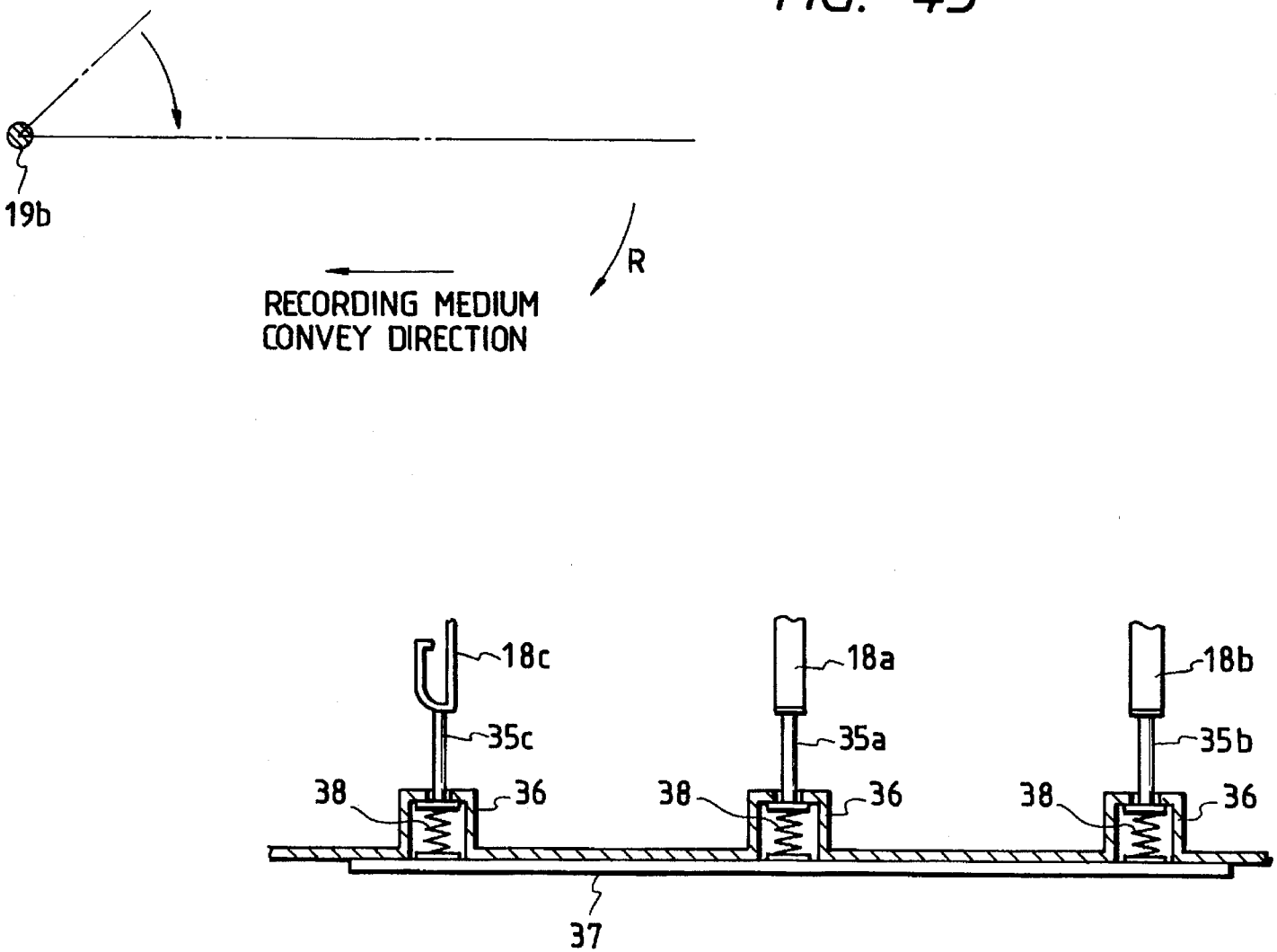
FIG. 43 is a sectional view showing the construction of the three contacts.

As shown in FIG. 42, these contact pins 35a, 35b, 35c are arranged so that the drum ground contact pin 35a and the charging bias contact pin 35c are disposed at a downstream side of the transfer roller 6 in the recording medium feeding direction and the developing bias contact pin 35a is disposed at an upstream side of the transfer roller 6 in the recording medium feeding direction. Accordingly, as shown in FIG. 43, the contacts 18a, 18b, 18c, provided on the process cartridge B, are similarly arranged so that the drum earthing contact 18a and the charging bias contact 18c are disposed at a downstream side of the photosensitive drum 9 in the recording medium feeding direction and the developing bias contact 18b is disposed at an upstream side of the photosensitive drum 9 in the recording medium feeding direction.

Now, the disposition of the electric contacts of the process cartridge B will be explained with reference to FIG. 51. Incidentally, FIG. 51 is a schematic plan view showing the positional relation between the photosensitive drum 9 and the electric contacts 18a, 18b, 18c.

Figure 51:
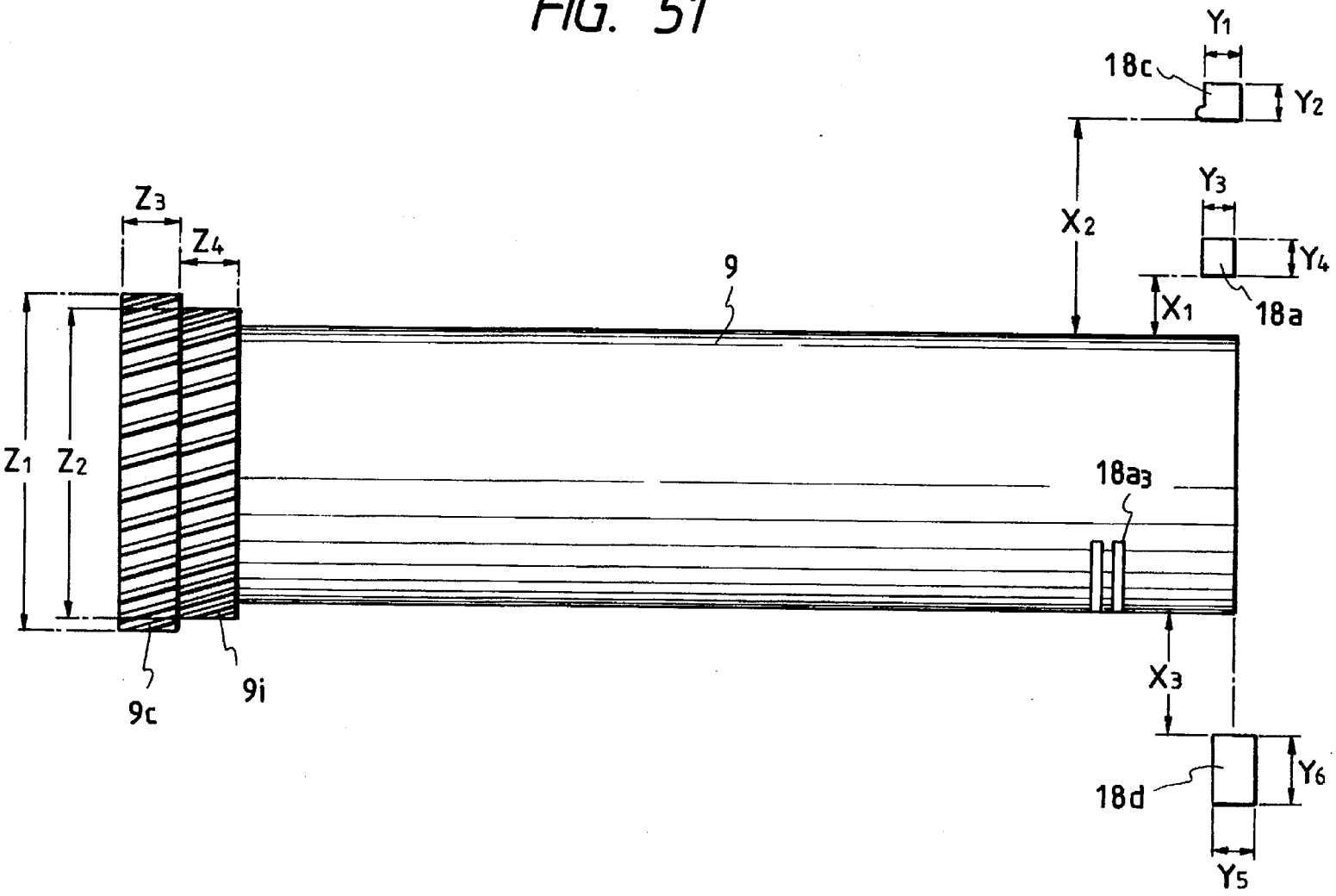
FIG. 51 is a view showing gears and contacts attached to the photosensitive drum.

As shown in FIG. 51, the contacts 18a, 18b, 18c are disposed at the end of the photosensitive drum 9 opposite to the end where the flange gear 9c is arranged in the longitudinal direction of the drum. The developing bias contact 18b is disposed at one side of the photosensitive drum 9 (i.e. side where the developing means 12 is arranged), and the drum ground contact 18a and the charging bias contact 18c are disposed at the other side of the photosensitive drum (where the cleaning means 13 is arranged). The drum ground contact 18a and the charging bias contact 18c are substantially arranged on a straight line. Further, the developing bias contact 18b is arranged slightly outwardly of the positions of the drum ground contact 18a and the charging bias contact 18c in the longitudinal direction of the photosensitive drum 9. The drum ground contact 18a, the developing bias contact 18b and the charging bias contact 18c are spaced apart from the outer peripheral surface of the photosensitive drum 9 gradually in order (i.e. a distance between the contact 18a and the drum is smallest, and a distance between the contact 18c and the drum is greatest). Further, an area of the developing bias contact 18b is greater than an area of the drum ground contact 18a and an area of the charging bias contact 18c. Furthermore, the developing bias contact 18b, the drum ground contact 18a and the charging bias contact 18c are disposed outwardly of a position where the arm portions 18a3 of the drum ground contact 18a are contacted with the inner surface of the photosensitive drum 9, in the longitudinal direction of the photosensitive drum 9.

As mentioned above, by arranging the electric contacts between the process cartridge (which can be mounted within the image forming system) and the image forming system at the positioning and abutting side of the process cartridge, it is possible to improve the positional accuracy between the contacts of the process cartridge and the contact pins of the image forming system, thereby preventing the poor electrical connection, and, by arranging the contacts at the non-driving side of the process cartridge, it is possible to make the configurations of the contact pins of the image forming system simple and small-sized.

Further, since the contacts of the process cartridge are disposed inside of the contour of the frames of the process cartridge, it is possible to prevent foreign matter from adhering to the contacts, and, thus, to prevent the corrosion of the contacts; and, further to prevent the deformation of the contacts due to an external force. Further, since the developing bias contact 18b is arranged at the side of the developing means 12 and the drum ground contact 18a and the charging bias contact 18c are arranged at the side of the cleaning means 13, the arrangement of electrodes in the process cartridge can be simplified, thus making the process cartridge small-sized.

Now, dimensions of various parts in the illustrated embodiment will be listed up herein below. However, it should be noted that these dimensions are merely an example, and the present invention is not limited to this example:

(1) Distance (X1) between the photosensitive drum 9 and the drum ground contact 18a about 6.0 mm;

(2) Distance (X2) between the photosensitive drum 9 and the charging bias contact 18c about 18.9 mm;

(3) Distance (X3) between the photosensitive drum 9 and the developing bias contact 18b about 13.5 mm;

(4) Width (Y1) of the charging bias contact 18c about 4.9 mm;

(5) Length (Y2) of the charging bias contact 18c about 6.5 mm;

(6) Width (Y3) of the drum ground contact 18a about 5.2 mm;

(7) Length (Y4) of the drum ground contact 18a about 5.0 mm;

(8) Width (Y5) of the developing bias contact 18a about 7.2 mm;

(9) Length (Y6) of the developing bias contact 18a about 8.0 mm

(10) Diameter (Z1) of the flange gear 9c about 28.6 mm;

(11) Diameter (Z2) of the gear 9i about 26.1 mm;

(12) Width (Z3) of the flange gear 9c about 6.7 mm;

(13) Width (Z3) of the gear 9i about 4.3 mm;

(14) Number of teeth of the flange gear 9c 33; and

(15) Number of teeth of the gear 9i 30.

Now, the flange gear 9c and the gear 9i will be explained. The gears 9c, 9i comprise helical gears. When the driving force is transmitted from the image forming system to the flange gear 9c, the photosensitive drum 9 mounted in the lower frame 15 with play is subjected to the thrust force to be shifted toward the flange gear 9c, thereby positioning the drum at the side of the lower frame 15.

The gear 9c is used with a process cartridge containing the magnetic toner for forming a black image. When the black image forming cartridge is mounted within the image forming system, the gear 9c is meshed with a gear of the image forming system to receive the driving force for rotating the photosensitive drum 9 and is meshed with a gear of the developing sleeve 12d to rotate the latter. The gear 9i is meshed with a gear connected to the transfer roller 6 of the image forming system to rotate the transfer roller. In this case, the rotational load does not almost act on the transfer roller 6.

Incidentally, the gear 9*i* is used with a color image forming cartridge containing the non-magnetic toner. When the color image forming cartridge is mounted within the image forming system, the gear 9*c* is meshed with the gear of the image forming system to receive the driving force for rotating the photosensitive drum 9. On the other hand, the gear 9*i* is meshed with the gear connected to the transfer roller 6 of the image forming-system to rotate the transfer roller and is meshed with the gear of the developing sleeve 12*d* for the non-magnetic toner to rotate the latter. The flange gear 9*c* has a diameter greater than that of the gear 9*i*, a width greater than that of the gear 9*i* and a number of teeth greater than that of the gear 9*i*. Thus, even when the greater load is applied to the gear 9*c*, the gear 9*c* can receive the driving force to rotate the photosensitive drum 9 more surely, and can transmit the greater driving force to the developing sleeve 12*d* for the magnetic toner to rotate the latter more surely.

Incidentally, as shown in FIG. 43, each of the contact pins 35*a*–35*c* is held in a corresponding holder cover 36 in such a manner that it can be shifted in the holder cover but cannot be detached from the holder cover. Each contact pin 35*a*–35*c* is electrically connected to a wiring pattern printed on an electric substrate 37 to which the holder covers 36 are attached, via a corresponding conductive compression spring 38. Incidentally, the charging bias contact 18*c*, to be abutted against the contact pin 35*c*, has an arcuate curvature in the vicinity of the pivot axis 19*b* of the upper opening/closing cover 19 so that, the opening/closing cover 19 mounting the process cartridge B thereon is rotated around the pivot axis 19*b* in a direction shown by the arrow R to close the cover, the charging bias contact. 18*c* nearest to the pivot axis 19*b* (i.e. having the minimum stroke) can contact with the contact pin 35*c* effectively.

(Positioning)

When the process cartridge B is mounted and the opening/closing cover 19 is closed, the positioning is established so that a distance between the photosensitive drum 9 and the lens unit 1*c* and a distance between the photosensitive drum 9 and the original glass support 1*a* are kept constant. Such positioning will now be explained.

As shown in FIG. 8, positioning projections 15*m* are formed on the lower frame 15 to which the photosensitive drum 9 is attached, in the vicinity of both longitudinal ends of the frame. As shown in FIG. 5, when the upper and lower frames 14, 15 are interconnected, these projections 15*m* protrude upwardly through holes 14*g* formed in the upper frame 14.

Figure 44:
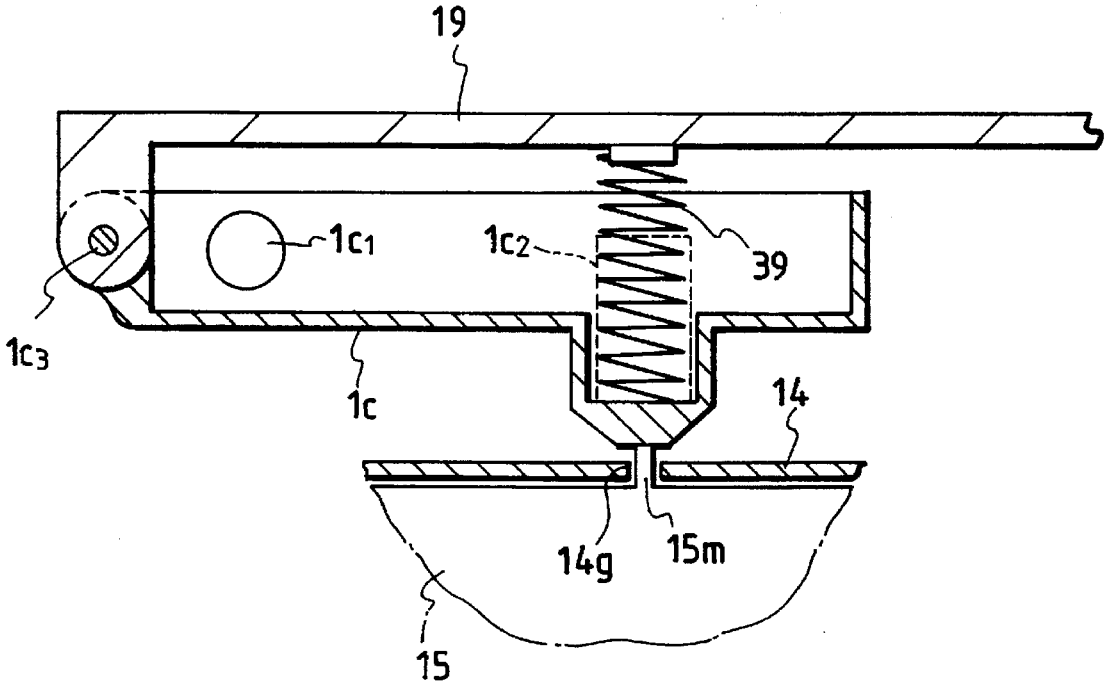
FIG. 44 is a sectional view for explaining the positioning of the relative position between the lower frame and a lens unit.

Further, as shown in FIG. 44, the lens unit 1*c* containing therein the lens array 1*c*2 for reading the original 2 is attached to the upper opening/closing cover 19 (on which the process cartridge B is mounted) via a pivot pin 1*c*3 for slight pivotal movement around the pivot pin and is biased downwardly (FIG. 44) by an urging spring 39. Thus, when the process cartridge B is mounted on the upper cover 19 and the latter is closed, as shown in FIG. 44, the lower surface of the lens unit 1*c*, is abutted against the positioning projections 15*m* of the process cartridge B. As a result, when the process cartridge B is mounted within the image forming system A, the distance between the lens array 1*c*2 , in the lens unit 1*c*, and the photosensitive drum 9, mounted on the lower frame 15, is accurately determined, so that the light image optically read from the original 2 can be accurately illuminated onto the photosensitive drum 9 via the lens array 1*c*2.

Figure 45:
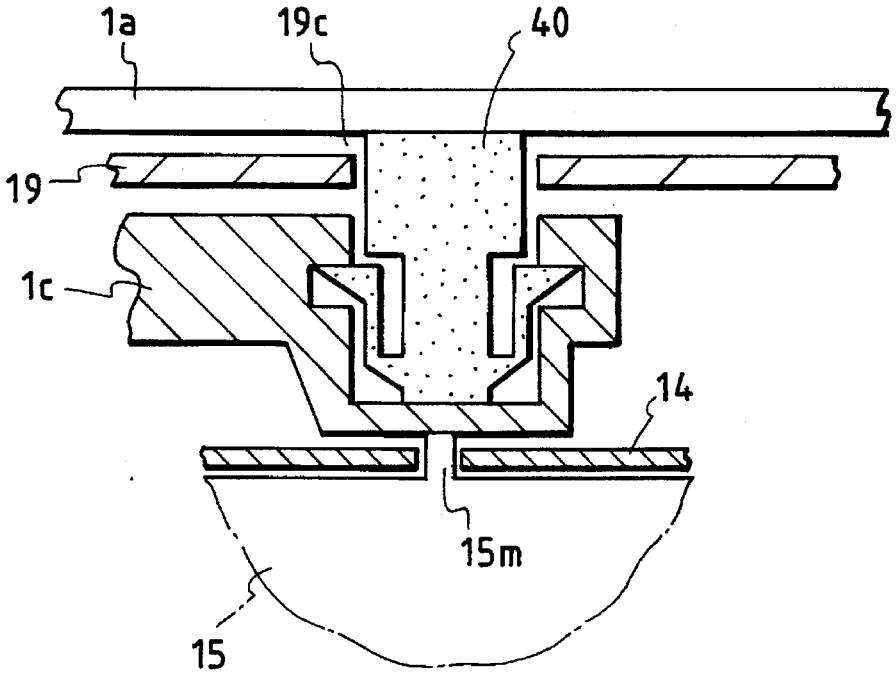
FIG. 45 is a sectional view for explaining the positioning of the relative position between the lower frame and an original glass support.
Figure 46:
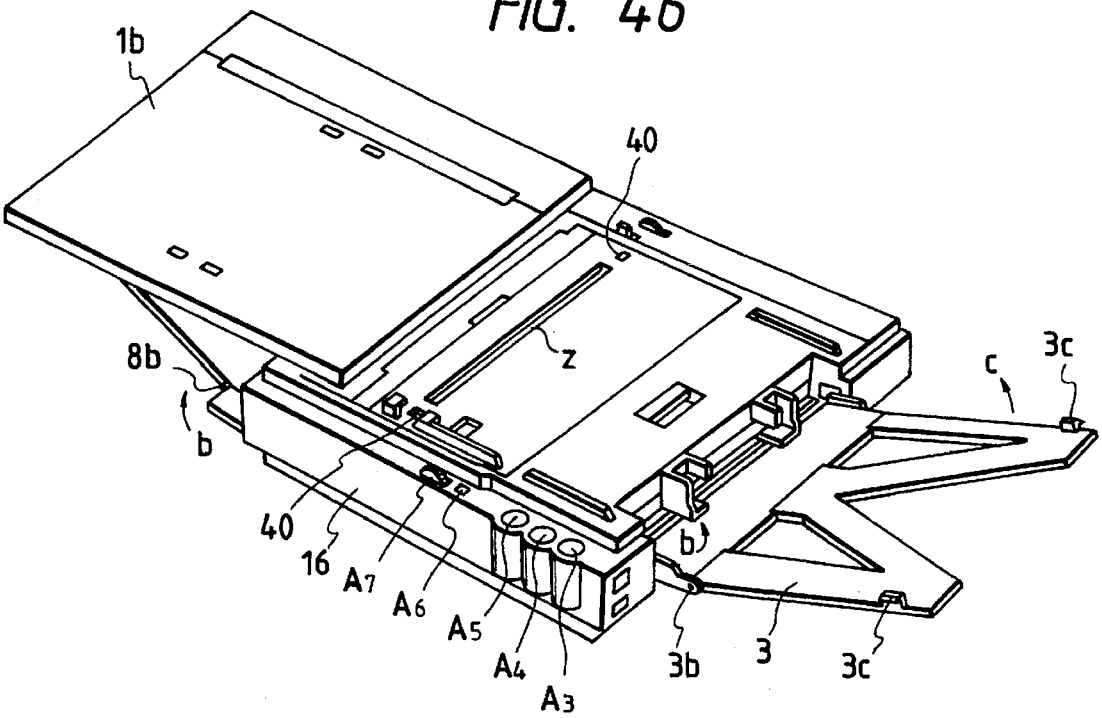
FIG. 46 is a perspective view showing the attachment positions of positioning pegs.

Further, as shown in FIG. 45, positioning pegs 40 are provided in the lens unit 1*c*, which positioning pegs can be protruded slightly from the upper cover 19 upwardly through holes 19*c* formed in the upper cover. As shown in FIG. 46, the positioning pegs 40 are protruded slightly at both longitudinal sides of an original reading slit Z (FIGS. 1 and 46). Thus, when the process cartridge B is mounted on the upper cover 19 and the latter is closed and then the image forming operation is started, as mentioned above, since the lower surface of the lens unit 1*c* is abutted against the positioning projections 15*m*, the original glass support 1*a* is shifted while riding on the positioning pegs 40. As a result, a distance between the original 2, disposed or rested on the original glass support 1*a*, and the photosensitive drum 9 mounted on the lower frame 15 is always kept constant, thus accurately illuminating system and a removable process cartridge therefor the light reflected from the original 2. Therefore, since the information written on the original 2 can be optically read accurately and the exposure to the photosensitive drum 9 can be effected accurately, it is possible to obtain the high quality image.

(Drive Transmission)

Next, the driving force transmission to the photosensitive, drum 9, in the process cartridge B, mounted within the image forming system A will be explained.

Figure 47:
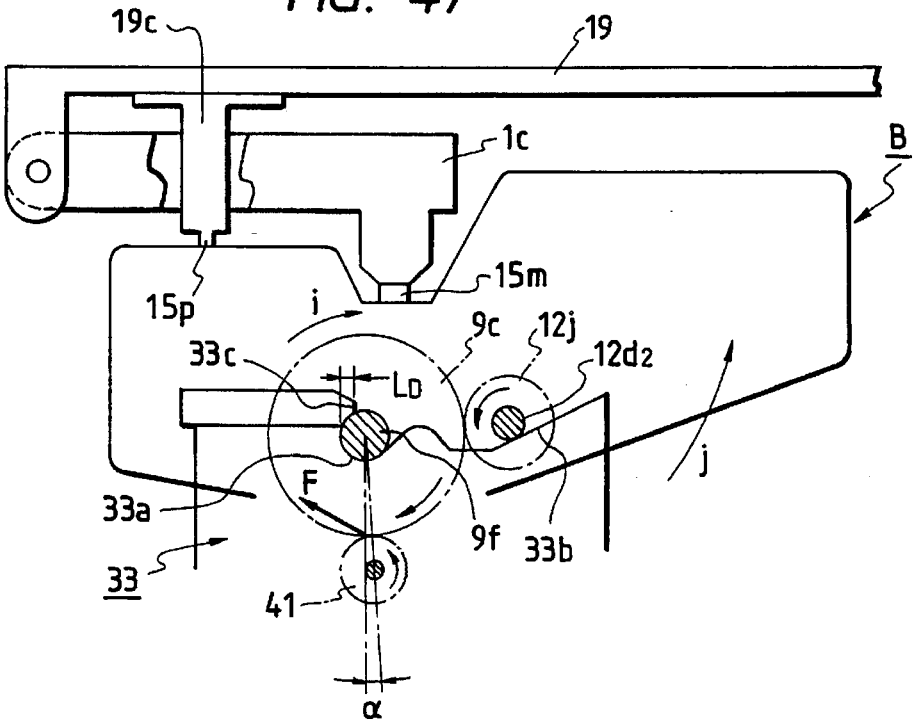
FIG. 47 is a schematic elevational view showing the relation between rotary shafts of the drum and of the sleeve and shaft supporting members therefor, and a transmitting direction of a driving force from a drive gear to a flange gear of the photosensitive drum.

When the process cartridge B is mounted within the image forming system A, the rotary shaft 9*f* of the photosensitive drum 9 is supported by the shaft support member 33 of the image forming system as mentioned above. As shown in FIG. 47, the shaft support member 33 comprises a supporting portion 33*a* for the drum rotary shaft 9*f*, and an abutment portion 33*b* for the rotary shaft 12*d*2 of the developing sleeve 12*d*. An overlap portion 33*c* having a predetermined overhanging amount L (1.8 mm in the illustrated embodiment) is formed on the supporting portion 33*a*, thus preventing the drum rotary shaft 9*f* from floating upwardly. Further, when the drum rotary shaft 9*f* is supported by the supporting portion 33*a*, the rotary shaft 12*d*2 of the developing sleeve is abutted against the abutment portion 33*b*, thus preventing the rotary shaft 12*d*2 from dropping downwardly. Further, when the upper opening/closing cover 19 is closed, positioning projections 15*p* of the lower frame 15, protruding from the upper frame 14 of the process cartridge B, are abutted against an abutment portion 19*c* of the opening/closing cover 19.

Accordingly, when the driving force is transmitted to the flange gear 9*c* of the photosensitive drum 9 by driving the drive gear 41 of the image forming system meshed with the flange gear, the process cartridge B is subjected to a reaction force tending to rotate the process cartridge around the drum rotary shaft 9*f* in a direction shown by the arrow i in FIG. 47. However, since the rotary shaft 12*d*2 of the developing sleeve is abutted against the abutment portion 33*b* and the positioning projections 15*p* of the lower frame 15 protruding from the upper frame 14 are abutted against the abutment portion 19*c* of the upper cover, the rotation of the process cartridge B is prevented.

As mentioned above, although the lower surface of the lower frame 15 acts as the guide for the recording medium 4, since the lower frame is positioned by abutting it against the body of the image forming system as mentioned above, the positional relation between the photosensitive drum 9, the transfer roller 6 and the guide portions 15*h*1, 15*h*2 for the recording medium 4 is maintained with high accuracy, thus performing the feeding of the recording medium and the image transfer with high accuracy.

During the driving force transmission, the developing sleeve 12*d* is biased downwardly not only by the rotational reaction force acting on the process cartridge B but also by a reaction force generated when the driving force is transmitted from the flange gear 9c to the sleeve gear 12j. In this case, if the rotary' shaft 12d2 of the developing sleeve is not abutted against the abutment portion 33b, the developing sleeve 12d will be always biased downwardly during the image forming operation. As a result, it is feared that the developing sleeve 12d is displaced downwardly and/or the lower frame 15 on which the developing sleeve 12d is mounted is deformed. However, in the illustrated embodiment, since the rotary shaft 12d2 of the developing sleeve is abutted against the abutment portion 33b without fail, the above-mentioned inconvenience does not occur.

Figure 48:
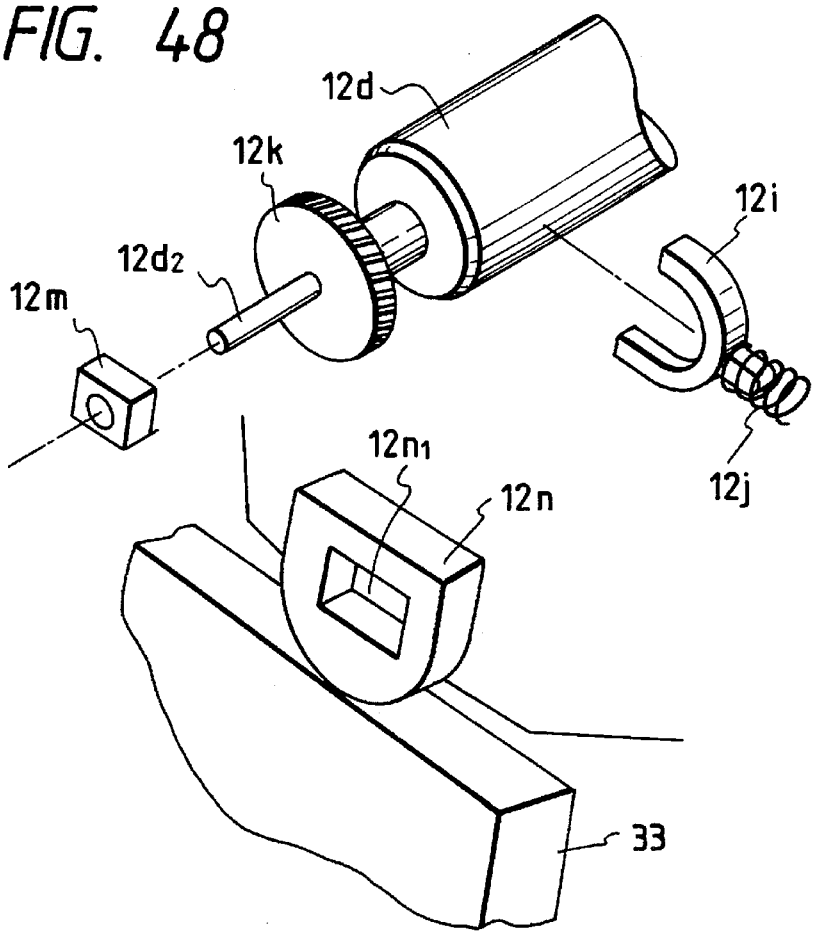
FIG. 48 is an exploded perspective view of a developing sleeve according to an embodiment wherein it can easily be slid.
Figure 49:
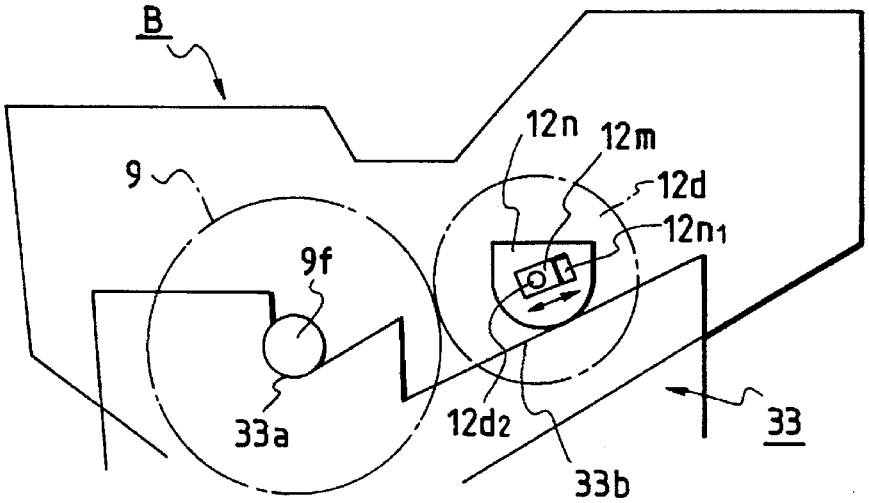
FIG. 49 is a schematic elevational view of the developing sleeve of FIG. 48.

Incidentally as shown in FIG. 20 the developing sleeve 12d is biased against the photosensitive drum 9 by the springs 12j via the sleeve bearings 12i. In this case, the arrangement as shown in FIG. 48 may be adopted to facilitate the sliding movement of sleeve bearings 12i. That is to say, a bearing 12m for supporting the rotary shaft 12d2 of the developing sleeve is held in a bearing holder 12n, such a manner that the bearing 12m can slide along a slot 12n1 formed in the bearing holder. With this arrangement, as shown in FIG. 49, the bearing holder 12n is abutted against the abutment portion 33b of the shaft support member 33 and is supported thereby; in this condition, the bearing 12m can be slide along the slot 12n1 in directions shown by the arrow. Incidentally, in the illustrated embodiment, an inclined angle θ (FIG. 47) of the abutment portion 33b is selected to have a value of about 40 degrees.

Figure 52A:
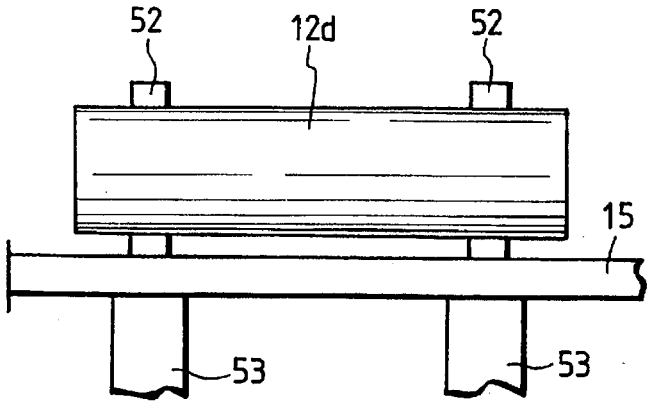
FIG. 52A is an elevational view a developing sleeve receiving member according to another embodiment.
Figure 52B:
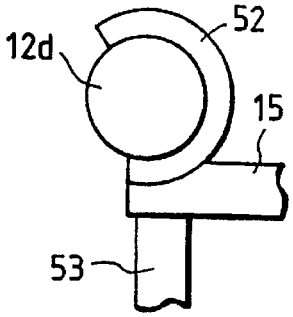
FIG. 52B is an end view of the receiving member of FIG. 52A.

Further, the developing sleeve 12d may be supported, not via the sleeve rotary shaft. For example, as shown in FIGS. 52A and 52B, it may be supported at both its end portions by sleeve bearings 52, the lower ends of which are supported by the lower frame 15 which is in turn supported by receiving portions 53 formed on the image forming system.

Further, in the illustrated embodiment, the flange gear 9c of the photosensitive drum 9 is meshed with the drive gear 41 for transmitting the driving force to the flange gear in such a manner that, as shown in FIG. 47, a line connecting a rotational center of the flange gear 9c and a rotational center of the drive gear 41 is offset from a vertical line passing through the rotational center of the flange gear 9c in a counter-clockwise direction by a small angle α (about 1° in the illustrated embodiment), whereby a direction F of the driving force transmission from the drive gear 41 to the flange gear 9c directs upwardly. In general, although the floating of the process cartridge can be prevented by a downwardly directing force generated by setting the angle α to a value of 20° or more, in the illustrated embodiment, such angle α is set to about 1°.

By setting the above-mentioned angle α to about 1°, when the upper opening/closing cover 19 is opened in a direction shown by the arrow j to remove the process cartridge B, the flange gear 9c is not blocked by the drive gear 41 and, thus, can be smoothly disengaged from the drive gear 41. Further, when the direction F of the driving force transmission is directed upwardly as mentioned above, the rotary shaft 9f of the photosensitive drum is pushed upwardly and, therefore, tends to be disengaged from the drum supporting portion 33a. However, in the illustrated embodiment, since the overlap portion 33c is formed on the supporting portion 33a, the drum rotary shaft 9f is not disengaged from the drum supporting portion 33a.

(Re-cycle)

The process cartridge having the above-mentioned construction permits the re-cycle. That is to say, the used-up process cartridge(s) can be collected from the market and the parts thereof can be re-used to form a new process cartridge. Such re-cycle will now be explained. Generally, the used-up process cartridge was disposed or dumped in the past. However, the process cartridge B, according to the illustrated embodiment, can be collected from the market after the toner in the toner reservoir has been used up, to protect the resources on the earth and the natural environment. Then, the collected process cartridge is disassembled into the upper and lower frames 14, 15 which are in turn cleaned. Thereafter, reusable parts and new parts are mounted on the upper frame 14 or the lower frame 15 at need, and then new toner is supplied into the toner reservoir 12a again. In this way, a new process cartridge is obtained.

Figure 50:
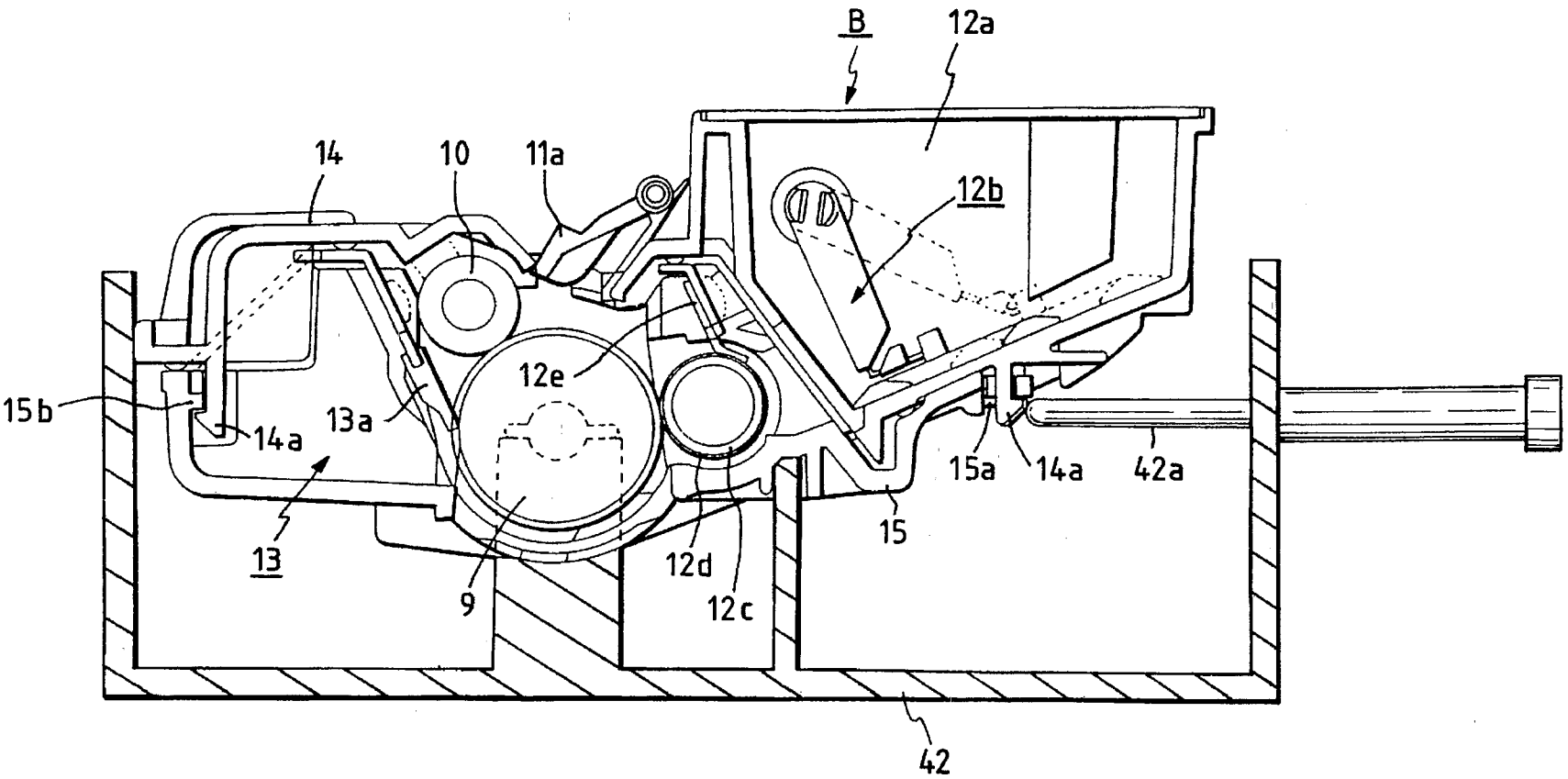
FIG. 50 is an elevational sectional view showing a condition where the upper frame and the lower frame are released.

More particularly,.by releasing the connections between the locking pawls 14a and the locking openings 15a, the locking pawls 14a and the locking projection 15b, the locking pawl 14c and the locking opening 15d, and the locking pawl 15c and the locking opening 14b (FIGS. 4, 8 and 9) which interconnect the upper and lower frames 14, 15, the upper and lower frames 14, 15 can easily be disassembled from each other. Such disassembling operation can easily be performed, for example, by resting the used-up process cartridge B on a disassembling tool 42 and by pushing the locking pawl 14a by means of a pusher rod 42a, as shown in FIG. 50. Even when the disassembling tool is not used, the process cartridge can be disassembled by pushing the locking pawls 14a, 14c, 15c.

After the upper frame 14 and the lower frame 15 are disconnected from each other as mentioned above (FIGS. 8 and 9), the frames are cleaned by removing the waste toner adhered to or remaining in the cartridge by an air blow technique. In this case, a relatively large amount of waste toner is adhered to the photosensitive drum 9, developing sleeve 12d and/or cleaning means 13 since they are directly contacted with the toner. On the other hand, the waste toner is not or almost not adhered to the charger roller 10 since it is not directly contacted with the toner. Accordingly, the charger roller 10 can be cleaned more easily than the photosensitive drum 9, developing sleeve 12d and the like. In this regard, according to the illustrated embodiment, since the charger roller 10 is mounted on the upper frame 14 other than the lower frame 15 on which the photosensitive drum 9, developing sleeve 12d and cleaning means 13 are mounted, the upper frame 14 separated from the lower frame 15 can easily be cleaned.

Figure 39B:
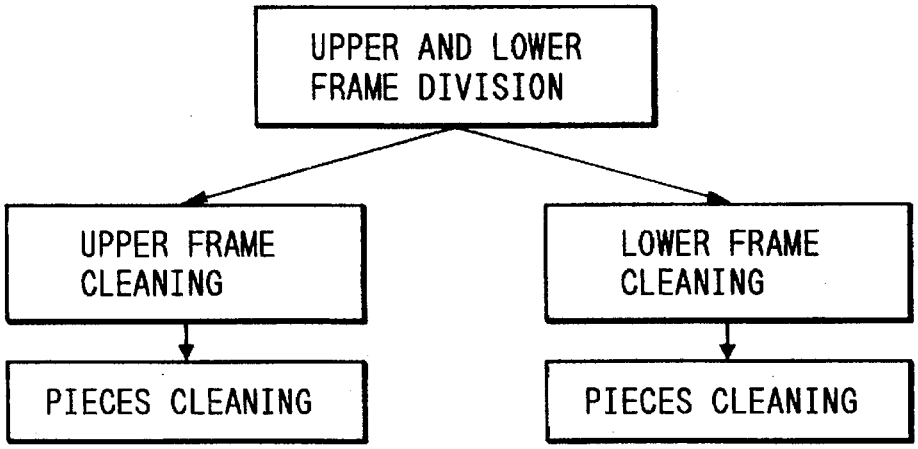
FIG. 39B is a flow chart showing the disassembling and cleaning line for the process cartridge.

In the disassembling and cleaning line as shown in FIG. 39B, first of all, the upper and lower frames 14, 15 are separated, from each other as mentioned above. Then the upper frame 14 and the lower frame 15 are disassembled and cleaned independently. Thereafter, as to the upper frame 14, the charger roller 10 is separated from the upper frame and is cleaned; and as to the lower frame 15, the photosensitive drum 9, developing sleeve 12d, developing blade 12e, cleaning blade 13a and the like are separated from the lower frame and are cleaned. Thus, the disassembling and cleaning line is very simple.

After the toner is cleared, as shown in FIG. 9, the opening 12a1 is sealed by a new cover film 28 again, and new toner is supplied into the toner reservoir 12a through the toner filling opening 12a3 formed in the side surface of the toner reservoir 12a, and then the filling opening 12a3 is closed by the lid 12a2. Then, the upper frame 14 and the lower frame 15 are interconnected again by achieving the connections between the locking pawls 14a and the locking openings 15a, the locking pawls 14a and the locking projection 15b, the locking pawl.14c and the locking opening 15d, and the locking pawl 15c and the locking opening 14b, thus assembling a process cartridge again in a usable condition.

Incidentally, when the upper and lower frames 14, 15 are interconnected, although the locking pawls 14*a* and the locking openings 15*a*, the locking pawls 14*a* and the locking projection 15*a* and the like are interlocked, when the same process cartridge is frequently re-cycled, it is feared that the locking forces between the locking pawls and the locking openings become weaker. To cope with this, in the illustrated embodiment, threaded holes are formed in the frames in the vicinity of four corners thereof. That is to say, through threaded holes are formed in the fitting recesses 14*d* and the fitting projections 14*e* of the upper frame 14 (FIG. 8) and in the fitting projections 15*e* (to be fitted into the recesses 14*d*) and the fitting recesses 15*f* (to be fitted onto the projections 14*e*) of the lower frame 15, respectively. Thus, even when the locking force due to the locking pawls become weaker, after the upper and lower frames 14, 15 are interconnected and the fitting projections and fitting recesses are interfitted, by screwing screws in the mated threaded holes, the upper and lower frames 14, 15 can be firmly interconnected.

Image forming Operation

Next, the image forming operation effected by the image forming system A, within which the process cartridge B is mounted, will be explained.

First of all, the original 2 is rested on the original glass support 1*a* shown in FIG. 1. Then, when the copy start button A3 is depressed, the light source 1*c*1 is turned ON and the original glass support 1*a* is reciprocally shifted on the image forming system in the left and right directions in FIG. 1 to read the information written on the original optically. On the other hand, in registration with the reading of the original, the sheet supply roller 5*a* and the pair of register rollers 5*c*1, 5*c*2 are rotated to feed the recording medium 4 to the image forming station. The photosensitive drum 9 is rotated in the direction d in FIG. 1 in registration of the feeding timing of the paired register rollers 5*c*1, 5*c*2, and is uniformly charged by the charger means 10. Then, the light image read by the reading means 1 is illuminated onto the photosensitive drum 9 via the exposure means 11, thereby forming the latent image on the photosensitive drum 9.

At the same time when the latent image is formed, the developing means 12 of the process cartridge B is activated to drive the toner feed mechanism 12*b*, thereby feeding out the toner from the toner reservoir 12*a* toward the developing sleeve 12*d* and forming the toner layer on the rotating developing sleeve 12*d*. Then, by applying to the developing sleeve 12*d* a voltage having the same charging polarity and same potential as that of the photosensitive drum 9, the latent image on the photosensitive drum 9 is visualized as the toner image. In the illustrated embodiment, the voltage of about 1.2 KWpp, 1590 Hz (rectangular wave) is applied to the developing sleeve 12*d*. The recording medium 4 is fed between the photosensitive drum 9 and the transfer roller 6. By applying to the transfer roller 6 a voltage having the polarity opposite to that of the toner, the toner image on the photosensitive drum 9 is transferred onto the recording medium 4. In the illustrated embodiment, the transfer roller 6 is made of foam EPDM having the volume resistance of about $10^9$ Ωcm and has an outer diameter of about 20 mm, and the voltage of −3.5 KV is applied to the transfer roller as the transfer voltage.

After the toner image was transferred to the recording medium, the photosensitive drum 9 continues to rotate in the direction d. Meanwhile, the residual toner remaining on the photosensitive drum 9 is removed by the cleaning blade 13*a*, and the removed toner is collected into the waste toner reservoir 13*c* via the squeegee sheet 13*b*. On the other hand, the recording medium 4 on which the toner image was transferred is sent, by the convey belt 5*d*, to the fixing means 7 where the toner image is permanently fixed to the recording medium 4 with heat and pressure. Then, the recording medium is ejected by the pair of ejector rollers 5*f*1, 5*f*2. In this way, the information on the original is recorded on the recording medium.

Next, other embodiments will be explained.

Figure 53:
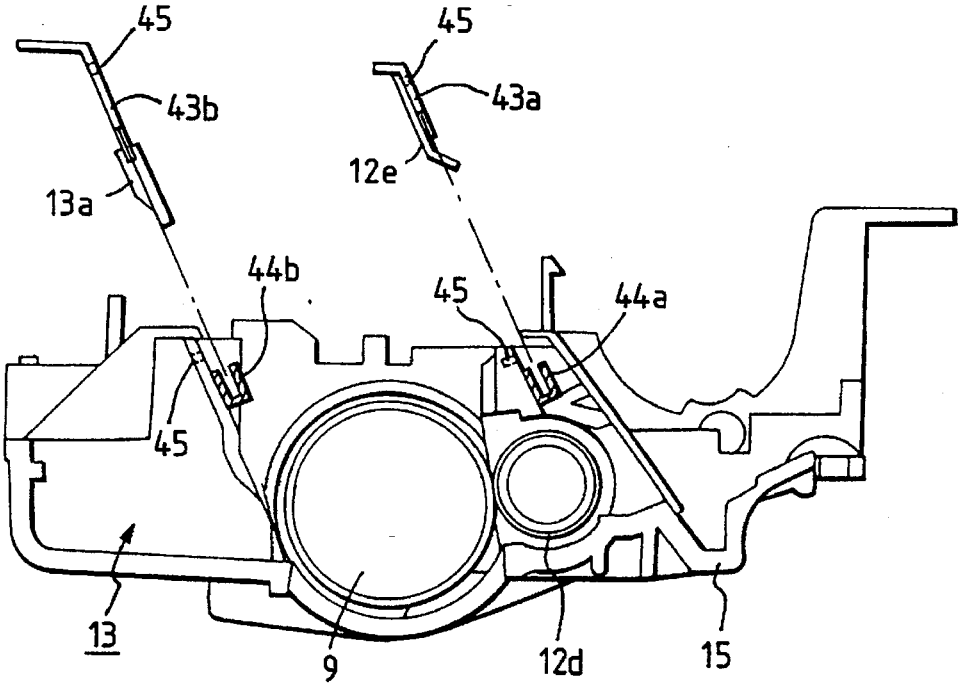
FIG. 53 is an elevational view showing an arrangement wherein the developing blade and the cleaning blade can be attached to the interior of the image forming system by pins.

In the above-mentioned first embodiment, while an example that the developing blade 12*e* and the cleaning blade 13*a* are attached to the frame by pins 24*a*, 24*b* was explained, as shown in FIG. 53, when the developing blade 12*e* and the cleaning blade 13*a* are attached to the lower frame 15 by forcibly inserting fitting projections 43*a*, 43*b* formed on both longitudinal ends of the developing blade 12*e* and the cleaning blade 13*e* into corresponding fitting recesses 44*a*, 44*b* formed in the body 16 of the image forming system, pin holes 45 for receiving the pins for attaching the blades 12*e*, 13*a* may be formed in the vicinity of the fitting projections 43*a*, 43*b*, and corresponding pin holes 45 may be formed in the body 16 of the image forming system (Incidentally, in place of the fitting projections 43*a*, 43*b*, half punches or circular bosses may be used).

With this arrangement, when the fitting connections between the blades 12*e*, 13*a* and the lower frame are loosened by the repeated re-cycle of the process cartridge B, the blades 12*e*, 13*a* can be firmly attached to the lower frame by pins.

Figure 54:
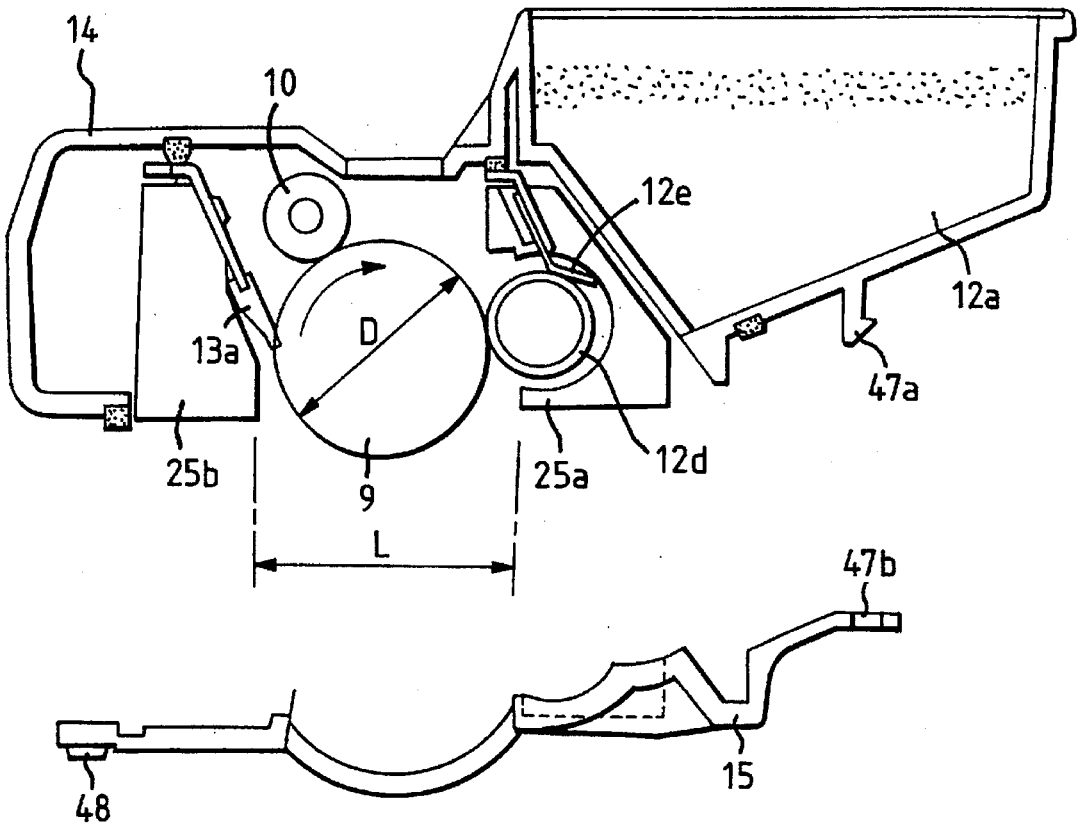
FIG. 54 an elevational view showing a condition that the photosensitive drum is being finally assembled, according to another embodiment.

Further, in the first embodiment, as shown in FIG. 29, while an example that the outer diameter D of the photosensitive drum 9 is smaller than the distance L between the drum guide members 25*a*, 25*b* to permit the final attachment of the photosensitive drum 9 to the lower frame 15 was explained, as shown in FIG. 54, even when the photosensitive drum 9 is incorporated into the upper frame 14, the outer diameter D of the photosensitive drum 9 may be smaller than the distance L between the drum guide members 25*a*, 25*a* so that the photosensitive drum can be lastly incorporated into the upper frame, thereby preventing the surface of the photosensitive drum 9 from damaging, as in the first embodiment. Incidentally, in FIG. 54, elements or parts having the same function as those in the first embodiment are designated by the same reference numerals. Further, the upper and lower frames 14, 15 are interconnected by interlocking locking projections 47*a* and locking openings 47*b* and by securing them by pins 48.

Figure 55:
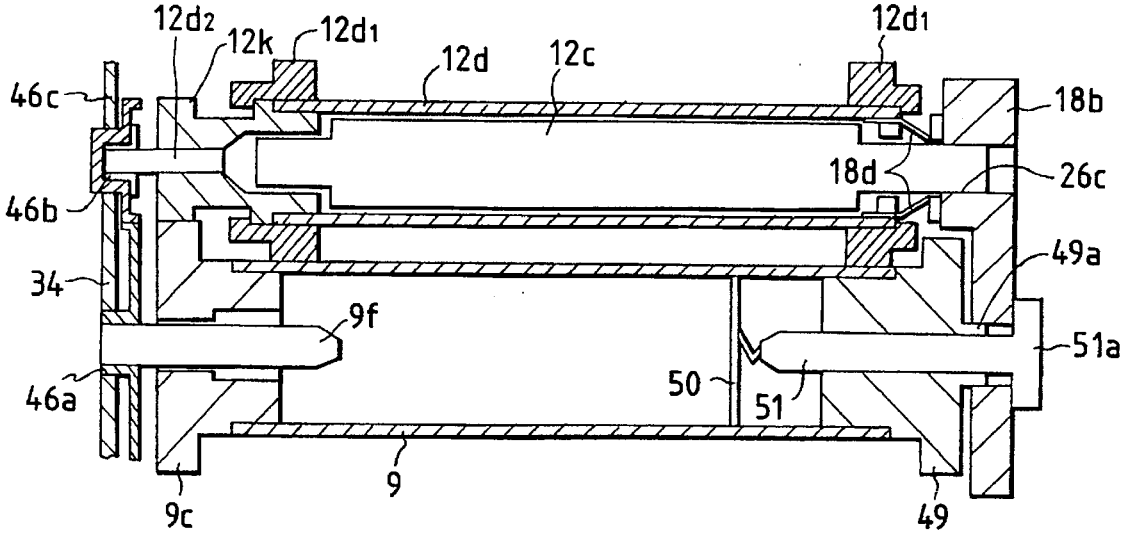
FIG. 55 is an elevational sectional view of bearing members for supporting the photosensitive drum and the developing sleeve, according to another embodiment.

Further, as shown in FIG. 35, in the first embodiment, while the photosensitive drum 9 and the developing sleeve 12*d* were supported by the bearing member 26, when the flange gear 9*c* is provided at one end of the photosensitive drum 9 and the transfer roller gear 49 is provided at the other end of the photosensitive drum, a structure as shown in FIG. 55 may be adopted. Incidentally, also in FIG. 55, elements having the same function as those in the first embodiment are designated by the same reference numerals.

More particularly, in FIG. 55, the flange gear 9*c* and the transfer roller gear 49 are secured to both ends of the photosensitive drum 9 by adhesive, press-fit or the like, respectively, the positioning of the drum is effected by rotatably supporting a central boss 49*a* of the transfer roller gear 49 by the bearing portion 33*a* of the bearing member 26. In this case, in order to earth the photosensitive drum 9, a drum earthing plate 50, having a central L-shaped contact portion, is secured to and contacted with the inner surface of the drum, and a drum earthing shaft 51 passing through a central bore in the transfer roller gear 49 is always contacted with the drum earthing plate 50. The drum earthing shaft 51 is made of conductive metal such as stainless steel, and the drum earthing plate 50 is also made of conductive metal such as bronze phosphate, stainless steel or the like. When the process cartridge B is mounted within the image forming system A, a head 51*a* of the drum earthing shaft 51 is supported by the bearing member 26. In this case, the head 51*a* of the drum earthing shaft 51 is contacted with the drum earthing contact pin of the image forming system, the earthing the photosensitive drum. Also in this case, as in the first embodiment, the positional accuracy between the photosensitive drum 9 and the developing sleeve 12*d* can be improved by using the single bearing member 26.

Further, the process cartridge B according to the present invention can be used to not only form a mono-color image as mentioned above, but also form a multi-color image (two color image, three color image or full-color image) by providing a plurality of developing means 12. Furthermore, the developing method may be of known two-component magnetic brush developing type., cascade developing type, touch-down developing type or cloud developing type. In addition, in the first embodiment, while the charger means was of the so-called contact-charging type, for example, other conventional charging technique wherein three walls are formed by tungsten wires and metallic shields made of aluminium are provided on the three walls, and positive or negative ions generated by applying a high voltage to the tungsten wires are shifted onto the surface of the photosensitive drum 9, thereby uniformly charging the surface of the photosensitive drum 9 may be adopted.

Incidentally, the contact-charging may be, for example, of blade (charging blade) type, pad type, block type, rod type or wire type, as well as the aforementioned roller type. Further, the cleaning means for removing the residual toner remaining on the photosensitive drum 9 may be of fur brush type or magnetic brush type, as well as blade type.

Furthermore, the process cartridge B comprises an image bearing member (for example, an electrophotographic photosensitive member) and at least one process means. Therefore, as well as the above-mentioned construction, the process cartridge may incorporate integrally therein the image bearing member and the charger means as a unit which can be removably mounted within the image forming system; or may incorporate integrally therein the image bearing member and the developing means as a unit which can be removably mounted within the image forming system; or may incorporate integrally therein the image bearing member and the cleaning means as a unit which can be removably mounted within the image forming system; or may incorporate integrally therein the image bearing member and two or more process means as a unit which can be removable mounted within the image forming system. That is to say, the process cartridge incorporates integrally therein the charger means, developing means or cleaning means and the electrophotographic photosensitive member as a unit which can be removably mounted within the image forming system; or incorporates integrally therein at least one of the charger means, developing means and cleaning means, and the electrophotographic photosensitive member as a unit which can be removably mounted within the image forming system; or incorporates integrally therein the developing means and the electrophotographic photosensitive member as a unit which can be removably mounted within the image forming system.

Further, in the illustrated embodiment, while the image forming system was-the electrophotographic copying machine, the present invention is not limited to the copying machine, but may be adapted to other various image forming system such as a laser beam printer, a facsimile, a word processor and the like.

Figure 56:
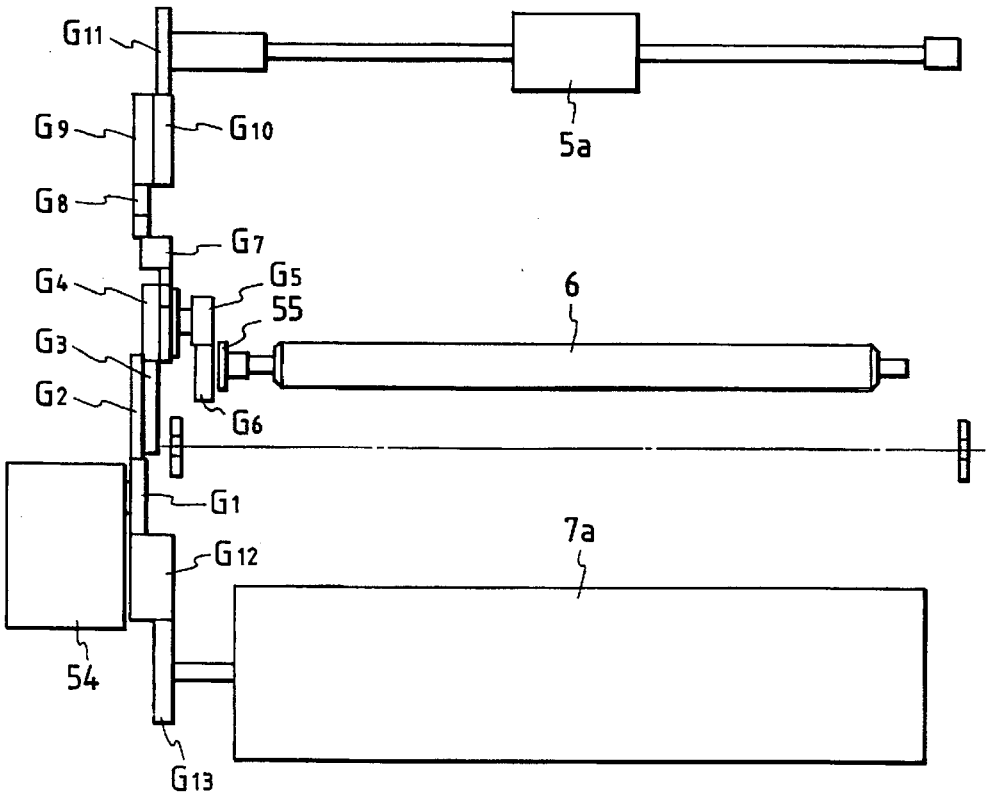
FIG. 56 is a schematic view of a transmission mechanism for transmitting a driving force from a drive motor of the image forming system to various elements.

Now, the above-mentioned driving force transmission to the photosensitive drum 9 will further explained with more detail. As shown in FIG. 56, the driving force is transmitted from the drive motor 54, attached to the body 16 of the image forming system, to a drive gear G6 via a gear train G1–G5, and from the drive gear G6 to the flange gear 9*c* meshed with the drive gear, thereby rotating the photosensitive drum 9. Further, the driving force of the drive motor 54 is transmitted from the gear G4 to a gear train G7–G11, thereby rotating the sheet supply roller 5*a*. Furthermore, the driving force of the drive motor 54 is transmitted from the gear G1 to the driving roller 7*a* of the fixing means 7 via gears G12, G13.

Figure 57:
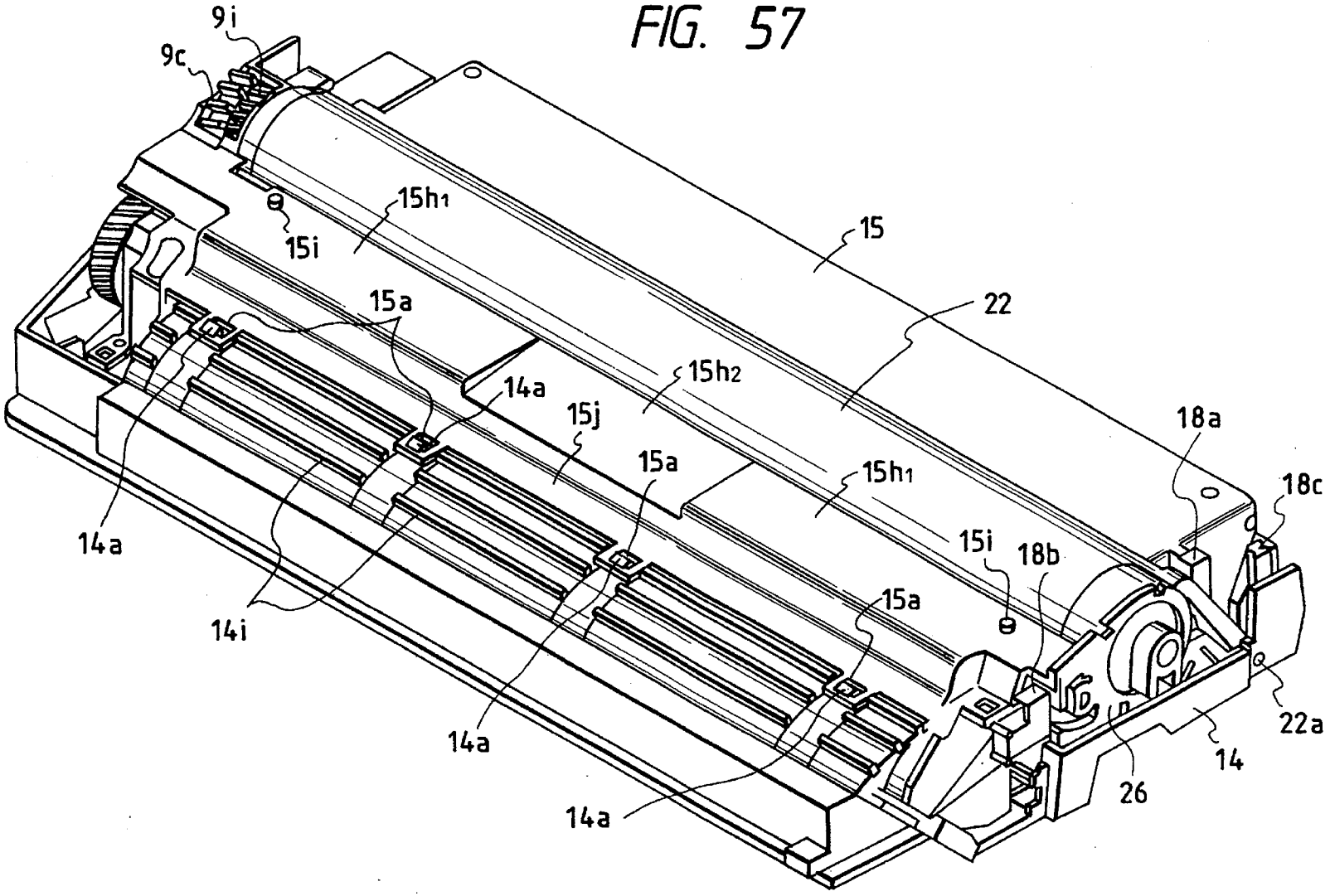
FIGS. 57 and 58 are perspective views showing a condition that the flange gear of the photosensitive drum and a gear integral with the flange gear are protruded from the lower frame.
Figure 58:
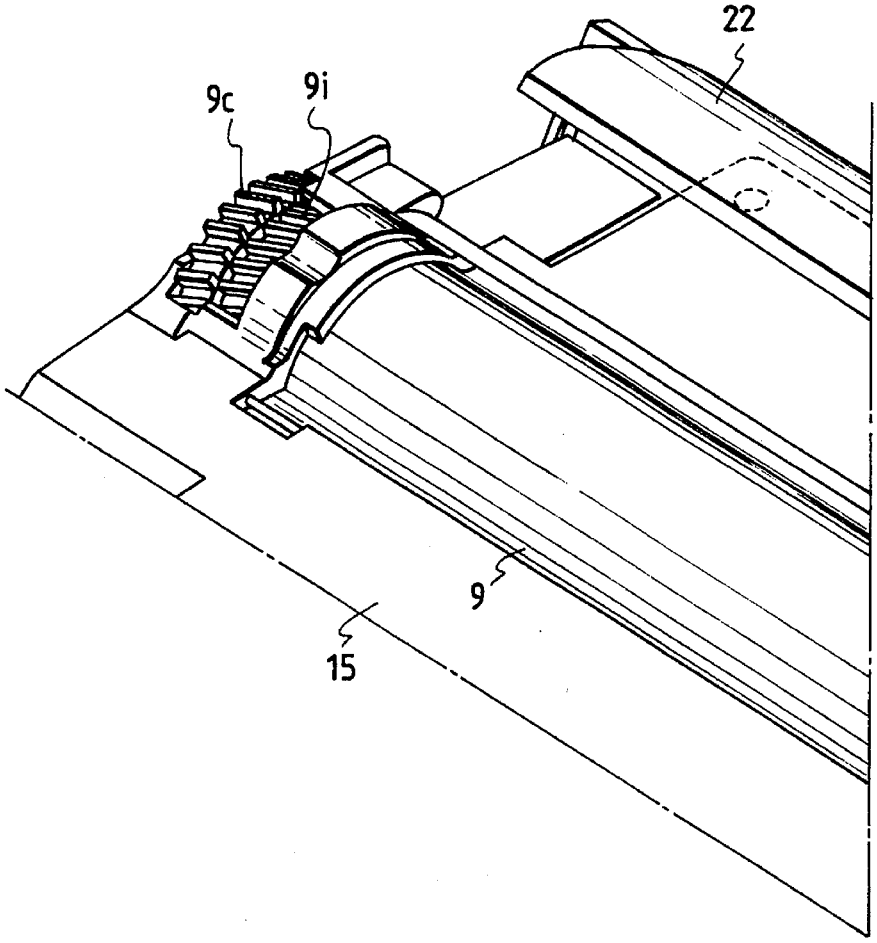
Figure 59:
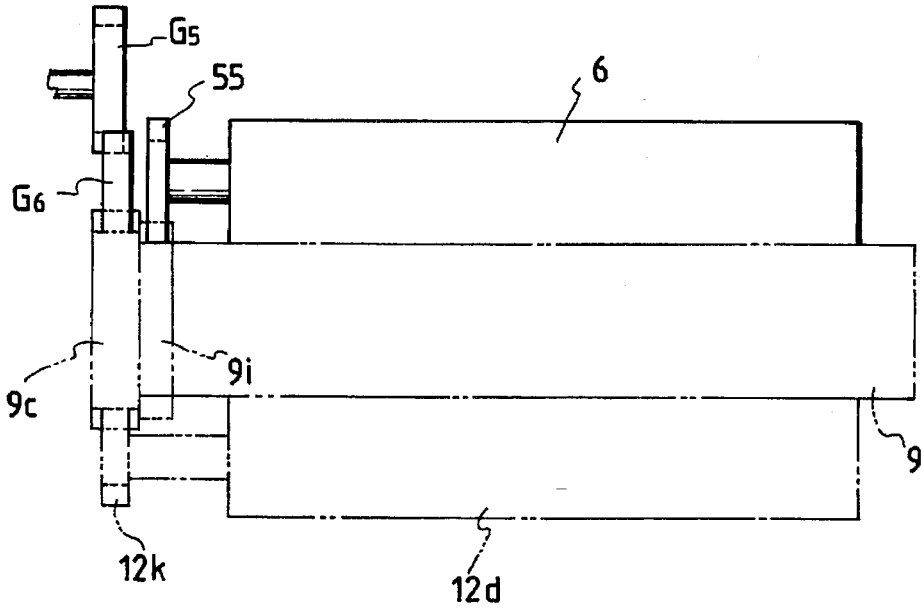
FIG. 59 is a view showing a gear train for transmitting a driving force from the drive gear of the image forming system to the photosensitive drum and the transfer roller.

Further, as shown in FIGS. 57 and 58, the flange gear (first gear) 9*c* and the gear (second gear) 9*i* are integrally formed and portions of the gears 9*c*, 9*i* are exposed from an opening 15*g* formed in the lower frame 15. When the process cartridge B is mounted within the image forming system A, as shown in FIG. 59, the drive gear G6 is meshed with the flange gear 9*c* of the photosensitive drum 9 and the gear 9*i*, integral with the gear 9*c*, is meshed with the gear 55 of the transfer roller 6. Incidentally, in FIG. 59, the parts of the image forming system are shown by the solid line, and the parts of the process cartridge are shown by the phantom line.

Figure 60A:
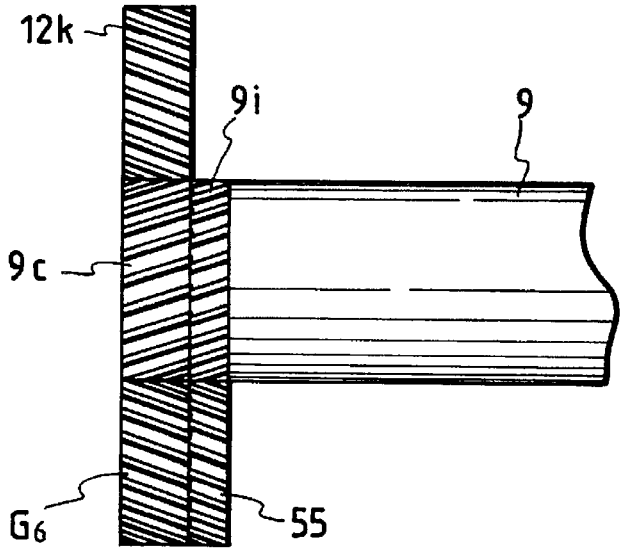
FIGS. 60A and 60B are views showing different drive transmitting mechanisms to developing sleeves, wherein magnetic toner is used and non-magnetic toner is used.
Figure 60B:
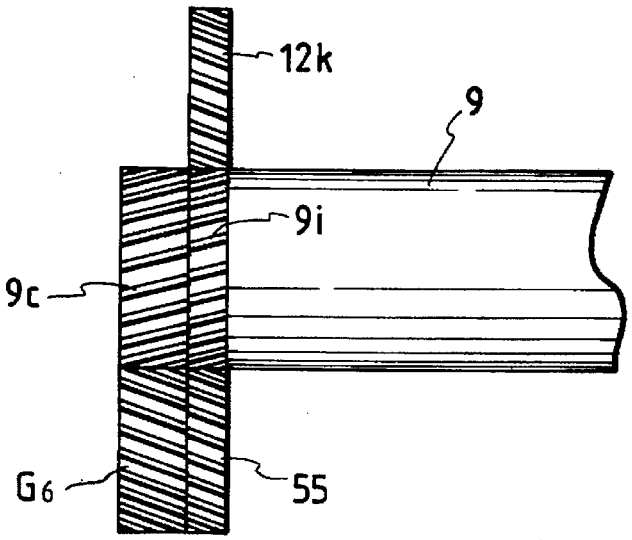

The number of teeth of the gear 9*c* is different from that of the gear 9*i*, so that the rotational speed of the developing sleeve 12*d* when the black image forming cartridge containing the magnetic toner is used is differentiated from the rotational speed of the developing sleeve when the color image forming cartridge containing the non-magnetic toner is used. That is to say, when the black image forming cartridge containing the magnetic toner is mounted within the image forming system, as shown in FIG. 60A, the flange gear 9*c* is meshed with the sleeve gear 12*k* of the developing sleeve 12*d*. On the other hand, when the color image forming cartridge containing the non-magnetic toner is mounted within the image forming system, as shown in FIG. 60B, the gear 9*i* is meshed with the sleeve gear 12*k* of the developing sleeve 12*d* to rotate the developing sleeve.

As mentioned above, since the gear 9*c* has the greater diameter and wider width than those of the gear 9*i* and has the number of teeth greater than that of the gear 9*i*, even when the greater load is applied to the gear 9*c*, the gear 9*c* can surely receive the driving force to rotate the photosensitive drum 9 surely and transmits the greater driving force to the developing sleeve 12*d* for the magnetic toner, thereby surely rotating the developing sleeve 12*d*.

As mentioned above, according to the present invention, since the optical means of the image forming system can be positioned by the positioning means of the process cartridge, it is possible to provide an image forming apparatus and a removable process cartridge therefor, which can improve the positional accuracy between the image bearing member and the optical means, thereby considerably enhancing the resultant image quality.

Further, according to the present invention, it is possible to provide an image forming apparatus and removable process cartridge therefor, which can form an image on an image bearing member with high accuracy, thereby considerably enhancing the resultant image quality, by positioning the image bearing member of the process cartridge with respect to an original support plate of the image forming system with high accuracy.

What is claimed is:

1. A process cartridge detachably mountable to a main body of an image forming system, the main body having optical means rockably attached thereto for irradiating a light beam corresponding to an image to an electrophotographic photosensitive member, said process cartridge comprising:

a first frame;

a second frame, separably engageable with said first frame to construct said process cartridge, said second frame including said electrophotographic photosensitive member and a positioning member for positioning the optical means of the main body relative to said electrophotographic photosensitive member when said process cartridge is mounted at a predetermined mount position on the main body of the image forming system; and process means for acting on said electrophotographic photosensitive member, wherein said positioning member passes through an opening formed in said first frame to position the optical means relative to said electrophotographic photosensitive member, when said process cartridge is mounted at the predetermined mount position on the main body of the image forming system.

2. A process cartridge according to claim 1, wherein said positioning member is disposed on said second frame at a position proximate to at least one of one end and the other end of said electrophotographic photosensitive member in a longitudinal direction thereof and said opening is provided on said first frame at a position proximate to at least one of the one end and the other end of an exposure opening for irradiating the light beam to said electrophotographic photosensitive member.

3. A process cartridge according to claim 1, wherein the main body of the image forming system has an openable/closable cover on which the optical means is rockably provided and which has a mount portion for mounting said process cartridge, and wherein said process cartridge mounted on the mount portion is positioned at a predetermined mount position on the main body of the image forming system by closing the openable/closeable cover.

4. A process cartridge according to claim 1, wherein a support member for supporting the optical means is provided with original platen positioning members so that an original platen provided on the main body of the image forming system rides over the platen positioning members.

5. A process cartridge according to claim 4, wherein the main body of the image forming system has an openable/closable cover on which the optical means is provided, the openable/closable cover having a mount portion for mounting said process cartridge, said original platen positioning members protruding from penetration holes formed proximate to each end of an exposure aperture formed in the openable/closable cover in a longitudinal direction thereof.

6. A process cartridge according to claim 1, wherein said process means comprises a developing roller provided on said second frame for developing a latent image formed on said electrophotographic photosensitive member, said developing roller supplying a toner to said electrophotographic photosensitive member.

7. A process cartridge according to claim 1, wherein said process means comprises a cleaning blade provided on said second frame and abutted to said electrophotographic photosensitive member for removing residual toner therefrom.

8. A process cartridge according to claim 1, wherein said process means includes a charge roller provided in said first frame and abutted to and charging said electrophotographic photosensitive member.

9. A process cartridge according to claims 1, 4, or 5, wherein the optical means has a lens for leading a light emitted from a lamp and reflected by an original surface to said electrophotographic photosensitive member.

10. A process cartridge according to claim 1, wherein said first frame and said second frame are separately connected by engaging a hook member provided on said first frame within an engage portion provided on said second frame.

11. A process cartridge according to claim 10, wherein said engage portion has a plurality of engage openings.

12. A process cartridge according to claim 10, wherein said engage portion has a plurality of locking projections.

13. An image forming system having a main body onto which a process cartridge is removably mountable and which forms an image onto a recording medium, said image forming system comprising:

optical means provided for irradiating an information light beam corresponding to an image to an electrophotographic photosensitive member disposed in the process cartridge;

mount means for removably mounting a process cartridge, the process cartridge including (i) a first frame, (ii) a second frame, separably engageable with the first frame to construct the process cartridge, the second frame including the electrophotographic photosensitive member and positioning members for positioning said optical means relative to the electrophotographic photosensitive member when the process cartridge is mounted at a predetermined mount position on said main body of said image forming system, and (iii) process means for acting on the electrophotographic photosensitive member disposed in the second frame, wherein the positioning members pass through openings formed in the first frame to position said optical means relative to the electrophotographic photosensitive member, when the process cartridge is mounted at the predetermined mount position on said main body of said image forming system; and convey means for conveying the recording medium.

14. An image forming system according to claim 13, wherein said optical means includes a lens and a lamp supported by a support member, and wherein the positioning members position said support member by abutment of the positioning members to said support member.

15. An image forming system according to claim 13, wherein the positioning members are disposed on the second frame at positions proximate to one end and the other end of the electrophotographic photosensitive member in a longitudinal direction thereof and the openings are provided on the first frame at positions proximate to one end and the other end of an exposure opening for irradiating the light beam to the electrophotographic photosensitive member.

16. An image forming system according to claim 13, wherein said main body of said image forming system includes an openable/closable cover on which said optical means is rockably provided, said openable/closable cover having a mount portion for mounting the process cartridge, the process cartridge mounted on said mount portion being located at the predetermined mount position on said main body of said image forming system by closing said openable/closable cover.

17. An image forming system according to claim 13, wherein a support member supporting said optical means is provided with original platen positioning members so that an original platen provided on said main body of said image forming system rides over said original platen positioning members upon moving.

18. An image forming system according to claim 17, wherein said main body of said image forming system has an openable/closable cover on which said optical means is provided, said openable/closable cover having a mount portion for mounting the process cartridge, and wherein said original platen positioning members protrude from penetration holes formed proximate to each end of an exposure aperture formed in said openable/closable cover in a longitudinal direction thereof.

19. An image forming system according to claims 13, 17, or 18, wherein said optical means has a lens for leading a light emitted from a lamp and reflected by an original surface to the photosensitive member.

20. An image forming system according to claim 19, wherein said lens and said lamp are supported by said support member, said positioning members positioning said support member by abutment of said positioning members to said support member.

21. An image forming system according to claim 13, wherein the process means comprises a developing roller provided on the second frame for developing a latent image formed on the electrophotographic photosensitive member, the developing roller supplying a toner to the electrophotographic photosensitive member.

22. An image forming system according to claim 13 or 21, wherein the process means comprises a cleaning blade provided on the second frame and abutted to the electrophotographic photosensitive member for removing residual toner therefrom.

23. An image forming system according to claim 13 or 21, wherein the process means comprises a charge roller abutted to and charging the electrophotographic photosensitive member.

24. A process cartridge removably mountable onto a main body of an electrophotographic photosensitive image forming system including an original setting platen on which an original is set, a lamp for irradiating a surface of the original set on the original setting platen with a light beam, a lens for introducing a reflected light from the original surface to an electrophotographic photosensitive member, and a rockable support member for supporting the lamp and the lens, said process cartridge comprising:

an electrophotographic photosensitive drum, a charge roller abutted to and charging said electrophotographic photosensitive drum;

a developing roller that supplies toner to said electrophotographic photosensitive drum for developing a latent image formed on said electrophotographic photosensitive drum;

a cleaning blade abutted to said electrophotographic photosensitive drum for removing residual toner therefrom;

a lower frame provided with said electrophotographic photosensitive drum, said developing roller, and said cleaning blade, said lower frame being located at a lower position when said process cartridge is mounted in a predetermined position on the main body of the image forming system;

an upper frame provided with said charge roller and a toner containing portion for containing the toner to be used by said developing roller, said upper frame being located at an upper position when said process cartridge is mounted in the predetermined position on the main body of the image forming system, said upper frame being separably connected with said lower frame; and positioning members provided on said lower frame and protruding from penetration holes formed on said upper frame, for abutting to and positioning the support member supporting the lamp and the lens when said process cartridge is mounted onto the main body of the image forming system.

25. A process cartridge according to claim 24, wherein said positioning members are disposed on said lower frame at positions proximate to one end and the other end of said electrophotographic photosensitive drum in a longitudinal direction thereof, and the penetration holes are provided in said upper frame at positions proximate to one end and the other end of an exposure aperture for irradiating the light beam to said electrophotographic photosensitive drum.

26. A process cartridge according to claim 24, wherein the main body of the image forming system comprises an openable/closable cover on which the support member is rockably supported and which includes a mount portion for mounting said process cartridge, and wherein said process cartridge mounted on the mount portion is positioned at a predetermined mount position on the main body of the image forming system by closing the openable/closable cover.

27. A process cartridge according to claim 24, wherein the support member is further provided with an original platen positioning member so that an original platen rides over the original platen positioning member upon moving.

28. A process cartridge according to claim 27, wherein the main body of the image forming system comprises an openable/closable cover on which the support member is rockably provided, the openable/closable cover having a mount portion for mounting said process cartridge, the original platen positioning member protruding from penetration holes formed proximate to each end of an exposure aperture formed on the openable/closable cover in a longitudinal direction thereof.

29. A process cartridge removably mounted onto a main body of an image forming system including a reciprocally movable original setting glass on which an original is set, a lamp for irradiating a surface of the original set on the original setting glass, a lens for introducing a reflected light from a surface of the original to an electrophotographic photosensitive drum, a lens unit rockably supporting the lamp and the lens, original setting glass positioning members provided on the lens unit such that the original setting glass, upon moving, rides over the original setting glass positioning members, and an openable/closable cover having a mount portion for mounting said process cartridge, said lens unit being rockably provided on the openable/closable cover and the original setting glass positioning members protruding from penetration holes disposed proximate to each end of an exposure aperture formed on the openable/closable cover in a longitudinal direction thereof, said process cartridge comprising:

an electrophotographic photosensitive drum;

a charge roller abutted to and charging said electrophotographic photosensitive drum;

a developing roller supplying toner to said electrophotographic photosensitive drum for developing a latent image formed on said electrophotographic photosensitive drum;

a cleaning blade abutted to said electrophotographic photosensitive drum for removing residual toner therefrom;

a lower frame provided with said electrophotographic photosensitive drum, said developing roller, and said cleaning blade, said lower frame being located at a lower position when said process cartridge is mounted on a mount portion provided on the openable/closable cover and when the openable/closable cover is closed;

an upper frame provided with said charge roller and a toner container portion for containing the toner to be used by said developing roller, said upper frame being located at an upper position when said process cartridge is mounted on the mount portion provided on the openable/closable cover and when the openable/closable cover is closed, said upper frame being separably connected with said lower frame; and positioning members provided on said lower frame and protruding from penetration holes formed in said upper frame, for abutting and positioning the lens unit supporting the lamp and the lens when said process cartridge is mounted on the mount portion provided on the openable/closable cover and when the openable/closable cover is closed, said positioning members being provided on said lower frame at positions proximate to one and the other end of said electrophotographic photosensitive drum in a longitudinal direction thereof, said penetration holes formed in said upper frame being provided proximate to one end and the other end of an exposure aperture for irradiating the reflected light to said electrophotographic photosensitive drum.

30. A process cartridge according to claim 29, wherein the original setting glass positioning members protrude from said penetration holes disposed proximate to each end of an exposure aperture formed on the openable/closable cover in a longitudinal direction thereof.

31. An electrophotographic image forming system for forming an image on a recording medium, said image forming system comprising:

an original setting platen on which an original is set;

a lamp for irradiating a surface of the original set on said original setting platen with a light beam;

a lens for introducing a reflected light from the surface of the original to an electrophotographic photosensitive member;

a rockable support member for supporting said lamp and the lens; and mount means for removably mounting a process cartridge that includes:

an electrophotographic photosensitive drum;

a charge roller abutted to the electrophotographic photosensitive drum for charging the electrophotographic photosensitive drum;

a developing roller that supplies toner to the electrophotographic photosensitive drum for developing a latent image formed on the electrophotographic photosensitive drum;

a cleaning blade abutted to the electrophotographic photosensitive drum for removing residual toner therefrom;

a lower frame provided with the electrophotographic photosensitive drum, the developing roller, and the cleaning blade, the lower frame being located at a lower position when the process cartridge is mounted in a predetermined position on a main body of said electrophotographic image forming system;

an upper frame provided with the charge roller and a toner container portion for containing the toner to be used by the developing roller therein, the upper frame being located at an upper position when the process cartridge is mounted in the predetermined position on said main body of said electrophotographic image forming system, the upper frame being separably connected to the lower frame; and positioning members, provided on the lower frame and protruding from penetration holes formed on the upper frame, to be abutted to and positioning the support member when the process cartridge is mounted onto said main body of said electrophotographic image forming system.

32. An image forming system according to claim 31, wherein the positioning members are disposed on the lower frame at positions proximate to one end and the other end of the electrophotographic photosensitive member in a longitudinal direction thereof, and the penetration holes are provided on the upper frame at positions proximate to one end and the other end of an exposure aperture for irradiating the light beam to the electrophotographic photosensitive member.

33. An image forming system according to claim 31, wherein an openable/closable cover is provided on said main body of said image forming system, said support member being rockably provided on the openable/closable cover having a mount portion for mounting the process cartridge, and wherein the process cartridge mounted on said mount portion is positioned at a predetermined mount position on said main body of said image forming system when said openable/closable cover is closed.

34. An image forming system according to claim 31, wherein said support member is further provided with original platen positioning members so that said original setting platen rides over said original platen positioning members upon moving.

35. An image forming system according to claim 34, wherein said main body of said image forming system comprises an openable/closable cover on which said support member is rockably provided and which has a mount portion for mounting the process cartridge, said original platen positioning members protruding from penetration holes formed proximate to each end of an exposure aperture formed on said openable/closable cover in a longitudinal direction thereof, and the process cartridge mounted on said mounted portion being positioned at a predetermined mount position on said main body of said image forming system.

36. An electrophotographic image forming system for forming an image on a recording medium, said image forming system comprising:

an original setting glass on which an original is set and reciprocally movable;

a lamp for irradiating a surface of the original set on said original setting glass;

a lens for introducing a reflected light from the original surface to an electrophotographic photosensitive drum;

a lens support member for rockably supporting said lamp and said lens;

original setting glass positioning members provided on a lens unit and on which said original setting glass rides over upon moving;

an openable/closable cover having a mount member for removably mounting a process cartridge, said original setting glass positioning members protruding from penetration holes disposed proximate to each end of an exposure aperture formed on said openable/closable cover in a longitudinal direction thereof; and a mount member for removably mounting the process cartridge, the process cartridge including:

an electrophotographic photosensitive drum;

a charge roller abutted to and charging the electrophotographic photosensitive drum;

a developing roller supplying toner to the electrophotographic photosensitive drum by rotation thereof for developing a latent image formed on the electrophotographic photosensitive drum;

a cleaning blade abutted to the electrophotographic photosensitive drum for removing residual toner therefrom;

a lower frame provided with the electrophotographic photosensitive drum, the developing roller and the cleaning blade, the lower frame being located at a lower position when the process cartridge is mounted on said mount member provided on said openable/closable cover and when said openable/closable cover is closed;

an upper frame provided with the charge roller and a toner containing portion for containing the toner to be used by the developing roller, the upper frame being located at an upper position when the process cartridge is mounted on said mount member provided on said openable/closable cover and when said openable/closable cover is closed, the upper frame being separably connected to the lower frame; and positioning members provided on the lower frame and protruding from penetration holes formed on the upper frame, abutting to and positioning said lens support member supporting the lens when the process cartridge is mounted on said mount member and when said openable/closable cover is closed, said positioning members being provided on the lower frame at positions proximate to one and the other end of the electrophotographic photosensitive drum in a longitudinal direction thereof, the penetration holes formed on the upper frame being proximate to one end and the other end of an exposure aperture for irradiating the reflected light to the electrophotographic photosensitive drum.

37. An image forming system according to claim 36, wherein said original setting glass positioning members protrude from the penetration holes disposed proximate to each end of an exposure aperture formed on said openable/closable cover in a longitudinal direction thereof.

38. A process cartridge according to claim 24 or 29, wherein said lower frame and said upper frame are separably connected by engaging a lock member provided on said upper frame with an engage portion provided on said lower frame.

39. A process cartridge according to claim 38, wherein said engage portion has a plurality of engage openings.

40. A process cartridge according to claim 38, wherein said engage portion has a plurality of locking projections.

* * * * *

UNITED STATES PATENT AND TRADEMARK OFFICE

CERTIFICATE OF CORRECTION

PATENT NO. : 5,659,847

DATED : August 19, 1997

INVENTOR(S) : TADAYUKI TSUDA, ET AL.

It is certified that error appears in the above-identified patent and that said Letters Patent is hereby corrected as shown below:

[57] ABSTRACT:

Line 3, "means" should read --unit--.

COLUMN 1:

Line 36, "disclosed" should read --disclosed in--;
Line 41, "of" should read --of the--; and
Line 50, "disclose" should read --disclosed--.

COLUMN 2:

Line 15, "yet" should read --Yet--;
Line 57, "an earthing" should read --a grounding--; and
Line 63, "Charger" should read --charger--.

COLUMN 3:

Line 44, "end" should read --ends--.

COLUMN 4:

Line 30, "view" should read --view of--.

COLUMN 5:

Line 14, "manually" should read --or manually--.

COLUMN 6:

Line 50, "members" should read --member--.

UNITED STATES PATENT AND TRADEMARK OFFICE

CERTIFICATE OF CORRECTION

PATENT NO. : 5,659,847

DATED : August 19, 1997

INVENTOR(S) : TADAYUKI TSUDA, ET AL.

It is certified that error appears in the above-identified patent and that said Letters Patent is hereby corrected as shown below:

COLUMN 7:

Line 4, delete "a";
Line 6, "flow" should read --flowing--; and
Line 11, "tray" should read --tray 3--.

COLUMN 8:

Line 41, "tray" should read --try--.

COLUMN 9:

Line 2, "9" should read --9,--;
Line 16, "seems" should read --seems to be--;
Line 20, "the" should read --to the--;
Line 41, "an" should read --a--; and
Line 44, "ground" should read --grounding--.

COLUMN 10:

Line 50, "earthing" should read --ground--;
Line 59, "earthing" should read --ground--; and
Line 61, "earthing" should read --ground--.

COLUMN 11:

Line 35, "along" should read --alone--.

COLUMN 12:

Line 28, "cartridge" should read --cartridge B--.

UNITED STATES PATENT AND TRADEMARK OFFICE

CERTIFICATE OF CORRECTION

PATENT NO. : 5,659,847

DATED : August 19, 1997

INVENTOR(S) : TADAYUKI TSUDA, ET AL.

It is certified that error appears in the above-identified patent and that said Letters Patent is hereby corrected as shown below:

COLUMN 13:

Line 17, "or '" should read --or--;
Line 21, "rosin" (both occurrences) should read --resin--; and
Line 62, "are" should read --is--.

COLUMN 14:

Line 37, "the" should read --each--.

COLUMN 16:

Line 13, "12d," should read --12d1--; and
Line 59, "opment" should read --oping--.

COLUMN 18:

Line 1, "the" (first occurrence) should read --thus--;
Line 14, "The" should read --the--;
Line 37, "Squeegee" should read --squeegee--; and
Line 42, "it" should read --if--.

COLUMN 20:

Line 57, "as" should read --as is--.

COLUMN 21:

Line 2, "thick" should read --thick and--; and
Line 44, "and" should read --and more--.

UNITED STATES PATENT AND TRADEMARK OFFICE

CERTIFICATE OF CORRECTION

PATENT NO. : 5,659,847

DATED : August 19, 1997

INVENTOR(S) : TADAYUKI TSUDA, ET AL.

It is certified that error appears in the above-identified patent and that said Letters Patent is hereby corrected as shown below:

COLUMN 22:

Line 11, "palyurethane" should read --polyurethane--;
Line 29, "12eand" should read --12e and--; and
Line 35, "the" (second occurrence) should be deleted.

COLUMN 23:

Line 8, "lublicant" should read --lubricant--;
Line 13, "lublicant" should read --lubricant--;
Line 26, "lublicant" should read --lubricant--;
Line 27, "lublicant" should read --lubricant--;
Line 51, "photosensitived" should read --photosensitive--;
Line 52, "rum" should read --drum--; and
Line 63, "between" should be deleted.

COLUMN 24:

Line 1, "earthing" should read --ground--;
Line 4, "earthing" should read --ground--;
Line 24, "earthing" should read --ground--;
Line 25, "earthing" should read --grounding--;
Line 28, "Of" should read --of--; and
Line 56, "shin" should read --Shin--.

COLUMN 25:

Line 59, "resister" should read --register--.

UNITED STATES PATENT AND TRADEMARK OFFICE

CERTIFICATE OF CORRECTION

PATENT NO. : 5,659,847

DATED : August 19, 1997

INVENTOR(S) : TADAYUKI TSUDA, ET AL.

It is certified that error appears in the above-identified patent and that said Letters Patent is hereby corrected as shown below:

COLUMN 26:

Line 28, "guided" should read --guided by--; and
Line 62, "9" should read --9,--.

COLUMN 27:

Line 26, "earthing" should read --ground--.

COLUMN 29:

Line 10, "forming-system" should read --forming system--.

COLUMN 30:

Line 15, "system and a removable process" should be deleted;
Line 16, "cartridge therefor" should read --the photosensitive drum 9 with--; and
Line 22, "photosensitive," should read --photosensitive--.

COLUMN 31:

Line 4, "rotary'" should read --rotary--; and
Line 26, "slide" should read --slid--.

COLUMN 32:

Line 13, "particularly,." should read --particularly,--; and
Line 47, "separated," should read --separated--.

UNITED STATES PATENT AND TRADEMARK OFFICE

CERTIFICATE OF CORRECTION

PATENT NO. : 5,659,847

DATED : August 19, 1997

INVENTOR(S) : TADAYUKI TSUDA, ET AL.

It is certified that error appears in the above-identified patent and that said Letters Patent is hereby corrected as shown below:

COLUMN 33:

Line 4, "15a" should read --15b--; and
Line 15, "become" should read --becomes--.

COLUMN 34:

Line 39, "25a" (second occurrence) should read --25b--.

COLUMN 35:

Line 10, "the" (second occurrence) should read --thus--;
Line 24, "technique" should read --techniques--; and
Line 67, "was-the" should read --was the--.

COLUMN 36:

Line 3, "system" should read --systems--; and
Line 6, "will" should read --will be--.

Signed and Sealed this

Eighteenth Day of August, 1998

Bruce Lehman

*Attest:*

BRUCE LEHMAN

*Attesting Officer*

*Commissioner of Patents and Trademarks*